US005839048A

United States Patent [19]

Kato

[11] Patent Number: 5,839,048

[45] **Date of Patent: *Nov. 17, 1998**

[54] SHEET POST-PROCESSING APPARATUS AND IMAGE FORMING APPARATUS HAVING SAME

[75] Inventor: Katsuhito Kato, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 779,028

[22] Filed: Jan. 6, 1997

Related U.S. Application Data

[63] Continuation of Ser. No. 537,448, Oct. 2, 1995, abandoned.

[30] Foreign Application Priority Data

Sep. 30, 1994 [JP] Japan ..... 6-261484

[51] Int. Cl.[6] ..... G03G 15/00

[52] U.S. Cl. ..... 399/407; 270/58.09; 270/58.12; 270/58.27; 399/408; 399/410

[58] Field of Search ..... 399/407, 408, 399/410; 270/58.08, 58.09, 58.12, 58.14, 58.16, 58.19, 58.27

[56] References Cited

U.S. PATENT DOCUMENTS

| | | | |
|---|---|---|---|
| 5,185,628 | 2/1993 | Wilson et al. | 355/313 X |
| 5,203,550 | 4/1993 | Kawano et al. | 270/53 |
| 5,222,721 | 6/1993 | Miura et al. | 270/53 X |
| 5,384,634 | 1/1995 | Takehara et al. | 355/324 X |
| 5,443,248 | 8/1995 | Hayashi et al. | 270/53 |
| 5,542,655 | 8/1996 | Murakami | 355/324 X |
| 5,700,002 | 12/1997 | Kato et al. | 270/58.12 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A sheet post processing apparatus includes at least one sheet receiving tray for accommodating sheets; a sheet discharging device for discharging sheets to the said sheet receiving tray; a sheet processing device for processing sheets accommodated on the sheet receiving tray; a reference member for guiding edges of the sheets on the sheet receiving tray and for functioning as a reference for alignment of the sheets to a reference position; an aligning member movable to a predetermined alignment position to urge the sheets on the receiving tray to the reference member; a device for changing a reference position of the reference member to make constant a distance from an edge of the sheet to a position where the sheets are processed by the sheet processing device.

22 Claims, 66 Drawing Sheets

FIG. 10

| TYPE OF BINDING | SIZE | MULTIGUIDE 156 | SWINGING GUIDE 55b |
|---|---|---|---|
| ONE FRONT PORTION. IS BOUND | A4 B5 LTR | 1 | 3 |
| | A3 B4 A4R LGL LDL | 5 | 3 |
| ONE REAR PORTION IS BOUND | A4R | 3 | 2 |
| | LGL LTRR | 4 | 4 |
| TWO PORTIONS ARE BOUND | A4 | 1 | 3 |
| | B5 | 1 | 1 |
| | LTR | 1 | 2 |
| | A3 | 5 | 3 |
| | B4 | 2 | 1 |
| | LDR | 3 | 2 |

| FIG. 34A |
| --- |
| FIG. 34B |

| FIG. 35A |
| --- |
| FIG. 35B |

SHEET POST-PROCESSING APPARATUS AND IMAGE FORMING APPARATUS HAVING SAME

This application is a continuation of application Ser. No. 08/537,448 filed Oct. 2, 1995, now abandoned.

FIELD OF THE INVENTION AND RELATED ART

The present invention relates to a sheet post-processing apparatus, more particularly to a sheet post-processing apparatus for post-processing sheets such as copy sheets, after sorted or accommodated on sheet trays, the sheets being discharged from an image forming apparatus such as a copying machine, printer, laser beam printer or the like.

Heretofore, in a sheet post-processing apparatus having a binding means (stapler) retractable relative to a bin tray, the stapler 501, as shown in FIG. 64, is advanced to a predetermined position (e.g. a front corner, or two end edges) of the bin tray B, and staples sets or bundles of sheets on the bin tray B.

Before the stapling operation by the stapler 501, the sets of sheets sorted and accommodated on the bin trays B, are aligned by abutting edges of the sheets to a reference guide 503 by a movable aligning guide 502.

However, in the conventional example, if the sizes of the sheets sorted and accommodated on the bin trays are different, the stapling positions are different. For example, as shown in FIG. 64, when the edges of the A4 size sheets 504A and B5 size sheets 504B are stapled at two positions, the staple positions are symmetrical (a1=a2) in the case of A4 size sheets but not for the B5 size sheets (b1>b2).

SUMMARY OF THE INVENTION

Accordingly, it is a principal object of the present invention to provide an apparatus with which the staple positions are symmetrical for a plurality of sizes of sheets (A4 or B5, or the like).

According to an aspect of the present invention, there is provided a sheet post processing apparatus, comprising at least one sheet receiving tray for accommodating sheets; sheet discharging means for discharging sheets to said sheet receiving tray; sheet processing means for processing sheets accommodated on said sheet receiving tray; a reference member for guiding edges of the sheets on said sheet receiving tray and for functioning as a reference for alignment of the sheets to a reference position; an aligning member movable to a predetermined alignment position to urge the sheets on the receiving tray to the reference member; means for changing a reference position of said reference member to make constant a distance from an edge of the sheet to a position where the sheets are processed by said sheet processing means.

With this structure, the reference position for the alignment is made different depending on the sizes of sheets, so that the distances from the staple positions to the ends are equal.

Additionally, in the case of corner stapling at the alignment side, the distance from the staple position and the edge is constant irrespective of the sizes of the sheets.

When the stapling is effected at a corner of the alignment side, the staple position at the corner of the alignment side and an edge staple position at the alignment side are made the same, by changing the reference position in accordance with the size of the sheet. By doing so, it becomes unnecessary to enlarge the cut-away portion of the sheet receiving tray for the corner stapling at the alignment side, thus avoiding the reduction of the rigidity and stacking property of the sheet receiving tray.

The sheet post-processing apparatus is provided with an operation panel for inputting signals for the sheet alignment or stapling. When there is no input before the operation, the post processing operation is carried out after operation of the apparatus, in accordance with the signals therefrom, and therefore, the operatively to permit various types of operations.

BRIEF DESCRIPTION OF THE DRAWINGS

FIG. 10 is a diagram showing the operation relationship among the reference guide, the aligning rod and the multiguide;

DESCRIPTION OF THE PREFERRED EMBODIMENTS

An embodiment of a sheet processing apparatus according to the present invention will now be described with reference to the drawings.

Figure 1:
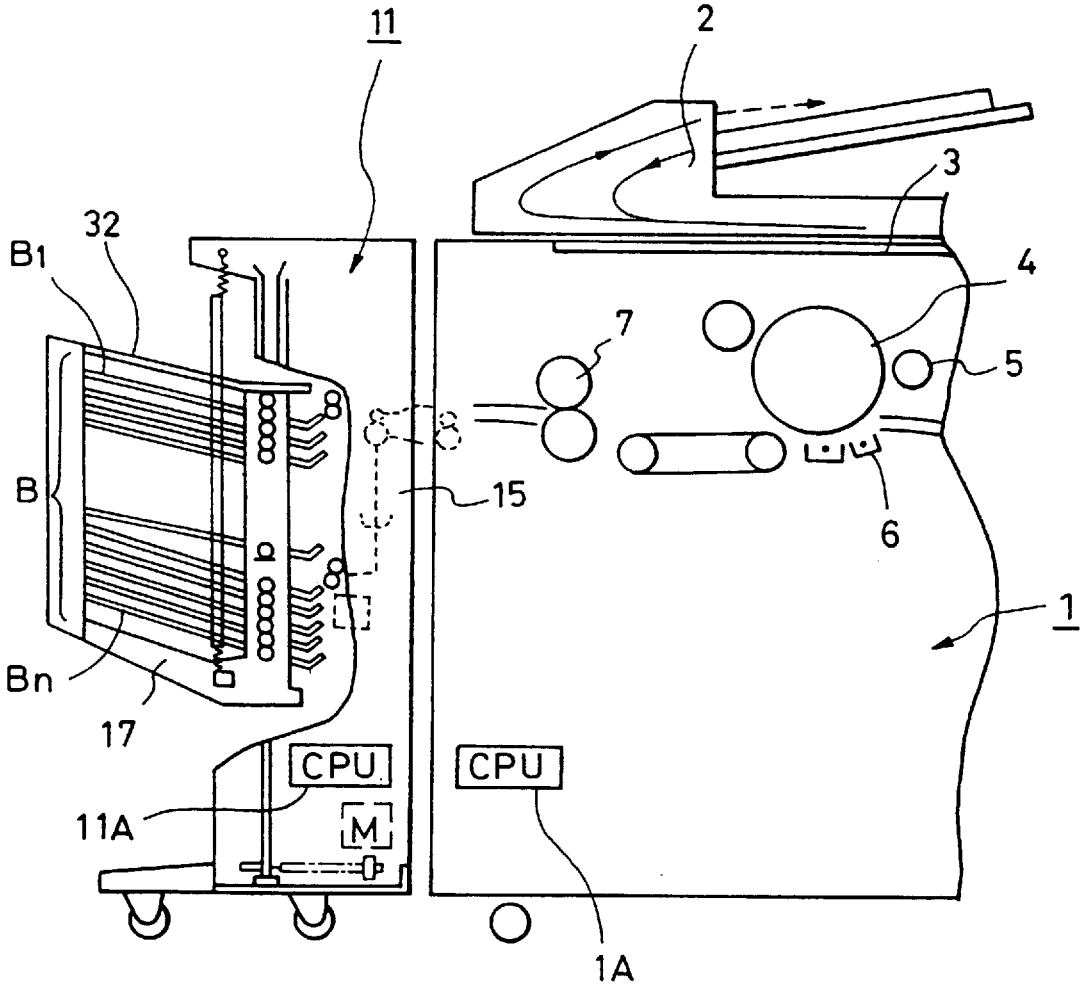
FIG. 1 is a vertical side cross sectional view showing a sheet processing apparatus and an image processing apparatus comprising the sheet processing apparatus according to the present invention.

The sheet processing apparatus according to the present invention will now be described with reference to the drawings. FIG. 1 is a schematic view showing the structure of a sheet processing apparatus according to the present invention. In this embodiment, a sheet processing apparatus provided for an image processing apparatus, such as a copying machine, will now be described.

As shown in FIG. 1, the image processing apparatus 1 has the top surface, on which an automatic original-document feeding apparatus 2 for automatically moving the original document is disposed. In the downstream (in the left portion of FIG. 1) of the image processing apparatus 1, a sheet processing apparatus (hereinafter called a "sorter") 11 having a bin trays B (B1, B2, . . . , Bn) is attached.

The image processing apparatus 1 is adapted to a known electrophotographic method, the detailed description of which is omitted here and in which the image of an original document located on a platen glass 3 is, by an optical system (not shown), formed on a photosensitive drum 4; and the image is transferred onto the sheet by a developing unit 5, a transferring electrode 6 and the like; and a fixing unit 7 permanently fixes the image on to the sheet.

(Overall Structure of Sheet Processing Apparatus)

Figure 2:
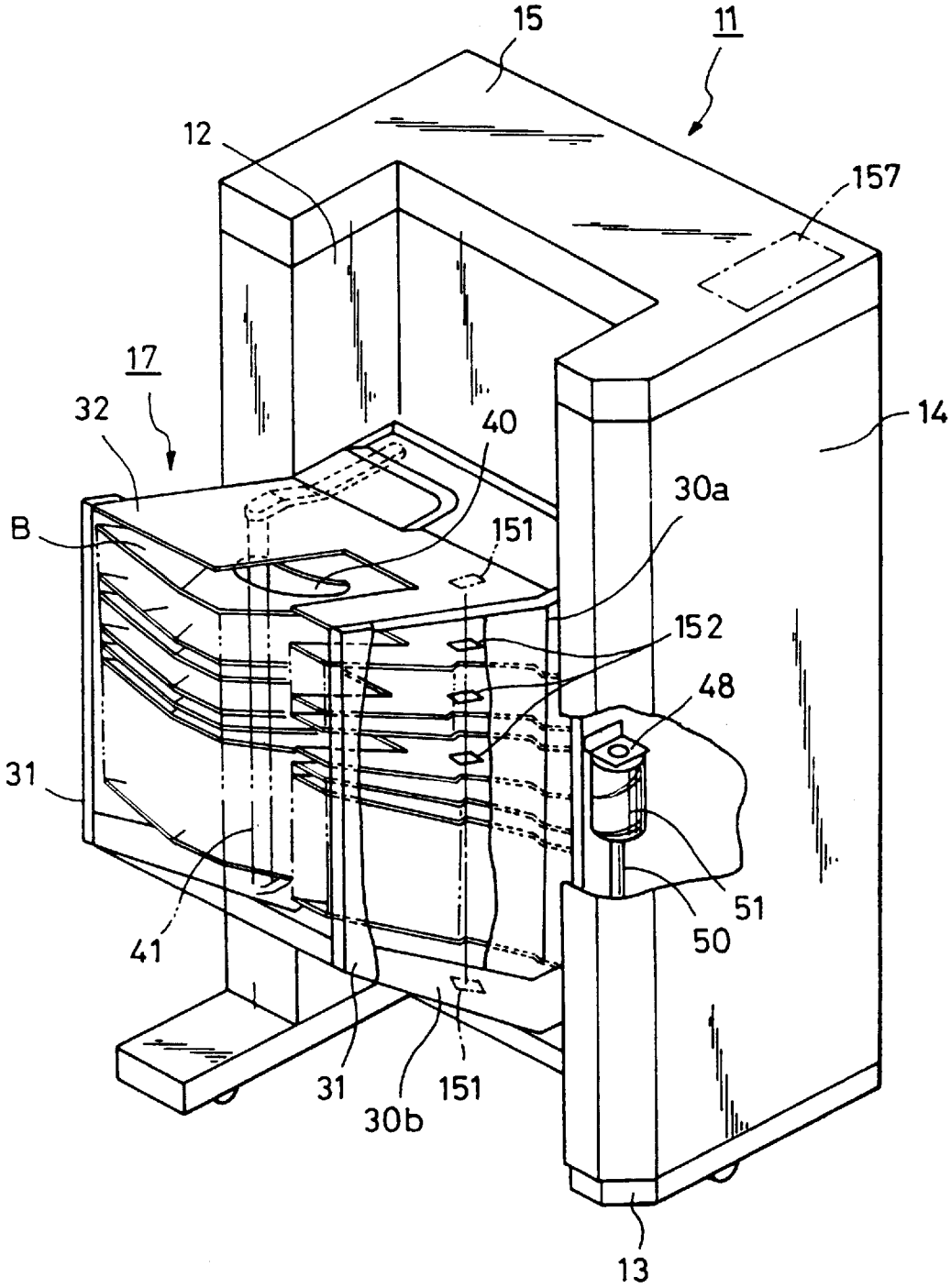
FIG. 2 is a partially-broken perspective view showing the sheet processing apparatus.
Figure 3:
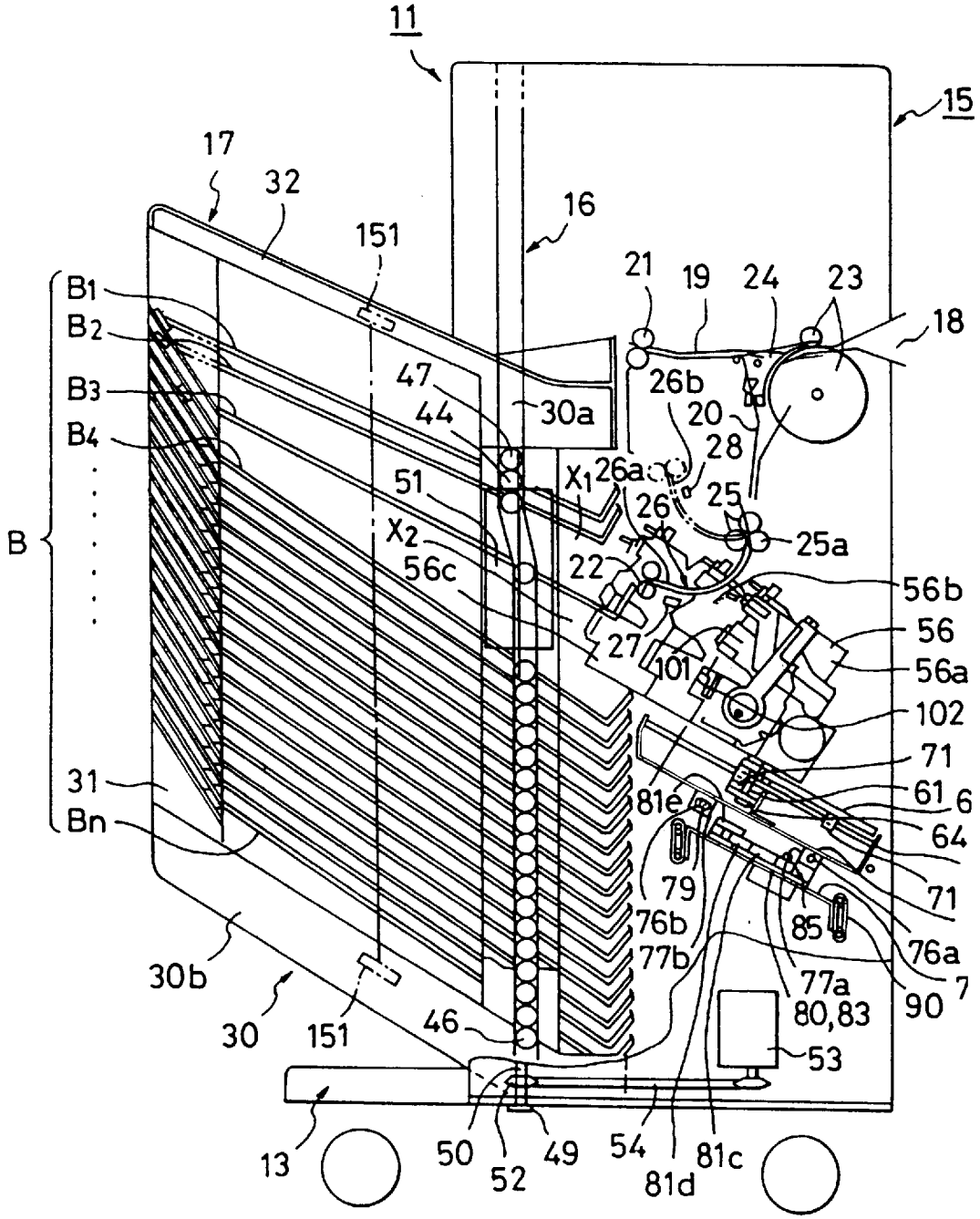
FIG. 3 is a vertical side cross sectional view showing the sheet processing apparatus.

The sorter 11, as shown in FIGS. 2 and 3, has a sorter body 15 comprising a pair of side plates 12, a base 13 and a cover 14, and further comprising a bin unit 17 accommodating a multiplicity of bins B and enabled to be moved vertically along guide rails 16 respectively attached to the sorter body 15.

The sorter body 15 has an introduction port 18 through which sheets S are introduced. A first sheet conveyance passage 19 is formed from the introduction port 18 toward the upper bin unit 17, while a second sheet conveyance passage 20 is branched from the first sheet conveyance passage 19. An upper discharge roller pair 21 for discharging non-sort sheets (sheets not to be classified) is disposed downstream from the first sheet conveyance passage 19. A lower discharge roller pair 22 for discharging sort sheets (sheets to be classified) is disposed downstream from the second sheet conveyance passage 20.

(Shape of Discharge Roller)

Figure 4:
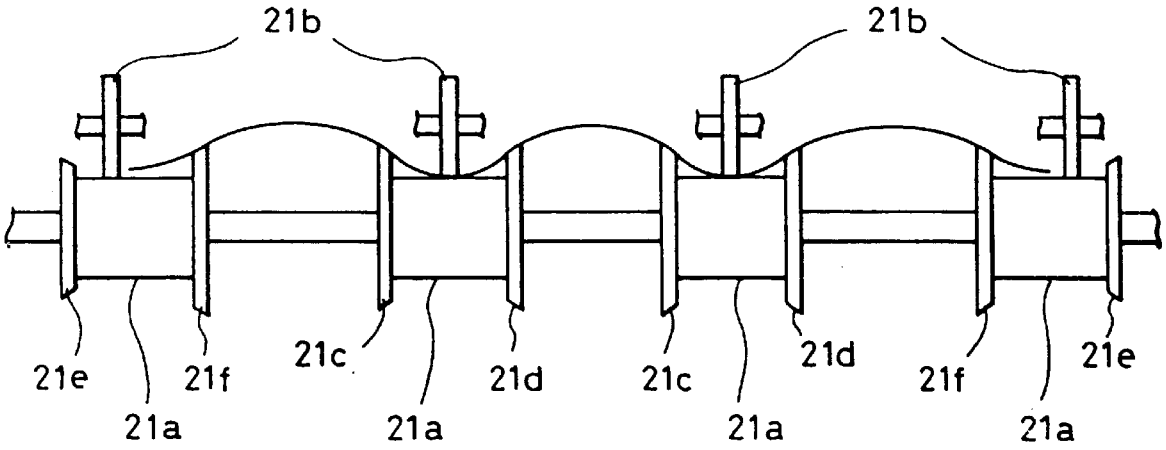
FIG. 4 is an explanatory view of a lower discharge roller pair of the sheet processing apparatus.

The upper discharge roller pair 21, as shown in FIG. 4, has a driving discharge roller 21*a* and a follower discharge roller 21*b* that presses the discharge roller 21*a*. The discharge roller 21*a* has four cylindrical rollers disposed in the axial direction thereof. Ribs 21*c*, 21*d*, 21*e* and 21*f* are stood erect on the two end surfaces of each discharge roller 21*a*.

The discharge roller 21*a* is so disposed that the sheet always comes in contact with the ribs 21*c* and 21*d* or 21*e* and 21*f* when the discharge roller 21*a* and the discharge roller 21*b* hold the sheet. The reason for this is that, when the sheet S is made to be rigid, a state where the sheet S comes in contact with only the internal rib 21*c* or 21*f* of the discharge roller 21*a* in the axial direction will cause the end of the sheet S to be gradually moved inwards, and thus the end of the sheet S is separated form the discharge roller 21*b*.

The discharge roller 21*b* presses each discharge roller 21*a* in such a manner that the discharge rollers 21*a* disposed in the central portion in the axial direction are pressed at their central portions; and the discharge rollers 21*a* disposed in the end portions in the axial direction are pressed at their positions dislocated outwards by about 3 mm from their central portions. The reason for this is that a gap must be maintained between the end of a sheet, which does not simultaneously come in contact with the two end rib portions of the discharge roller, and the nip between the discharge roller 21*a* and the discharge roller 21*b*. If a certain gap is not maintained between the end of the sheet and the nip, the end of the sheet and the discharge roller 21*b* interfere with each other in a case where the sheet S moves in a diagonal direction or the same is moved while being dislocated in the axial direction of the roller, thus causing the sheet S to be damaged or the movement of the sheet S to be made instable.

The right and left ribs 21*c* and 21*d* of the discharge rollers 21*a* disposed in the central portions have the same height, while the ribs 21*e* and 21*f* of the discharge rollers 21*a* disposed in the two end portions in the axial direction are formed such that the outer rib 21*e* has a lower height and the internal rib 21*f* has a higher height. Specifically, the ribs 21*c* and 21*d* have a height or about 2 mm, the rib 21*f* has a height of about 2.5 mm, and the rib 21*e* has a height of about 1.5 mm. The reason why the inner rub 21*f* is made to be higher than the outer rib 21*e*, and the rib 21*f* is made to be somewhat higher than the ribs 21*c* and 21*d* is that the degree of the rigidity of the sheet S must be uniform in the axial direction similar to the central portion even if the position, at which the discharge roller 21*b* presses the discharge roller 21*a*, is dislocated. If the rigidity of the sheet S is too strong, a trace is sometimes formed on the sheet S. If the rigidity is too weak, the sheet S cannot stably be discharged. Therefore, it is preferable that the state of the rigidity be uniform.

The material of the discharge roller 21*a* is ABS resin, hard rubber or the like, while the material of the discharge roller 21*b* is polyacetal resin or the like. Although four discharge rollers 21*a* and discharge rollers 21*b* are disposed in the axial direction, the number is not limited to this, and the number may be increased or decreased.

As a result of the foregoing structure, when the sheet S is discharged while being held by the upper discharge roller pair 21, the ribs 21*c*, 21*d*, 21*e* and 21*f*, which are stood erect on the discharge roller 21*a*, make rigid the sheet S in the discharge direction. To maintain a gap from the end of the sheet S, the heights of the ribs 21*f* and 21*e* formed on the discharge rollers 21*a* at the two ends in the axial direction are arranged such that the inner rib is made to be high and the outer rib is made to be low so that the rigidity of the sheet S attained at the end of the sheet S can be made uniform even if the discharge roller 21*b* presses the discharge roller 21*a* at the outer position from the central position. Therefore, the sheets S can be stacked accurately.

Since the discharge roller 21*b* presses only the sheet S that is brought into contact with the two end ribs of the discharge rollers 21*a* at the two ends in the axial direction, undesirable movement of the two ends of the sheet S toward the central portion causing dislocation of the sheet S from the nip between the discharge roller 21*a* and the discharge roller 21*b* can be prevented. Thus, problems experienced with the conventional structure such that the end of the sheet cannot be held between the discharge roller 21*a* and the discharge roller 21*b*, or the end of the sheet comes in contact with the side surface of the discharge roller 21*b* and thus the movement is made instable depending upon the size of the sheet, thus causing the diagonal discharge to take place can be prevented. As a result, the discharge operation can be made stable.

At the branched portion between the sheet conveyance passages 19 and 20, there are disposed an introduction roller pair 23 and a deflector 24. When a non-sort mode (a mode in which sheets are not classified) is selected, the deflector 24 is displaced to introduce the sheet S into the first sheet conveyance passage (hereinafter called a "non-sort passage) 19. When a sort mode (a mode in which sheets are classified) is selected, the deflector 24 is displaced to introduce the sheet S into the second sheet conveyance passage (hereinafter called a "sort passage") 20.

The sort passage 20 has a relay roller pair 25 between the introduction roller pair 23 and the discharge roller pair 22, the relay roller pair 25 being disposed at a position that enables the minimum size sheet (the minimum size in the sheet feeding direction), that can be discharged from the main body of the apparatus, can be conveyed.

The sort passage 20 has the leading portion (downstream from the relay roller pair 25) formed into a leading passage 26. The leading passage 26 can be rotated around a drive roller 25*a* of the relay roller pair 25.

(Leading Passage)

The leading passage 26 is located at an operating position 26*a* (the position indicated by a continuous line shown in FIG. 3) when the sheet S is conveyed in a usual manner. The lower portion of the leading passage 26 abuts against a pushing mechanism, to be described later, so as to be located. The position of the leading passage 26 can be detected by a detection means 27, such as a microswitch.

The leading passage 26 is pushed to a relief position 26*b* (a position indicated by an alternate long and two short dashes line shown in FIG. 3) by the pushing mechanism when the stapler, to be described later, is operated. At a position to which the leading passage 26 is raised by a predetermined quantity, there is disposed a detection means 28, such as a microswitch, to detect the leading passage 26 at the foregoing position.

Figure 5A:
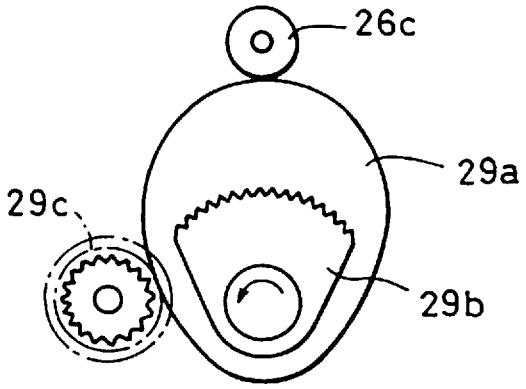
FIGS. 5(*a*), 5(*b*), and 5(*c*) are schematic views showing the structure of an upward moving mechanism for swinging the leading passage of the sheet processing apparatus.
Figure 5B:
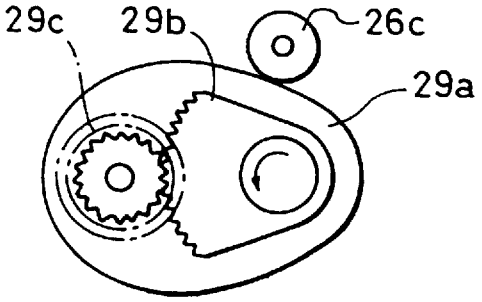
Figure 5C:
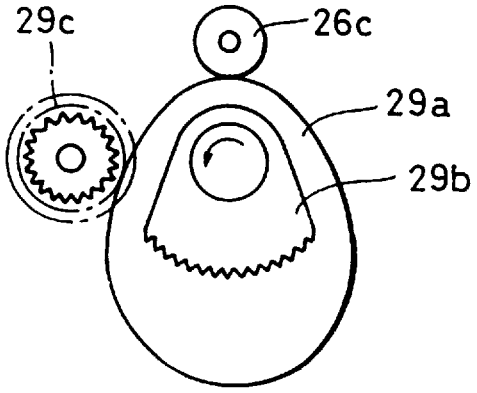

The pushing mechanism, as shown in FIG. 5, comprising an eccentric cam 29*a* that is rotated by a rotational force transmitted from a drive motor of a sheet conveyance system (not shown) through a one-way clutch; and a rotary damper 29*c* that is engaged to a sector gear 29*b* integrally formed with the eccentric cam 29*a* to supply rotational load. The eccentric cam 29*a* is not rotated because the drive force is not transmitted through the one-way clutch when the motor is rotated forwards (when the sheet S is conveyed). On the other hand, it is rotated due to the action of the one-way clutch when the motor is rotated reversely (when the conveyance of the sheet S is stopped).

Therefore, the rotation of the eccentric cam 29*a* when the motor is rotated reversely upwards pushes a rotative roller 26*c* disposed in the lower portion of the leading passage 26 to a relief position 26*b* (the position indicated by the alternate long and two short dashes line shown in FIG. 3) (a state 5(*a*)). when upward pushing by means of the eccentric cam 29*a* is suspended, the leading passage 26 tends to be moved downwards due to the gravitation. Since the sector gear 29*b* integrally formed with the eccentric cam 29*a* is engaged to the rotary damper 29*c* and thus the rotational load is applied to the eccentric cam 29*a* which is in contact with the rotative roller 26*c* (a state shown in FIG. 5(*b*)), the leading passage 26 is slowly moved downwards due to the rotational load of the rotary damper 29*c* so as to be rotated to the operating position 26*a* (the position indicated by the continuous line shown in FIG. 3) so that the leading passage 26 is located (a state shown in FIG. 5(*c*)).

(Discharge Guide)

Figure 47:
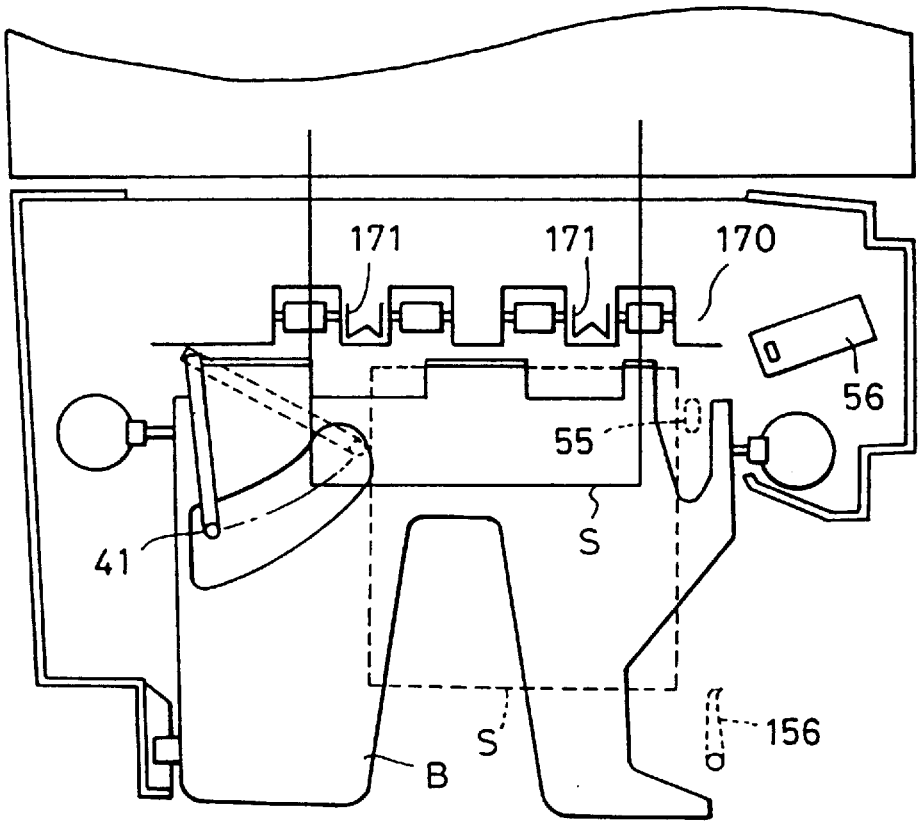
FIG. 47 is a top view of a discharge guide.

Referring to FIG. 47, a plurality of drive discharge rollers 22*a* and the follower discharge rollers 22*b* forming the lower discharge roller pair 22 are disposed in the axial direction. Furthermore, discharge guides 170 (an upper discharge guide 170*a* and a lower discharge guide 170*b*) forming the sheet conveyance passage connected to the lower discharge roller pair 22 are disposed vertically. In the sort mode, the sheet S conveyed through the discharge guide 170 is, by the lower discharge roller pair 22, discharged and stacked on each bin tray B.

Figure 48A:
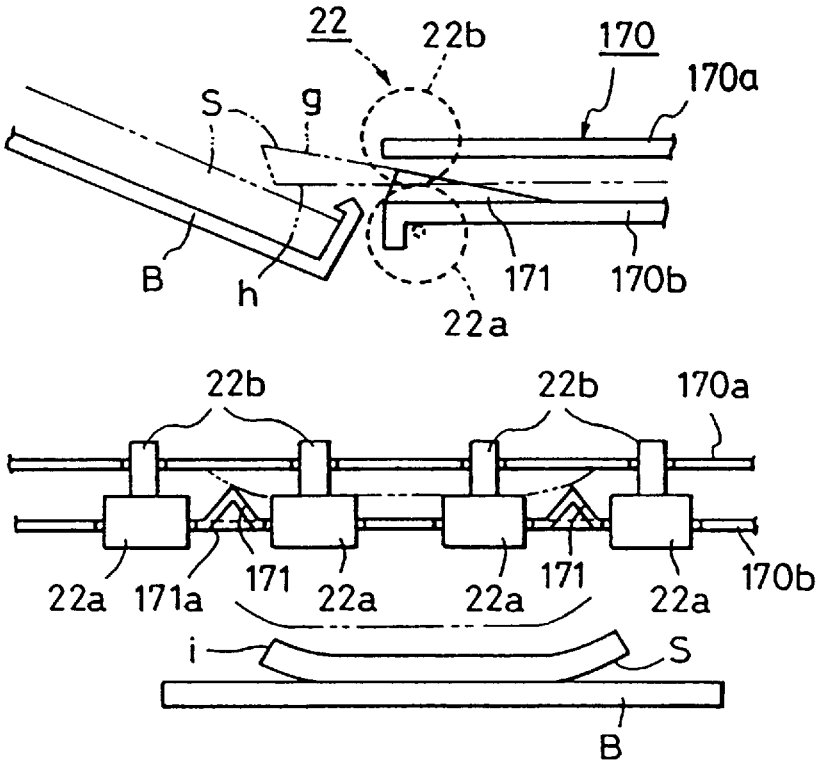
FIGS. 48(*a*), 48(*b*), and 48(*c*) are cross sectional views and a front view showing the discharge guide.
Figure 48B:
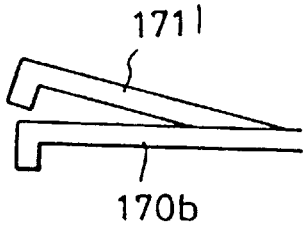
Figure 48C:
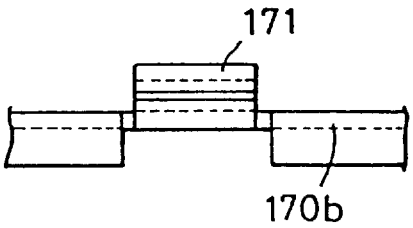

Among the discharge guides 170, in the portions of the lower discharge guide 170*b* corresponding to the end of the sheet (the two end positions of, for example, A4R-size sheet), there are formed guide portions 171 projecting upwards over the guide surface. The guide portions 171, as shown in FIG. 48(*a*), project upwards to face the sheet discharge port so as to discharge the sheet S in such a manner that the end of the sheet S, which is discharged as indicated by an alternate long and two short dashes line, is raised. The quantity of raising of the end of the sheet S is determined to be somewhat larger than the usual quantity of warp of the ends of sheets S previously stacked on the bin tray B.

As a result, even if the end of the sheet S discharged to the bin tray B and aligned to the reference position is warped upwards, the end of the sheet S, to be discharged by the lower discharge roller pair 22, is upwards raised by the guide portion 171 when discharged. Therefore, the sheet S can be discharged without interference of the two sheets S. Thus, undesirable movement of the upper most sheet S among the sheets S stacked in the bin in the sheet discharge direction occurring due to the friction between the sheet S, which is being discharged, and the sheets S, which have been stacked in the bin, can be prevented. Therefore, the sheets S can be stacked accurately, and the afterward processing operation can be performed desirably. Since the sheet discharge direction is partially changed (into a direction g), and the overall sheet discharge direction (a direction h) is changed, the quantity of skipping of the sheet S is not changed. Thus, the sheet S can be stacked stably.

The discharge guide 170 is made of a metal plate, such as a steep plate, while the guide portion 171 may be formed, as shown in FIGS. 48(*b*) and 48(*c*) by drawing or in such a manner that a cut portion is formed in a portion of the lower discharge guide 170*b*, followed by being bent upwards. Although two guide portions 171 are formed in the lower discharge guide 170*b*, the number of the guide portions 171 may be increased to be adaptable to the size and the state of curl of the sheet S. In FIG. 48(*b*), to enable the guide portion 171 to be brought into contact with only the left end curl portion (a portion i) of the stacked sheet bundle when the sheet S is discharged, the guide portion 171 may be formed only in one left portion 171*a* of the lower discharge guide 170*b*.

(Bin Unit)

The bin unit 17 has a pair of bin frames 30 which are disposed in the front portion and the inner portion and each of which consists of an erect portion 30*a* and a bottom portion 30*b*. A bin slider 31 is attached to the leading portion of the bottom portion 30*b* of the bin frame 30; and the erect portion 30*a* and the bin slider 31 of the bin frame 30 are respectively secured to the leading portion by a bin cover 32.

(Penetration Sensor)

The bin unit 17 includes a penetration sensor 151 for detecting whether or not a sheet S exists on the bin tray in such a manner that the penetration sensor 151 vertically penetrates cut portions 152 of all bin trays formed in the same positions when viewed from a position above each bin tray, and it detects the closing/opening of the cut portion 152 by the sheet S so as to detect whether or not the sheet S exists (see FIG. 2). The penetration sensor 151 is disposed in the region corresponding to the minimum size of the sheet S that is discharged on to the bin tray and as well as in an overlapped portion when the sheets S have been aligned and the same have been pushed forward for the purpose of taking the sheets S. Thus, the penetration sensor 151 is able to detect the sheet S regardless of the position of the sheet S on the bin tray.

(Aligning Rod)

Figure 51A:
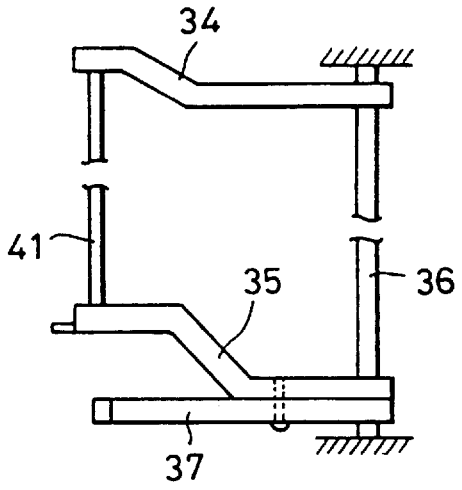
FIGS. 51(*a*) and 51(*b*) are cross sectional views taken along arrows J—J of FIG. 50.
Figure 51B:
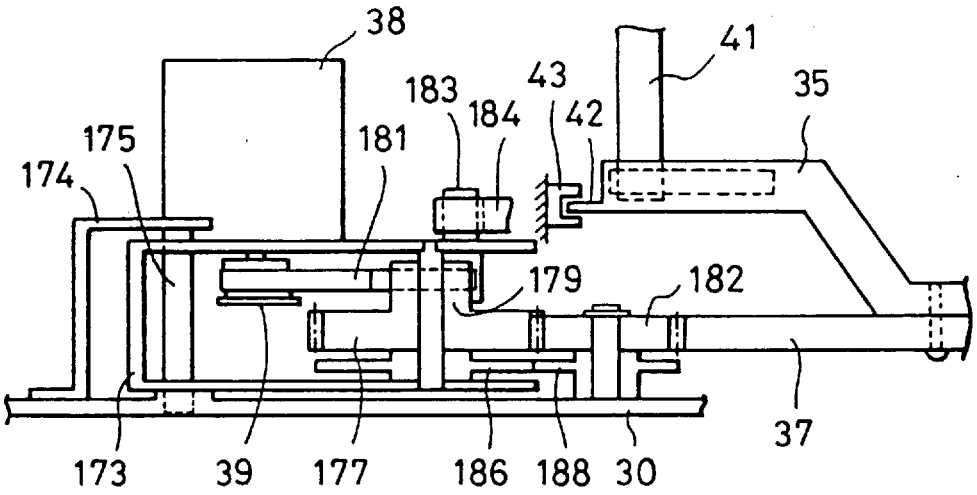

In the inner portion of the base portion of the bin frame 30, there is rotatively supported a rotation central shaft 36 having the two vertical ends secured to the upper arm 34 and a lower arm 35, the rotation central shaft 36 being made rotative by a rotational shaft (not shown) provided for the bin frame 30 and a rotational shaft 32*a* provided for the bin cover 32. The bin frame 30 has a sector gear 37 that is made rotative around a rotational shaft provided for the bin frame 30. The lower arm 35 is secured to the sector gear 37. A pulse motor 38 is disposed on an alignment unit frame 173 at a position above the bin frame 30, as shown in FIG. 51. The pulse motor 38 rotates the sector gear 37 through a gear train, to be described later. An aligning rod 41 penetrating all cut portions 40 formed in the bin trays B is disposed at the leading portion of the lower arm 35 and the leading portion of the upper arm 34. The aligning rod 41 is so structured that it swings in the cut portion 40 when the sector gear 37 is rotated. Furthermore, the lower arm 35 has a light shield plate 42 so that rotation of the light shield plate 42 integrally with the lower arm 35 turns on or off a home position sensor 43 disposed in the inner portion of the bin frame 30.

(Change in Speed of Aligning Rod between Alignment Mode and Bundle Pushing Mode)

Figure 50:
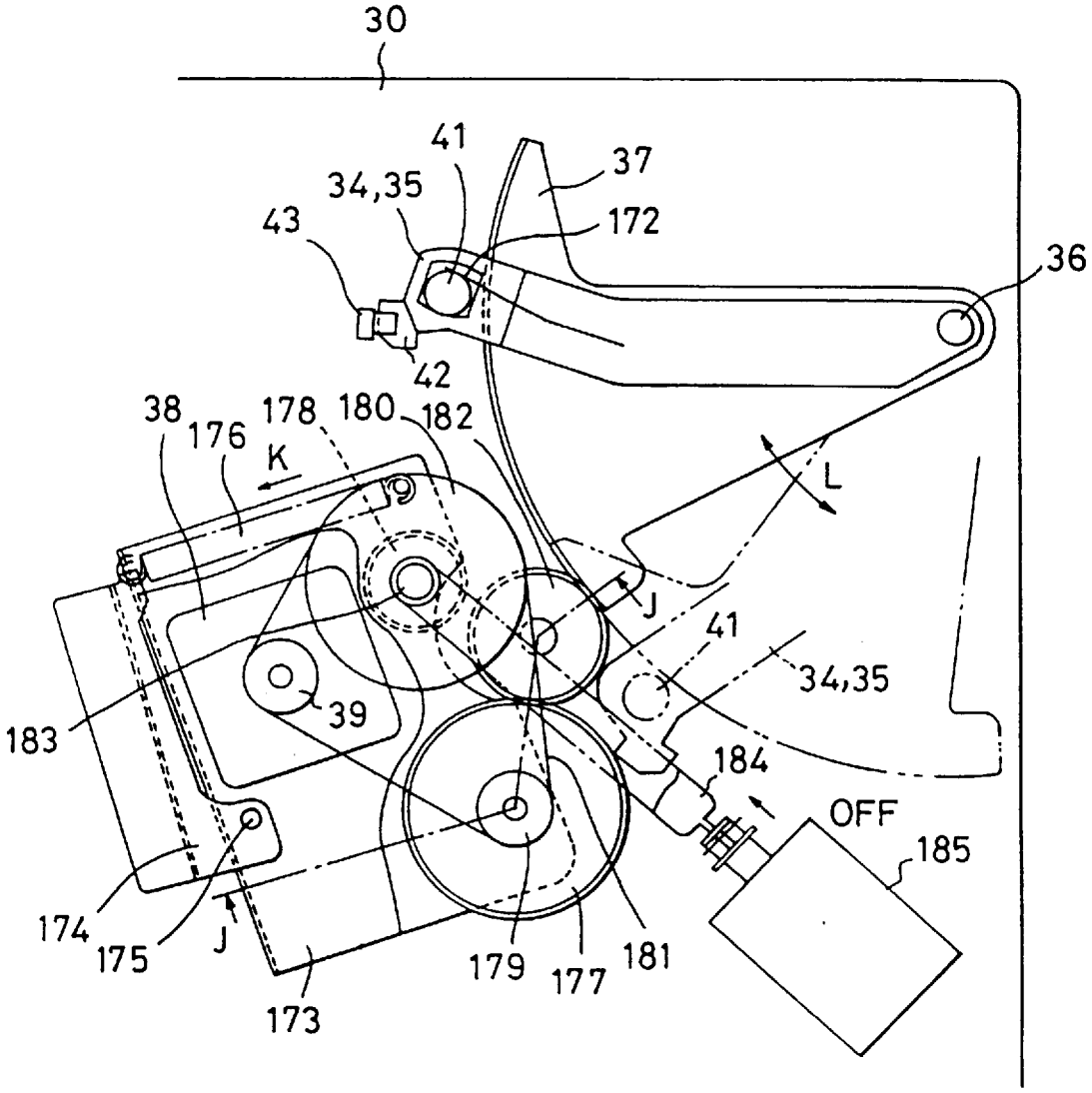
FIG. 50 is a top view showing the gear changing operation to be performed at the time of performing the aligning operation.

Referring to FIG. 51 (FIG. 51 is a cross section taken along line J—J shown in FIG. 50), the alignment unit frame 173 to which the pulse motor 38 is secured and which has a U-shape cross sectional shape facing side is rotatively supported around a support shaft 175 vertically supported by a support plate 174 and the bin frame 30. As shown in FIG. 50, the alignment unit frame 173 and the support plate 174 are connected to each other by a tension spring 176 so that the alignment unit frame 173 is urged in a direction indicated by an arrow K. On the alignment unit frame 173, there are rotatively supported an aligning gear 177 having a large diameter and a bundle-pushing gear 178 having a small diameter. The aligning gear 177 and the bundle-pushing gear 178 respectively have pulleys 179 and 180 formed integrally in the axial direction.

Referring to FIG. 50, the pulse motor 38 has an output shaft to which a pulley 39 is secured; and a timing belt 181 is arranged to the pulleys 39, 179 and 180 so that the rotation of the pulse motor 38 is transmitted to the aligning gear 177 and the bundle-pushing gear 178. The bin frame 30 has an idler gear 182 that is rotatively supported so that, when the alignment unit frame 173 is rotated, the aligning gear 177 or the bundle-pushing gear 178 is engaged to the idler gear 182. The idler gear 182 is engaged to the sector gear 37 so that the aligning rod 41 is moved in a direction indicated by an arrow L.

An end of a link 184 is connected to a rotation shaft 183 of the bundle-pushing gear 178 provided for the alignment unit frame 173, while another end of the same is connected to a solenoid 185. When the solenoid 185 is turned off, the alignment unit frame 173 is, as shown in FIG. 50, pulled in a direction indicated by an arrow K by a tension spring 176 so that the aligning gear 177 is engaged to the idler gear 182. In the foregoing state, the rotational speed of the pulse motor 38 is reduced to about ¼.

Figure 52:
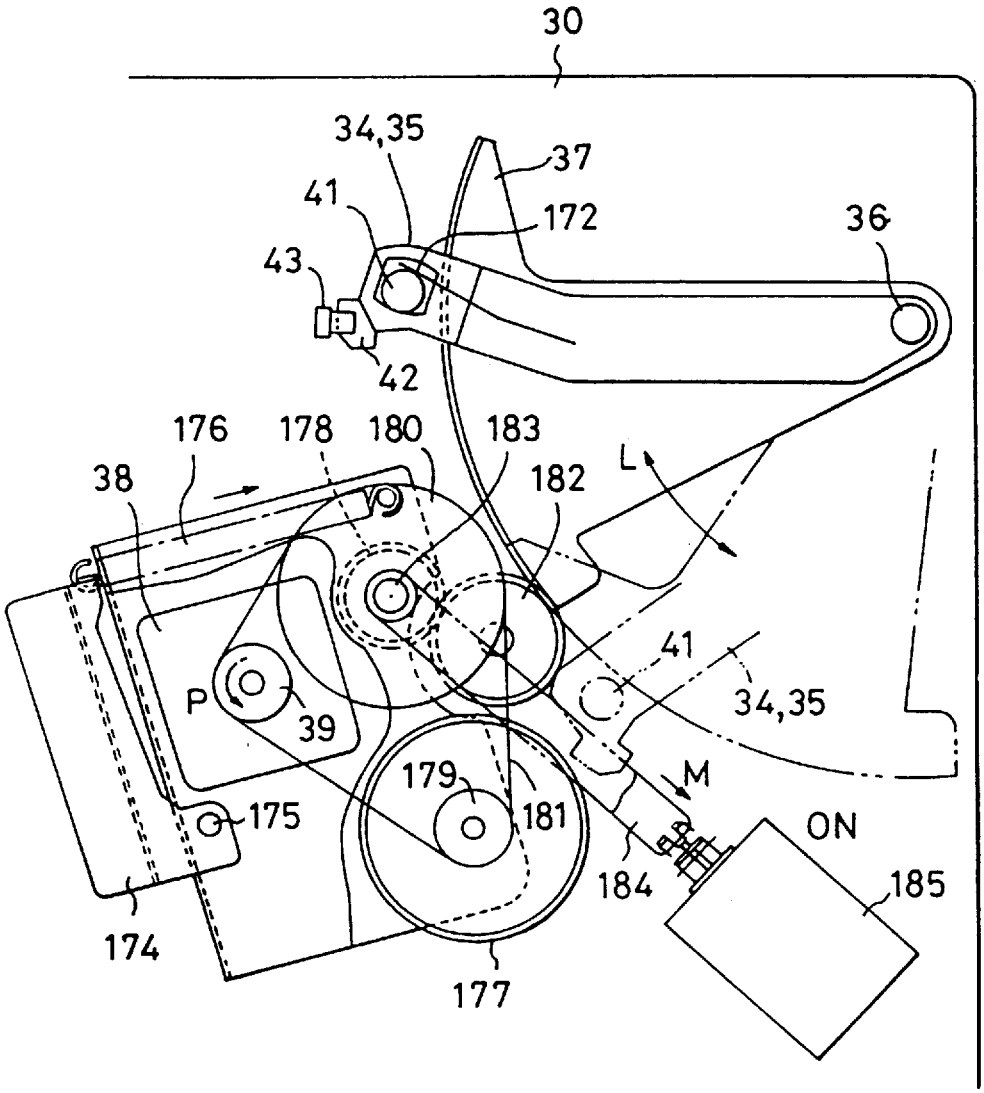
FIG. 52 is a top view showing the gear changing operation to be performed when the bundle is pushed.

When the solenoid 185 is turned on, the alignment unit frame 173 is, as shown in FIG. 52, pulled in a direction indicated by an arrow M by the solenoid 185 against the tension spring 176 so that the bundle-pushing gear 178 is engaged to the idler gear 182. In the foregoing state, the rotational speed of the pulse motor 38 is decreased to about 1/30.

When the aligning gear 177, the bundle-pushing gear 178 and the idler gear 182 are changed, and when the solenoid 185 is turned on or off, the rotation of pulse motor 38 is controlled such that it is rotated forwards or rearwards by a somewhat angular degree to prevent defective engagement due to the contact between the gear addendums in the engaged portion. Thus, the engaged gears are slightly rotated forwards or reversely to that the engagement is made reliable.

As shown in FIG. 51, the rotational shafts of the aligning gear 177, the bundle-pushing gear 178 and the idler gear 182 respectively have abutment rollers 186, 187 (not shown) and 188 attached thereto in order to maintain the gear backlash of the aligning gear 177, the bundle-pushing gear 178 and the idler gear 182.

After the sheets S have been discharged to each bin tray, no large pushing force is required to move the aligning rod 41 to align the sheets S to the reference position. Furthermore, the aligning rod 41 must be moved at high speed to complete alignment and relieving of the sheets S in a short time during the discharge of the sheets S. Accordingly, the pulse motor 38 is rotated forwards and reversely in a state where the solenoid 185 is turned off and the aligning gear 177 having a large diameter is engaged to the idler gear 182. Thus, the rotational force is transmitted so that the sector gear 37 is operated to cause the aligning rod 41 to quickly perform the operation for aligning the sheets S with a small pushing force.

When the aligning rod 41 pushes the bundle to take the sheet bundle on each bin toward an operator after the sheet bundle discharged and aligned on each bin tray has been stapled, a large pushing force is required to move the aligning rod 41. To stably move the sheet bundle, it is preferable that the sheet bundle be pushed at relatively low speed. Accordingly, the solenoid 185 is, as shown in FIG. 52, turned on to rotate the pulse motor 38 in a direction indicated by an arrow P in a state where the bundle-pushing gear 178 having a small diameter is engaged to the idler gear 182 to operate the sector gear 37. Thus, the aligning rod 41, at low speed, pushes the bundle of the sheets S with a large pushing force.

As a result of the foregoing structure, the speed of movement of the aligning rod 41 is changed between the operation for aligning the sheets S and the operation of pushing the bundle so that the pulse motor 38 is prevented from being added an excessive load. Therefore, the alignment and bundle pushing operations can be performed reliably. By slightly rotating forwards and rearwards the pulse motor 38 when the aligning gear 177 and the bundle-pushing gear 178 are switched to be engaged to the idler gear 182, gear change can be performed smoothly. Although the movement speed of the aligning rod is, in this embodiment, changed by the gears, the speed may, of course, be changed by a pulse motor or a DC motor.

(Reference Guide)

Figure 9A:
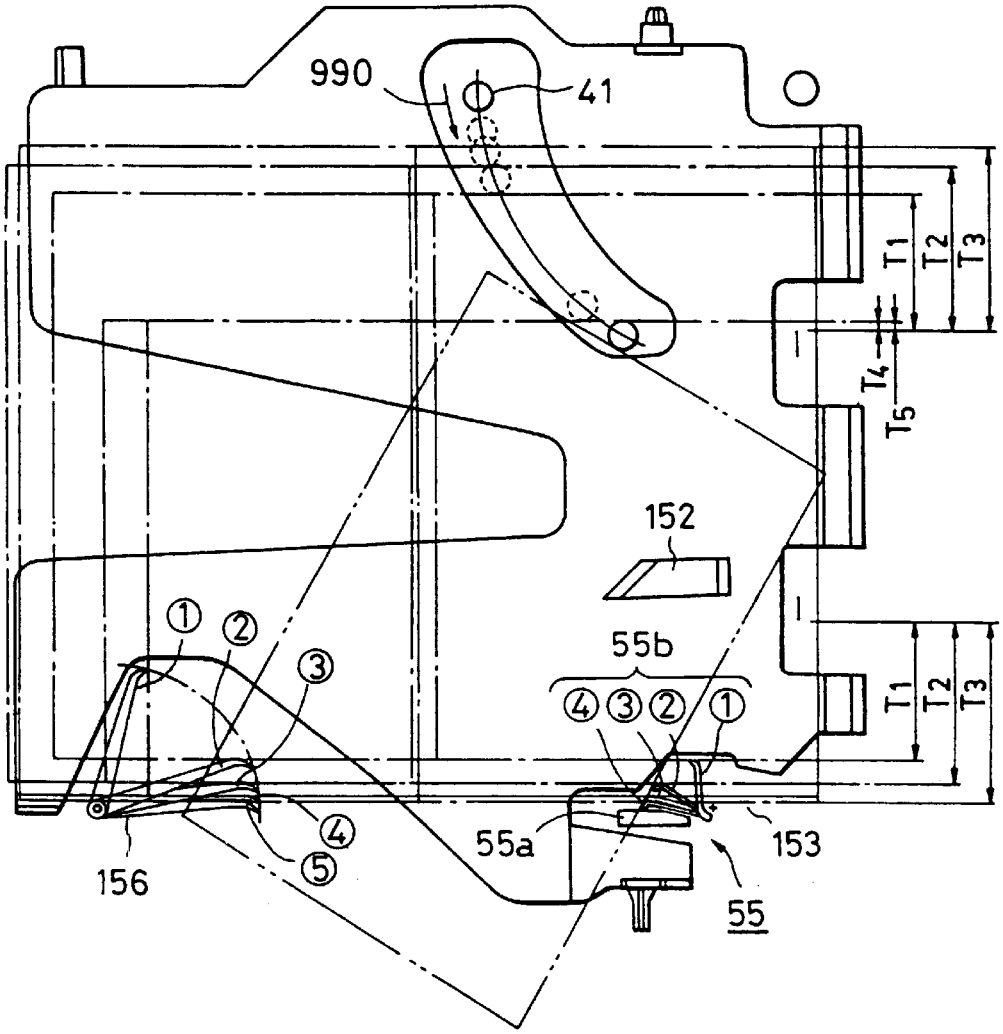
FIGS. 9(*a*) and 9(*b*) are top views showing the operations of the reference guide, an aligning rod and a multiguide.
Figure 9B:
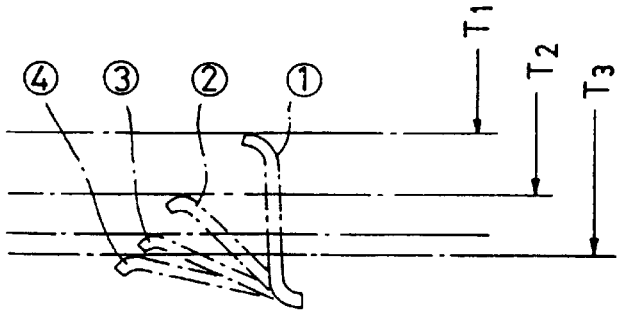
Figure 11A:
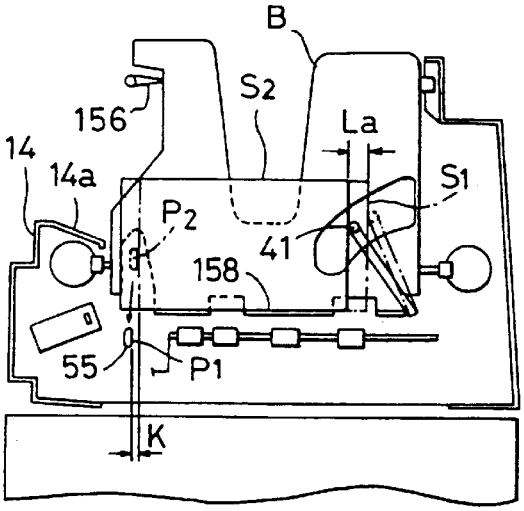
FIGS. 11(*a*), 11(*b*), 11(*c*), and 11(*d*) are top views showing a state where the sheet is aligned and moved upwards on a bin tray.
Figure 11B:
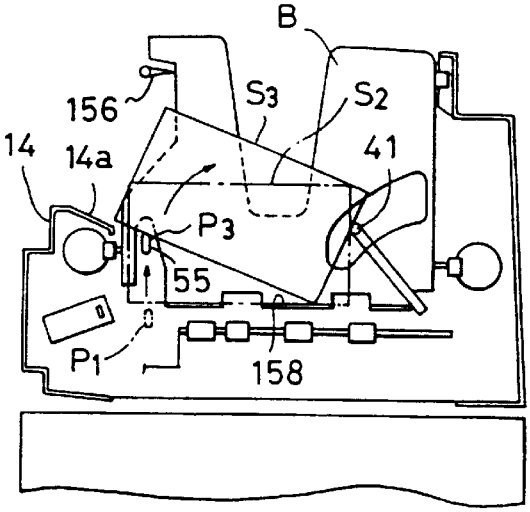
Figure 11C:
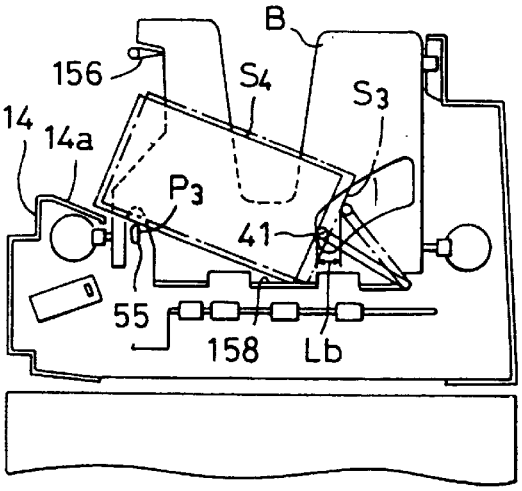
Figure 11D:
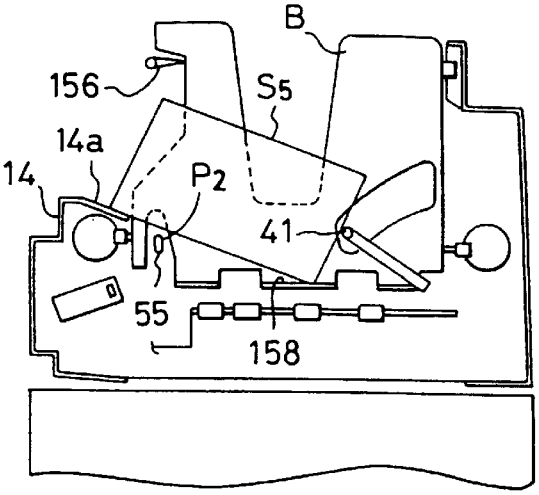
Figure 12A:
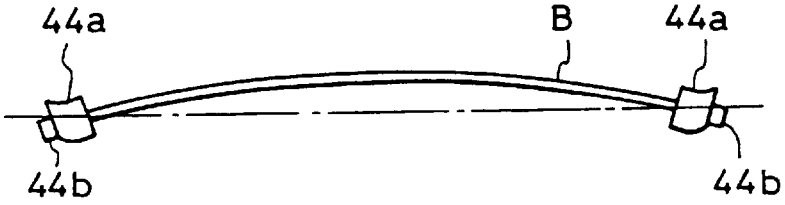
FIGS. 12(*a*), 12(*b*), 12(*c*), and 12(*d*) are schematic cross sectional views showing the bin tray.
Figure 12B:
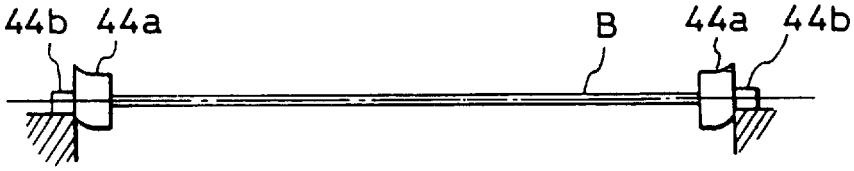
Figure 12C:
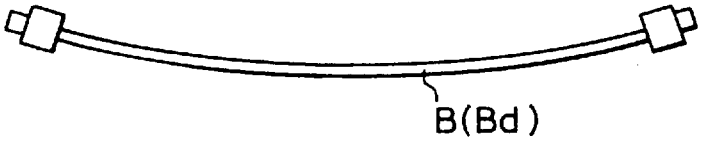
Figure 12D:
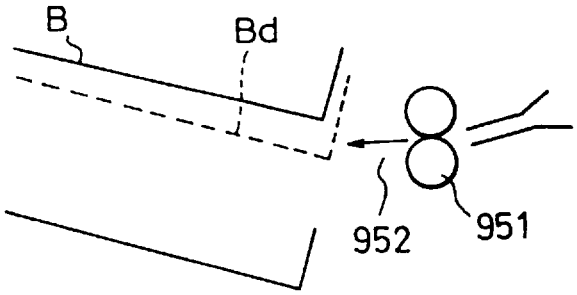

At a position facing the aligning rod 41, there is disposed a reference guide 55 through a cut portion 153 formed in each bin tray B. The reference guide 55, as shown in FIG. 9, comprises a swing guide 55*a*, that swings in the direction along the sheet discharge direction; and a swing guide 55*b* that swings with reference to the swing guide 55*a*. Thus, the reference guide 55 is arranged to move and swing to be adaptable to various conditions (the side of the sheet S and the like) for aligning the sheets S.

Figure 6:
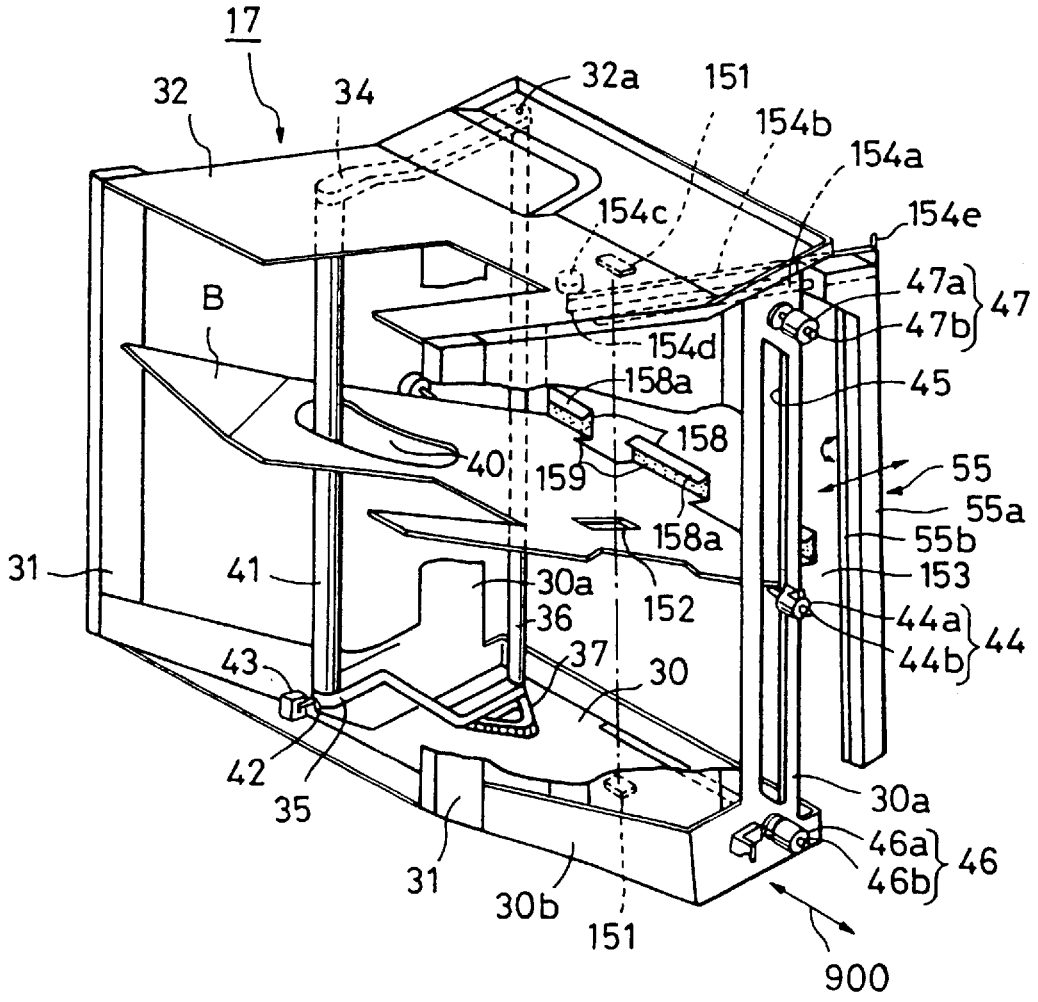
FIG. 6 is a perspective view showing a bin unit of the sheet processing apparatus.
Figure 7:
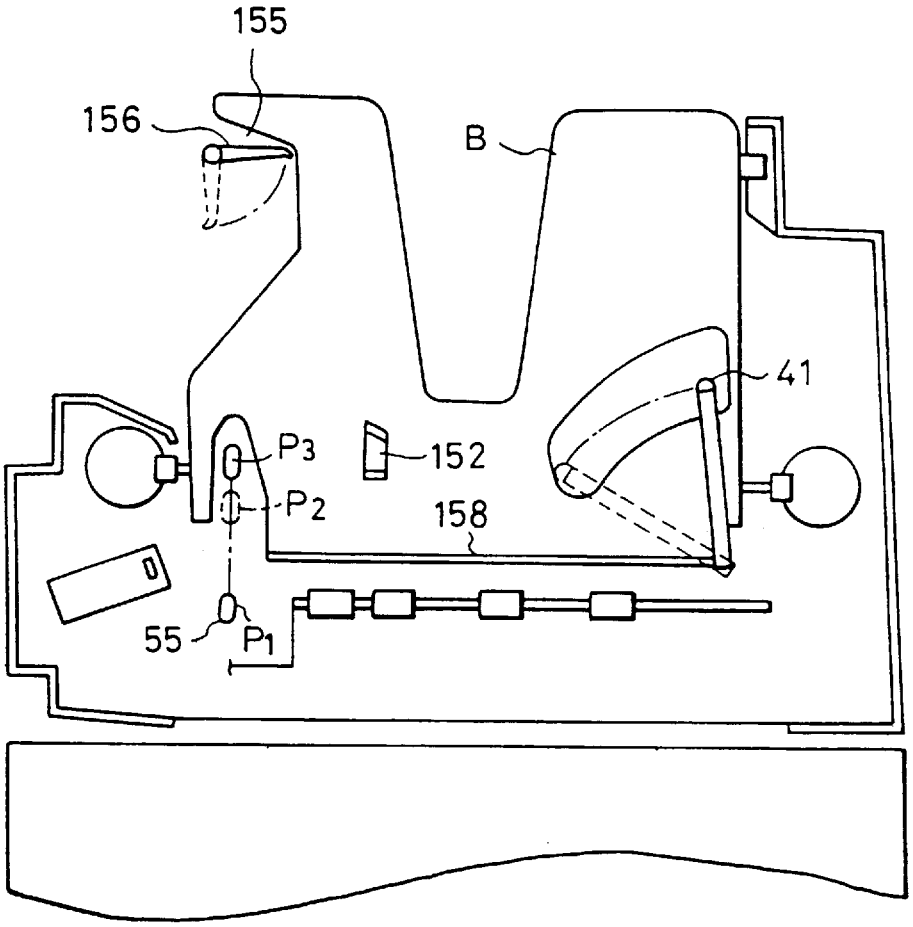
FIG. 7 is a top view of the bin unit of the sheet processing apparatus.

In the reference guide 55, the swing guide 55*a* is secured to a belt 154*b* arranged in parallel to a guide rail 154*a* extending in the sheet discharge direction and supported below the bin cover 32. An end of the belt 154*b* is set to a motor pulley 154*d* of a pulse motor 154*c* secured below the bin cover 32 and another end of the same is set to an idler pulley 154*e*. Thus, the forward and the rearward rotation of the motor 154*c*, as shown in FIG. 7, moves the reference guide 55 to a relief position P1, at which the reference guide 55 is relieved to the outside of the bin tray region, a reference position P2, which is used at the time of aligning the sheets S, and an upward pushing position P3 which is used when the sheets S are pushed upward. Referring to FIG. 6, the lower portion of the reference guide 55 is, by a rail member (not shown), enabled to be swung to prevent shakiness in a direction indicated by an arrow 900.

(Shape of Knurled Molding Member)

Figure 8A:
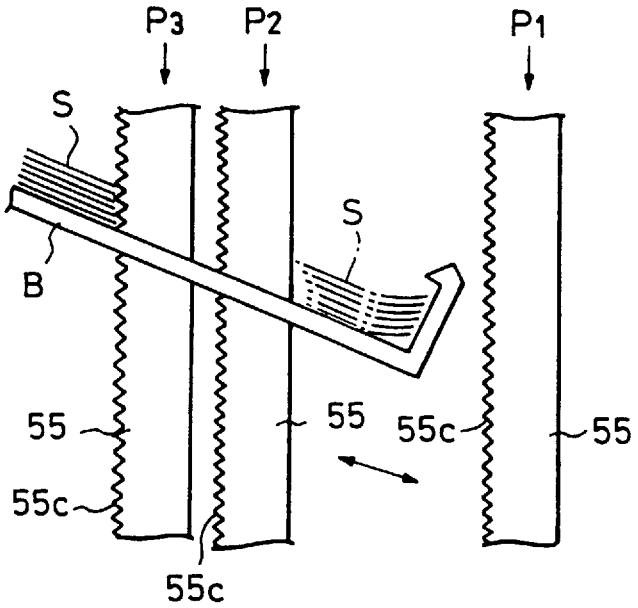
FIGS. 8(*a*) and 8(*b*) are schematic side views showing the movement position for a reference guide.
Figure 8B:
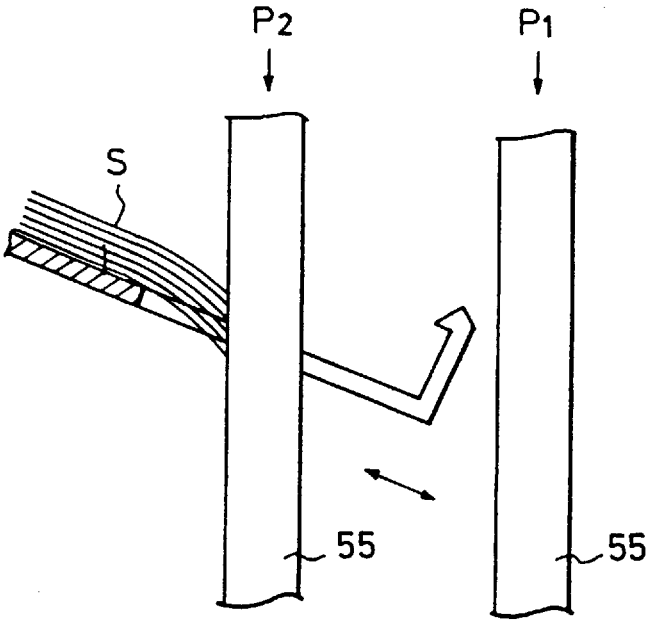

On the surface of the reference guide 55 that comes in contact with the sheet S, a knurled molding member 55*c* is attached as shown in FIG. 8(*a*). Thus, when the reference guide 55 is moved from the relief position P1 to the upward pushing position P3, undesirable hanging of the rear end of the sheet S as shown in FIG. 8(*b*) is prevented (FIG. 8(*b*) shows the movement of the sheet S in a case where no knurled molding member is provided).

Figure 53:
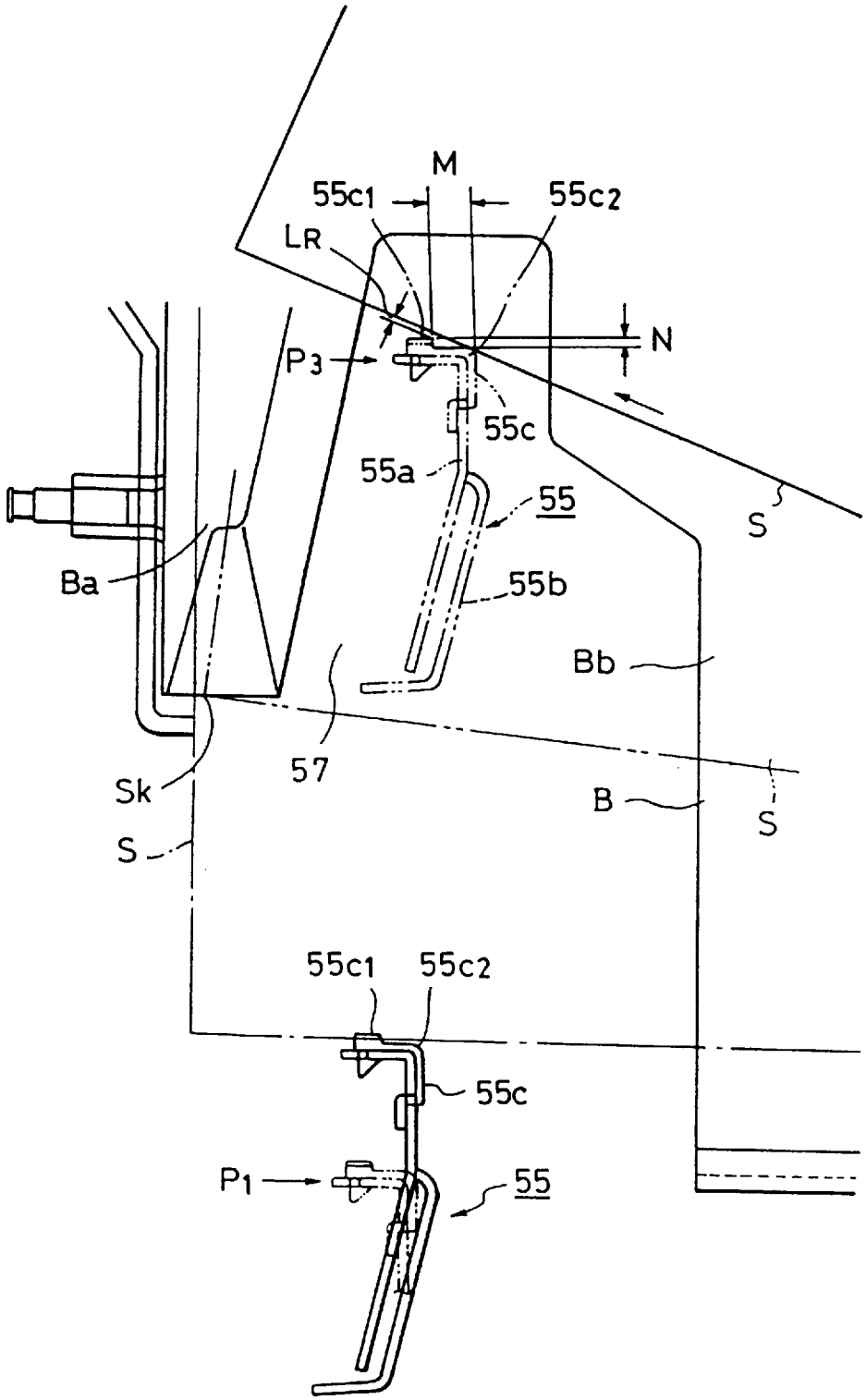
FIG. 53 is an enlarged top view showing a state where the rear end of a sheet and a reference guide (a knurled portion and a guide portion) are in contact when the bundle is pushed.
Figure 54:
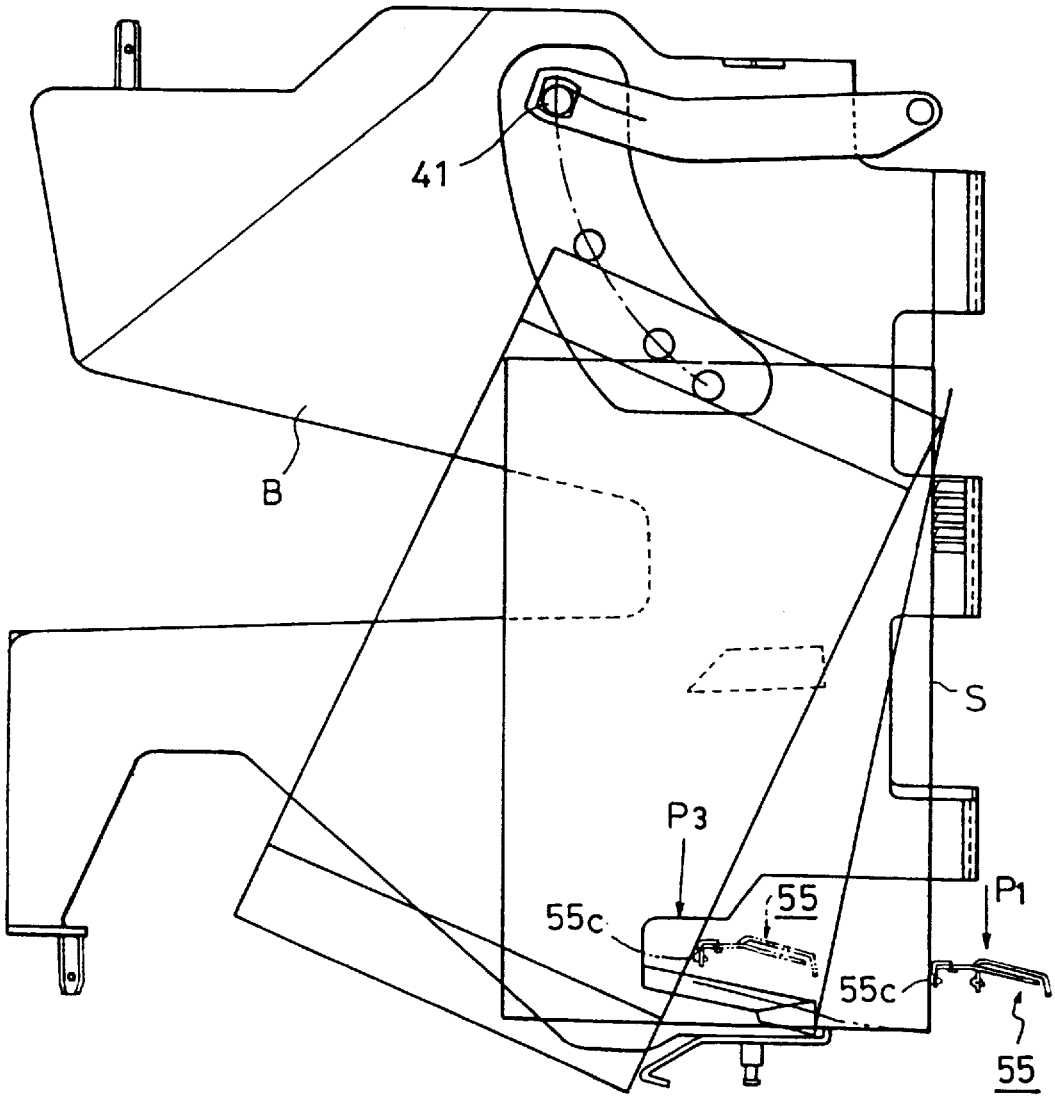
FIG. 54 is a schematic top view showing a state where the side end of a sheet and a reference guide (a knurled portion and a guide portion) are in contact when the bundle is pushed.

In the operation for pushing the sheet bundle to be described later, when the sheet S pushed upwards by the reference guide 55 is pushed so as to be taken from a position near the operator, a state, in which the knurled portion of the molding member 55*c* attached to the reference guide 55 and the side portion of the sheet S are in contact with each other, will be cause the side surface of the sheet S pushed by the aligning rod 41 is caught by the knurled portion and thus the side surface of the sheet S can be damaged. Accordingly, the molding member 55*c* according to this embodiment, as shown in FIG. 53, comprises a knurled portion 55c1 for guiding the side end of the sheet S when the sheet S is pushed upwards; and a guide portion 55c2 for guiding the side end of the sheet S when the sheet S is pushed outside. Thus, the side end of the sheet S is caused to come in contact with the guide portion 55c2 so as to be separated from the knurled portion 55c1 until the reference guide 55 reaches the upward pushing position P3.

As a result, the guide portion 55c2 is in contact with the side end of the sheet S that is pushed outside in the direction indicated by the arrow by the aligning rod 41 to guide the sheet S and the sheet S is apart from the knurled portion 55c1 by distance LR. Therefore, the knurled portion 55c1 is not caught by the side end of the sheet S so that the side end of the sheet S is prevented from being damaged.

Figure 63:
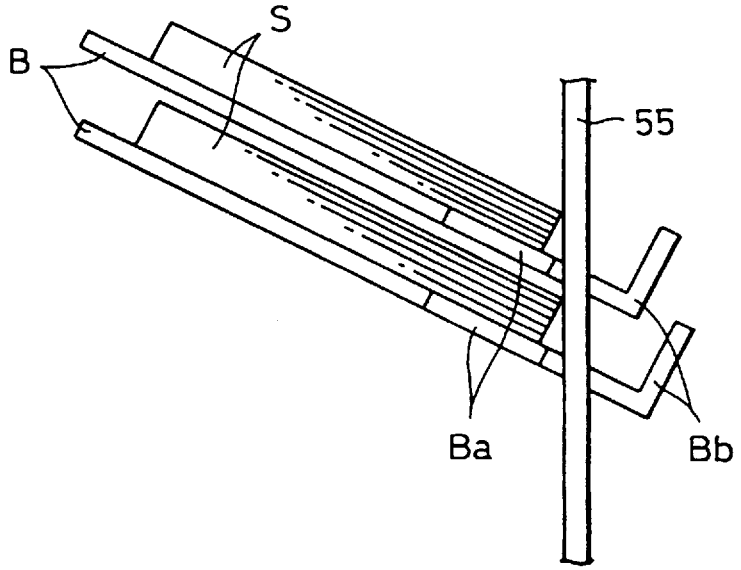
FIG. 63 is a schematic side view showing a state of a corner of a sheet that is restricted between the bin trays when the sheet is pushed upwards by the reference guide.
Figure 64:
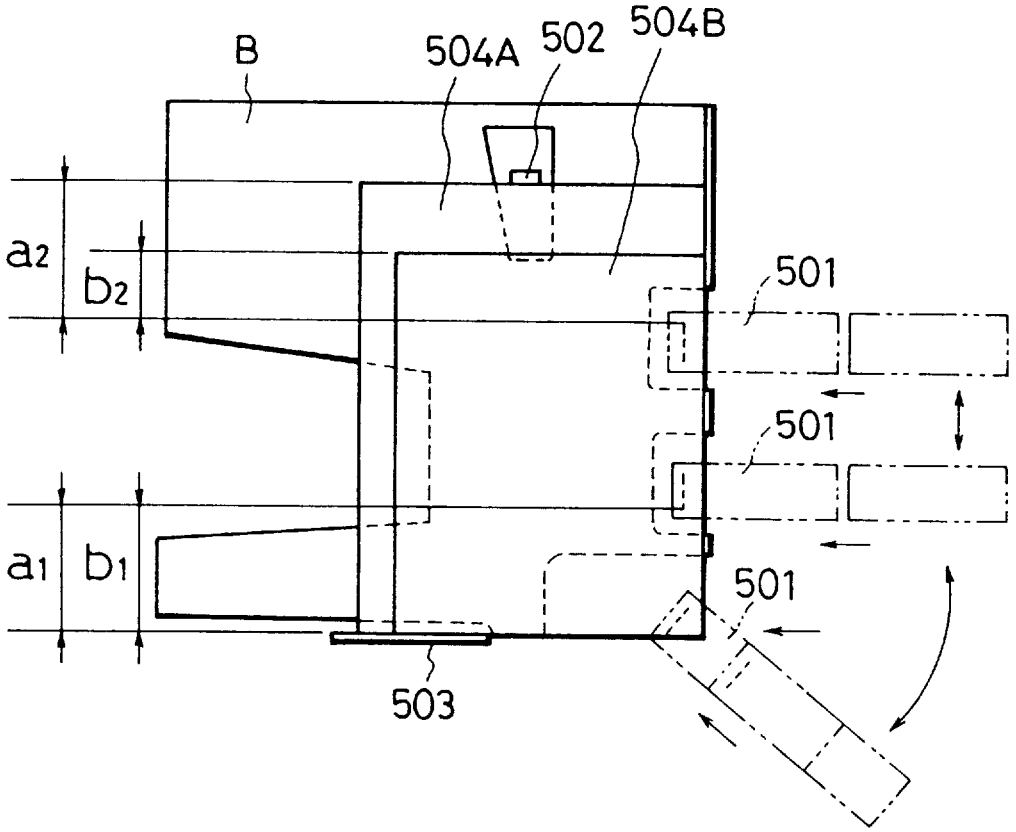
FIG. 64 PRIOR ART
FIG. 64 shows a prior art arrangement.

To cause the side end of the sheet S to be apart from the knurled portion 55c1 by the distance LR until the reference guide 55 reaches the upward pushing position P3, the side end of the sheet S is pushed upwards by the guide portion 55c2 in a region that is required to be as follows (see FIG. 53). That is, in a portion of the surface of the bin tray B near a U-shape cut portion 57, if the knurled portion 55c1 guides to cover a portion, in which a corner SK of the sheet S is place on the left stacking surface Ba to the left of the U-shape cut portion 57 as shown in FIG. 53, a portion above the foregoing portion as brought to a state where the sheet bundle is restricted by the stacking surfaces Ba and Bb of the bin tray (see FIG. 63). Thus, it can be pushed upwards by the guide portion 55c2 so that hanging of the side end of the sheet S that is pushed upwards by the guide portion 55c2 as shown in FIG. 8(*b*) can be prevented. That is, the dimensions of the knurled portion 55c1 and the guide portion 55c2 (M and N shown in FIG. 53) must be determined so as to cause the knurled portion 55c1 to be in contact with the side end of the sheet S to the foregoing position.

The knurled portion 55c1 and the guide portion 55c2 are formed into a molding member 55*c* formed integrally and enabled to be, by snap fitting, attached to the surface of the reference guide 55 that comes in contact with the sheet S. As a result, the assembling operation and changing operation can be completed easily.

Figure 55:
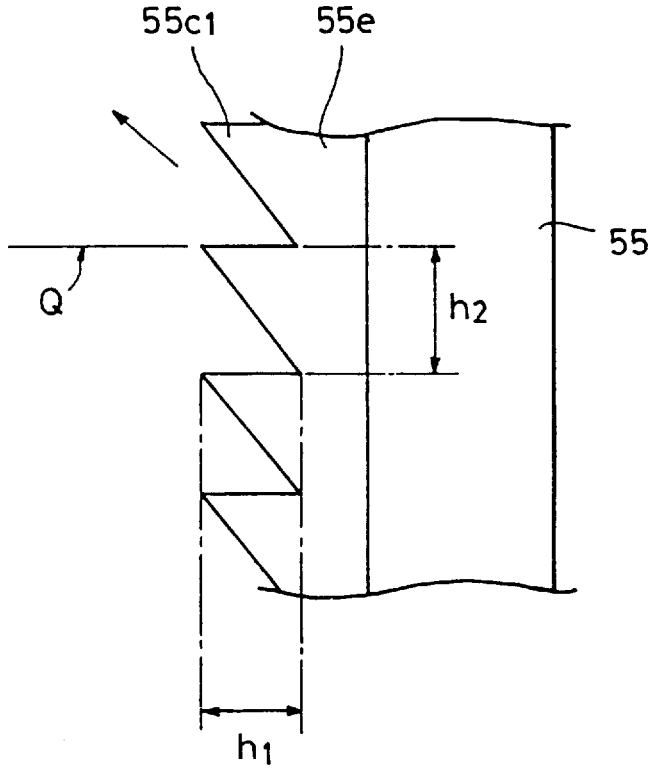
FIG. 55 is an enlarged cross sectional view of the knurled portion.

The knurled portion 55c1 has a cross sectional surface that comprises, as shown in FIG. 55, a multiplicity of sharp teeth 55*e* formed in a direction (the direction indicated by an arrow shown in FIG. 55) in which the sheet S is pushed upwards to catch the end of the sheet S. It is preferable that the knurled portion 55c1 be formed in such a manner that the height h1 of the tooth is about 0.1 mm to about 5.0 mm, the width h2 of the tooth is about 0.1 mm to about 5.0 mm, and the angle of the top surface of the tooth is about 0 deg. ±40 deg. with respect to the horizontal surface. As a result, when the sheet S is pushed upwards, the side end of the sheet S can be caught desirably so that upward pushing of the sheet S is performed reliably.

Although the knurled portion 55c1 and the guide portion 55c2 are formed into the molding member 55*c* formed integrally, the present invention is not limited to this. A similar effect can be obtained if the knurled portion and the guide portion are individually formed in the reference guide 55. Although the molding member 55*c* is attached to the surface of the reference guide 55 that comes in contact with the sheet S by snap fitting, the present invention is not limited to this. For example, it may be attached by an adhesive, such as an adhesive tape. Although the knurled portion 55c1 comprises a multiplicity of teeth to catch the side end of the sheet S, the present invention is not limited to this. For example, a frictional member having a friction resistance capable of catching the end of the sheet, specifically, a felt member or a rubber member may be employed to obtain a similar effect.

As shown in FIG. 9, in the reference guide 55, the swing guide 55*b* is, while being allowed to swing, supported by the swing guide 55*a* so as to be swung to an alignment reference positions ((1) to (4)) adaptable to the size of the sheet S by a drive mechanism (not shown). The drive mechanism comprises a rotary solenoid or the like that is operated in response to a pulse and that is controlled by a control means to be rotated for a predetermined angular degree in response to a sheet-size signal and a binding-type signal.

(Multiguide)

A multiguide 156 penetrating the cut portion 155 formed in each bin tray B is disposed downstream of the discharge direction for the sheet S from the reference guide 55. The multiguide 156 is, while being allowed to swing, supported in the bin unit 17 so as to be swung to the alignment reference positions ((1) to (5)) corresponding to the size of the sheet S in synchronization with swinging of the swing guide 55*b* in the reference guide 55. The drive mechanism comprises a rotary solenoid or the like that is operated in response to a pulse and that is controlled by a control means to be rotated for a predetermined angular degree in response to a sheet-size signal and a binding-type signal.

Figure 39:
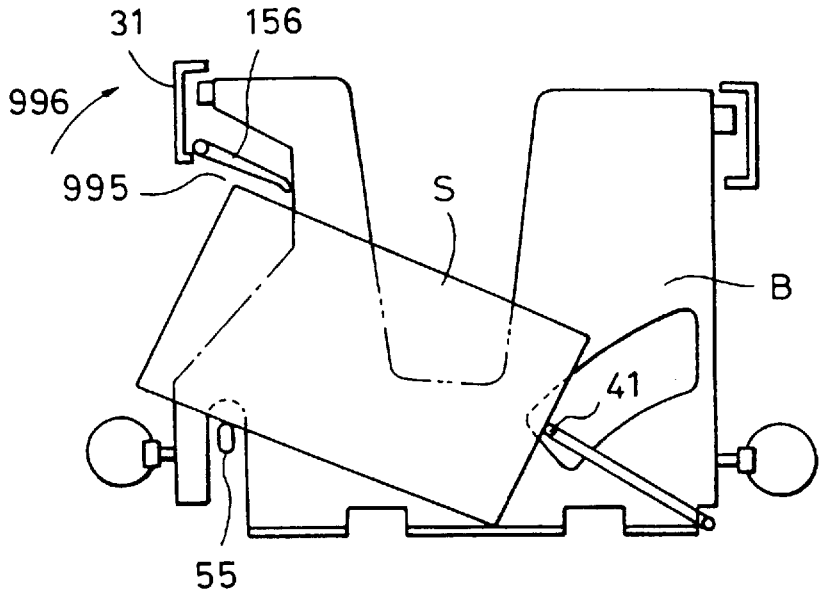
FIG. 39 is a top view showing the bin unit of the sheet processing apparatus.

The multiguide 156 is brought to positions (2), (as), (4) and (5) (see FIGS. 9 and 10) to restrict dislocation of the leading portion of large size paper (LDR, A4, A4R, LGL or the like). A case will now be described where it is brought to position (1). The multiguide 156 is brought to position (1) when one or two front portions of small-size paper (A4R, LTR or B5) are bound. In this case, sheets S are aligned by displacing the swing guide 55*b* to the respective position and the aligning rod 41 is used to align the sheets S. After the sheets S have been aligned, the sheets S are bound as desired (a case where binding has not been performed is permitted) and the front portion of the sheet bundle S is pushed as described later in such a manner that guiding is performed to prevent the corner 995 of the sheet bundle S being caught by the bin slider 31 or the like (see FIG. 39). When the sheets S are again stacked on the bin B in the state shown in FIG. 39, rotation of the sheets S on the bin in a direction indicated by an arrow 996 due to vibration occurring when the bin is shifted causing undesirable movement toward the bin is prevented.

(Alignment of Sheets)

The reference guide 55 and the multiguide 156 change their alignment reference positions to be adaptable to the size of the sheets S when the stapler 56, to be described later, is used to bind two portions or one inner portion in order to maintain uniform or a predetermined length from each binding position to the side end of the sheet S as shown in FIGS. 9 and 10.

That is, two portions are bound, the sheet aligning operation is performed in such a manner that the reference guide 55 is moved to the reference position P2; the swing guide 55*b* of the reference guide 55 is swung to the alignment reference position ((1), (2) and (as)) corresponding to the size of the sheets S; and the multiguide 156 is moved to the alignment reference position ((1), (2), (3) and (5)) corresponding to the size of the sheets S in synchronization with the movement of the swing guide 55*b*. When the sheet S has been discharged on to each bin tray, the aligning rod 41 located to face the reference guide 55 is moved in a direction indicated by an arrow 990 so as to be swung to each alignment position that presses the inner end of the sheet S so that the sheets S are aligned. As a result, the distance from each binding position to the two side ends of the sheets S (T1, T2 and T3 shown in FIG. 9) can be maintained to be uniform for each size of the sheets S.

The sheet alignment operation in a case where one inner portion is bound is performed in such a manner that the sheets S are aligned to be made coincide with the inner binding positions in the case of where the two portions are bound. The reference guide 55 is moved to the reference position P2; the swing guide 55*b* of the reference guide 55 is swung to the alignment reference positions ((2) and (4)) corresponding to the size of the sheets S; and the multiguide 156 is swung to the alignment reference positions ((3) and (4)) corresponding to the size of the sheets S in synchronization with this. After the sheet S has been discharged onto each bin tray, the aligning rod 41 placed to face the reference guide 55 is swung to the alignment position so that the sheets S are aligned. As a result, the distance (T4 and T5 shown in FIG. 9) from the binding position to the side ends of the sheets S can be made to be uniform. Furthermore, one inner portion is bound at the inner position in the case where the two portions are bound so that the necessity of enlarging the cut portion (or individually forming the foregoing cut portion) in the bin tray for binding one inner portion is eliminated. Therefore, the sheets S can be stacked desirably in such a manner that the rigidity of the bin tray is maintained.

The binding position for aligning the sheets S is usually instructed with a signal supplied from an operation panel (not shown) of an image processing apparatus before the image if formed. In a case where stapling is performed after the image has been formed and the sheets S have been sorted on to the bin tray, that is, after all operations have been completed, the binding position for the sheet alignment may be instructed afterwards. The afterward instruction is performed with a signal supplied from the operation panel of the image processing apparatus or a signal supplied from an operation panel 157 disposed near the operator above the sorter 11 (see FIG. 2). As a result, the operationality of the apparatus can be improved and thus a variety of needs of the operator can be satisfied.

(Quantity of Pushing of Aligning Rod)

The aligning rod 41 is swung to the alignment position after the sheets S have been discharged to each bin tray B to cause the sheet ends to abut against the reference guide 55. Furthermore, the aligning rod 41 is swung to the alignment position before the stapling operation using the stapler 56. At this time, the sheet ends have been pushed toward the reference position by the aligning rod 41 with a uniform force, the end of the sheet pushed by the aligning rod 41 is deflected if a small number of sheets are stacked, thus causing the stacking characteristic to deteriorate. The inner binding position can be dislocated when the one inner portion is bound or two portions are bound. Accordingly, this embodiment has a structure such that the quantity of pushing of the sheet ends by the aligning rod 41 is changed to correspond to the binding mode using the stapler 56.

Figure 49A:
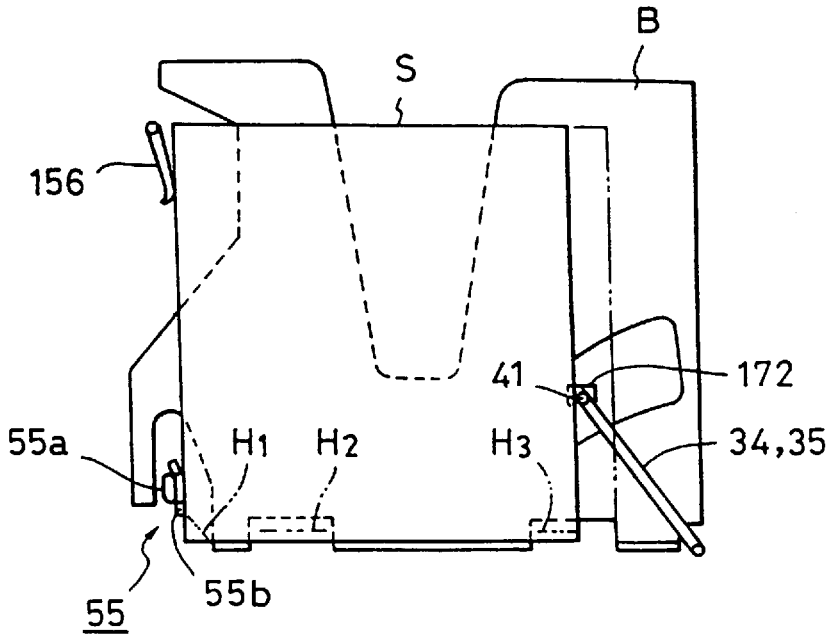
FIGS. 49(*a*), 49(*b*), and 49(*c*) are diagrams showing the structure of the aligning rod and the quantity of pressing by the aligning rod.
Figure 49B:
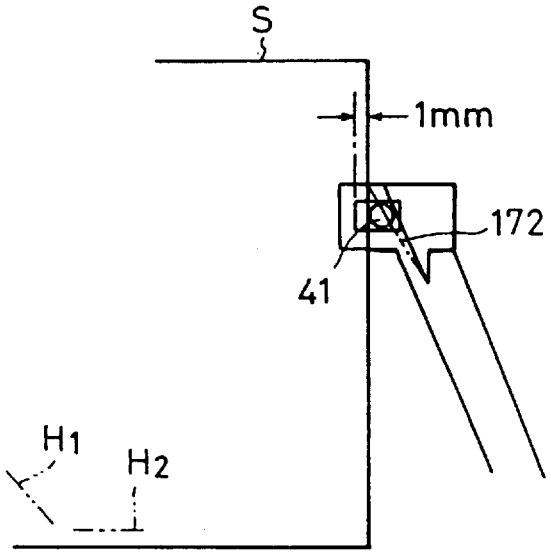
Figure 49C:
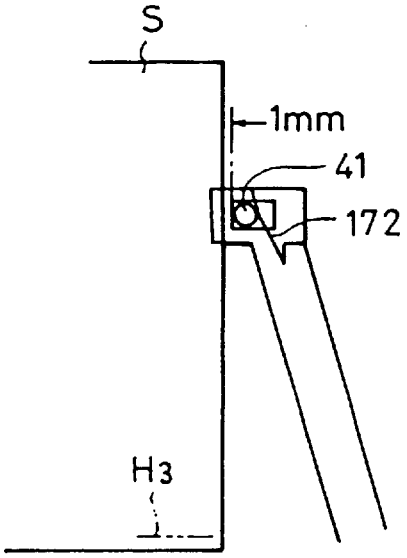

That is, referring to FIG. 49(*a*), a leaf spring 172 is provided for the support portion for the upper and lower arms 34 and 35 for vertically supporting the aligning rod 41 to urge the aligning rod 41 toward the sheet ends. The sheet bundle discharged on to the bin tray B and caused to abut against the swing guide 55*b* of the reference guide 55 is aligned by again swinging the aligning rod 41 before stapling is performed. If the binding mode among one front binding (binding position: H1) and two-portion binding is the front binding (binding position: H2), the aligning rod 41 is pushed toward the reference position by about 1 mm (+1 mm from the sheet ends), as shown in FIG. 49(*b*). Even if the end of the sheet pushed by the aligning rod 41 is deflected at this time, the dislocation of the binding position by the stapler 56 is not affected. Therefore, an excellent binding operation is performed.

If the binding mode is the inner-portion binding or one inner portion binding (binding position: H3) among the two-portion binding modes, the aligning rod 41 is, as shown in FIG. 49(*c*) stopped at a position of about 1 mm outside the sheet end position and the pushing operation is not performed (−1 mm from the sheet end, the quantity of pushing is minus). The foregoing value may be 0 mm to −1 mm. At this time, the aligning rod 41 does not come in contact with the sheet end and the same is not pushed from the sheet end to the reference position. The quantity of pushing of the aligning rod 41 is changed by controlling the quantity of rotation (the number of pulses) of the pulse motor 38. If the aligning rod 41 is not pushed from the sheet end in the front-portion binding mode among two-portion binding modes, no problem arises.

As a result, the binding position H3 by means of the stapler 56 is not dislocated due to the alignment operation, stapling can be performed at an appropriate position to correspond to the binding mode, the reliability of the apparatus can be improved and the afterward processing function can be performed effectively.

If the number of sheets to be stacked on each bin tray B is small, the stacking characteristic easily deteriorates due to deflection of the ends of the sheets S pushed by the alignment operation by the aligning rod 41. Therefore, the quantity of pushing of the aligning rod 41 may be changed to correspond to the number of sheets S to be stacked. That is, if the number of sheets S to be stacked on one bin is larger than 10, the aligning rod 41 is pushed toward the reference position by about 1 mm over the sheet end position. If the number is 10 or less, the aligning rod 41 is stopped at a positioned of about 0 mm to about 1 mm outside the sheet end position and no pushing is performed.

Although the alignment operation at the time of stacking sheets S has been described, the quantity of pushing of the aligning rod 41 before the stapling operation may be changed depending upon the number of sheets S to be stacked. The quantity of pushing of the aligning rod 41 may be changed between the operation where the discharged sheets S are aligned and the operation where the sheets S are aligned at the time of performing stapling.

The afterward instruction will now be described. If the instruction has been performed before an image is formed, the swing guide 55*b* and multiguide 156 are moved to predetermined positions; the aligning rod 41 is used to align the sheets S; and the stapling operation is performed.

If the non-binding sorting is instructed from the image processing apparatus having the foregoing structure, for example, an A4R-sheet is processed in such a manner that the positions of the swing guide 55*b* and the multiguide 156 are different between the one-front-portion binding and the one-inner-portion binding (the aligning positions are different). No problem arises in the case where the non-binding operation is performed regardless of the binding mode. However, if alignment is performed by, for example, one-inner-portion binding (the swing guide 55*b* is at position (2) and the multiguide 156 is at position (3)) and then one-front-portion binding is instructed afterwards, the front binding operation cannot be performed between the sheets S have been aligned in the inner portion.

Figure 45A:
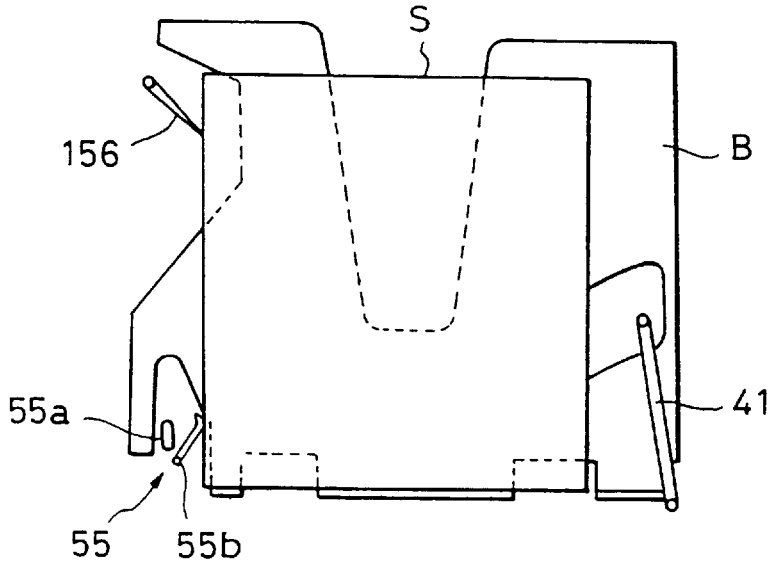
FIGS. 45(*a*) and 45(*b*) are diagrams showing the operation relationship among the reference guide, the aligning rod and the multiguide.
Figure 45B:
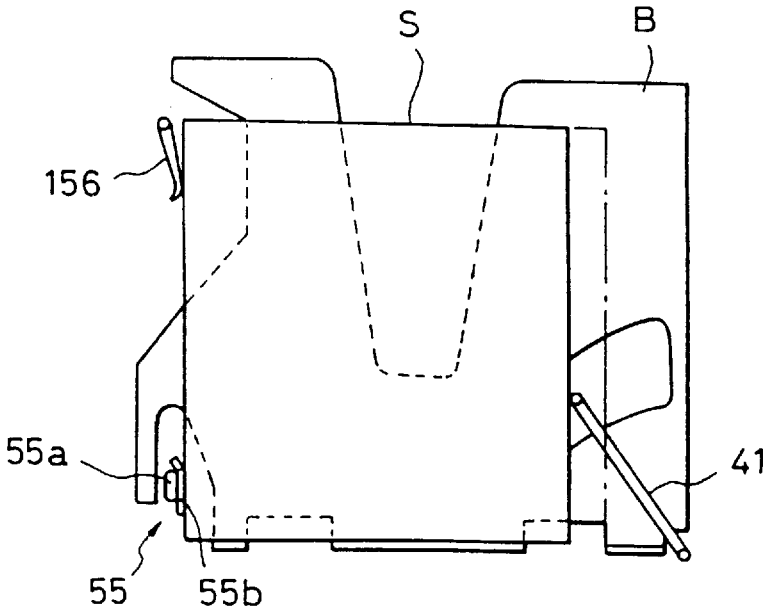

Accordingly, the sheet processing apparatus according to this embodiment of the present invention is arranged to align all sheets S at the position for the one-inner-portion binding mode or the two-portion binding mode as shown in FIG. 10 (FIG. 45(*a*) shows the example of an A4R-sheet). If the foregoing binding mode (the one-inner-portion binding mode or the two-portion binding mode) has been instructed afterwards, the foregoing binding operation is performed at the foregoing positions. If the one-front-portion binding mode has been instructed afterwards, the swing guide 55*b* and the multiguide 156 at the foregoing alignment positions are changed to the positions corresponding to the one-front-portion binding mode. Then, the aligning rod 41 is used to push all sheet bundles in all bins so as to be swung until the sheet ends abut against the swing guide 55*b* and the multi-guide 156 (FIG. 45(*b*) shows the case of A4R-sheet). Then, the stapler 56 is used to perform the one-front-portion binding operation after the movement. As a result of the foregoing structure, stapling can be performed at an arbitrary position even if the afterward instruction is performed.

Although the foregoing structure has the arrangement such that the aligning rod 41 is used to move the sheets S to the position for the one-front-portion binding mode if the afterward instruction is performed after the sheets S have been aligned. If the sheets S have been aligned at the one-front-portion binding position and as well as an afterward instruction of one-front-portion binding or two-portion binding is performed, an arrangement may be employed in which the aligning rod 41 is moved to a predetermined aligning position; the sheet bundles in all bins are moved to the predetermined positions toward the aligning rod 41 by the multiguide 156 and the swing guide 55*b;* and the predetermined binding operation is performed. Since the foregoing structure is arranged in such a manner that the sheets are aligned at the stapling position, the cut portion in the bin for introducing the stapler can be minimized. Therefore, the sheet stacking characteristic can be improved.

(Pushing of Sheet Bundle)

Small size sheets (B5 or A4 sheets) are enabled to be taken from the front portion of the apparatus after the sheets have been aligned by the structure in which the side ends of the sheets are pushed from the surface of the bind tray B. The sheet bundle is pushed by the aligning rod 41 and the reference guide 55.

The sheet bundle, which has been aligned (or stapled by the stapler to be described later), is pushed in such a manner that; initially the reference guide 55, which is in contact with the side end of the sheet at the reference position P2, as shown in FIG. 11(*a*), moved to the relief position P1 by the pulse motor 154*c*. At this time, the reference guide 55 is moved in a direction in which the reference guide 55 is moved away from the side end of the sheet bundle (step K). Therefore, the sheet bundle is not dislocated due to the movement.

Then, the aligning rod 41 is moved from the alignment position by a predetermined quantity La (La>K) by the pulse motor 38. The movement of the aligning rod 41 results in the sheets being pressed at the side end thereof. Thus, the sheet bundle is pushed in a direction indicated by an arrow toward the front portion of the apparatus along a stopper 158 by La (position S1 to position S2).

Then, the reference guide 55 relieved to the relief position P1 is, as shown in FIG. 11(*b*), moved to the upward movement position P3 while pushing upwards the rear end of the sheets. At this time, the rear end of the sheet is supported by the reference guide 55 and the stopper 158 and the side end is supported by the aligning rod 41 so that the positions of the sheets are changed to be inclined on each bin tray B (positions S2 to position S3). The molding member 55*c* is attached to the surface of the reference guide 55 that comes in contact with the sheet so that the rear end of the sheet is caught by the knurled portion 55*c*1 so that the sheet is reliably pushed upwards, followed by being separated from the knurled portion 55*c*1 and comes in contact with the guide portion 55*c*2 until the guide 55 reaches the upward movement position P3.

In the foregoing state, the aligning rod 41 is, as shown in FIG. 11(*c*), moved in a direction indicated by an arrow by a predetermined quantity Lb. The cover 14 in front of the sorter 11 has a space X that is sufficiently large to allow the sheet to pass through, and the cover 14 has a guide member 14*a* for guiding and holding the pushed sheet bundle. Therefore, the side end of the sheet is completely pushed outside the apparatus by the movement of the aligning rod 41 by the quantity Lb (position S3 to position (S4). Since the guide portion 55*c*2 of the molding matter 55*c* attached to the reference guide 55 is in contact with the rear end of the sheet and therefore guides the sheet at this time, the sheet can be discharge smoothly without the damage of the end surface of the sheet.

The reference guide 55 at the upward movement position P3 is, as shown in FIG. 11(*d*), moved to the reference position P2, and the end of the sheet bundle comes in contact with the guide member 14*a* provided for the cover 14 in front of the sorter 11 so as to be held (position S4 to position S5). As a result, the reference guide 55 and the rear end of the sheet are separated from each other. Therefore, if sheet bundles to be sorted are left after the sheet bundle have been pushed, the vertical movement of the bin tray does not cause contact between the sheet held at position S5 and the molding member 55*c* provided for the surface of the reference guide 55 that comes in contact with the sheet.

If a predetermined number of bundles have been sorted, the operation of the apparatus is completed here. If bundles to be sorted exist, the residual bundles are sorted on to the sheet bundles (position S5) placed on each bin tray, and the alignment and pushing are performed so that the operation of the apparatus is completed.

Figure 46:
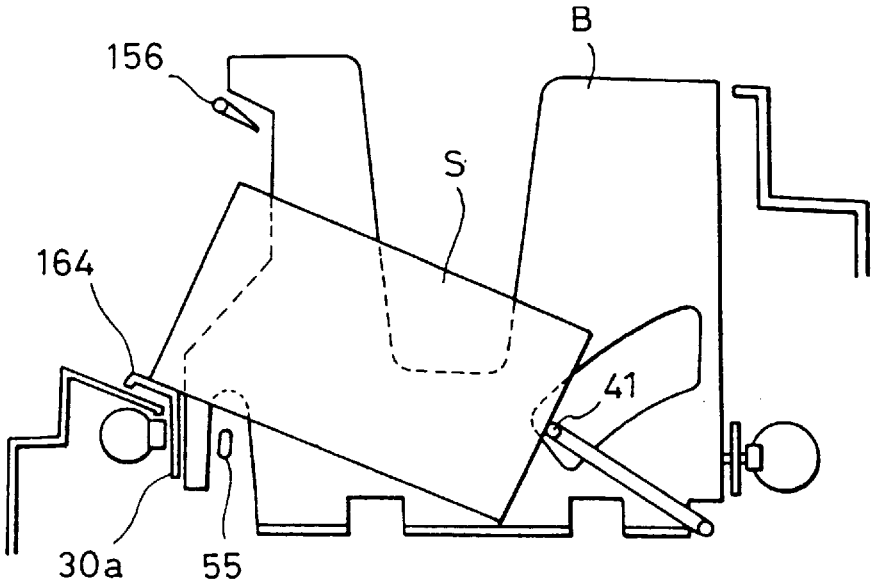
FIG. 46 is a top view showing a state where the sheet pushed on to the bin tray is maintained.

Although this embodiment has the structure such that the sheet bundle is brought into contact with the guide member 14*a* provided for the front cover 14 so as to be held (see FIG. 11(*d*)), a support portion 164 having the same effect as that of the guide member 14*a* may be provided for the erect portion 30*a* in front of the bin unit; and the end of the sheet bundle may be brought into contact with the support portion 164 to attain a similar effect (see FIG. 46).

After the foregoing operations have been completed, if a detection signal supplied from the penetration sensor 151 represents that a sheet exists, the aligning rod 41 maintains the position for holding the sheet bundle shown in FIG. 11(*d*). As a result, when an operator takes out the sheet bundle from the bin tray, undesirable introduction of the sheet bundle between the bin trays can be prevented. After taking of the sheet bundle has been completed by the operator, the detection signal supplied from the penetration sensor 151 represents that no sheet exits. Thus, the aligning rod 41 is moved from the position for holding the sheet bundle to the home position (the relief position).

(Condition for Relief Position for Aligning Rod)

Figure 56:
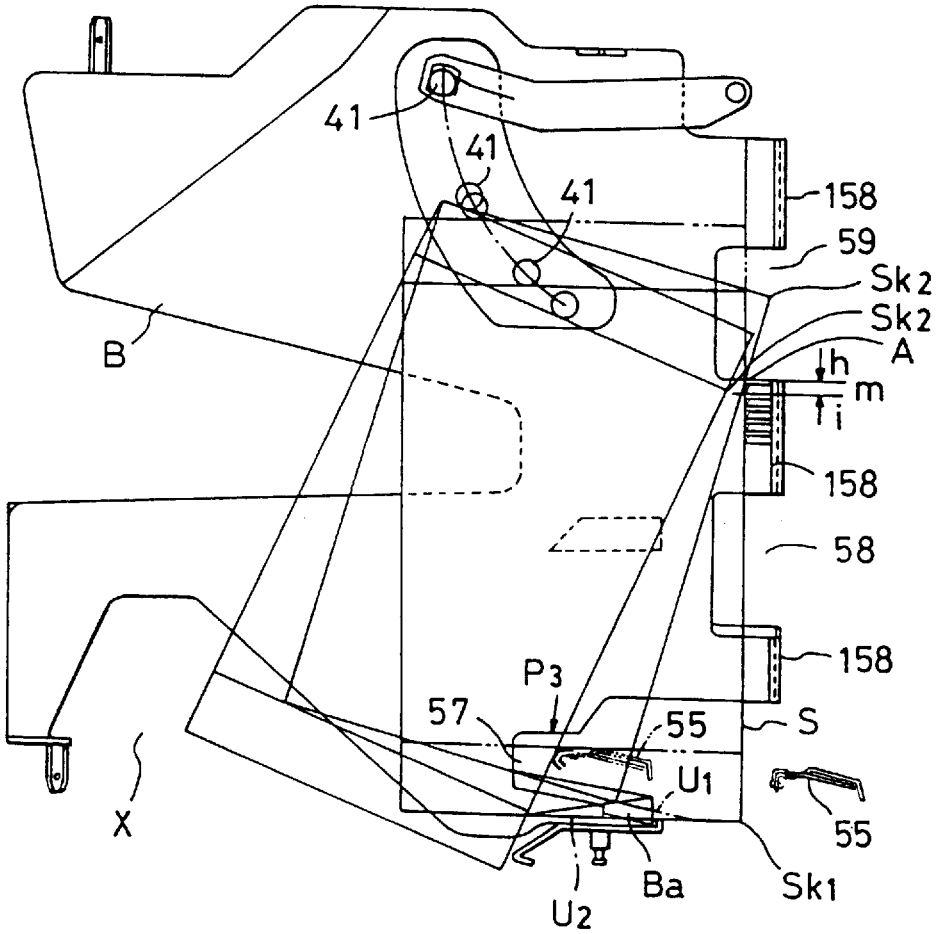
FIG. 56 is a top view showing a state (the locus) of the corner of a sheet when the sheet is pushed upwards.

To prevent introduction of the corner of the sheet in the front portion of the apparatus into the cut portion of the bin tray when the position of the sheet is changed to the inclined state by the reference guide 55 during the sheet-bundle pushing operation, the present invention has a structure such that the corner of the sheet is pushed upwards while being restricted between the bin trays. The structure will now be described with reference to the drawings. FIG. 56 shows a state where a small-size sheet bundle is pushed, and FIG. 57 shows a state where a large-size sheet bundle is pushed.

Figure 57:
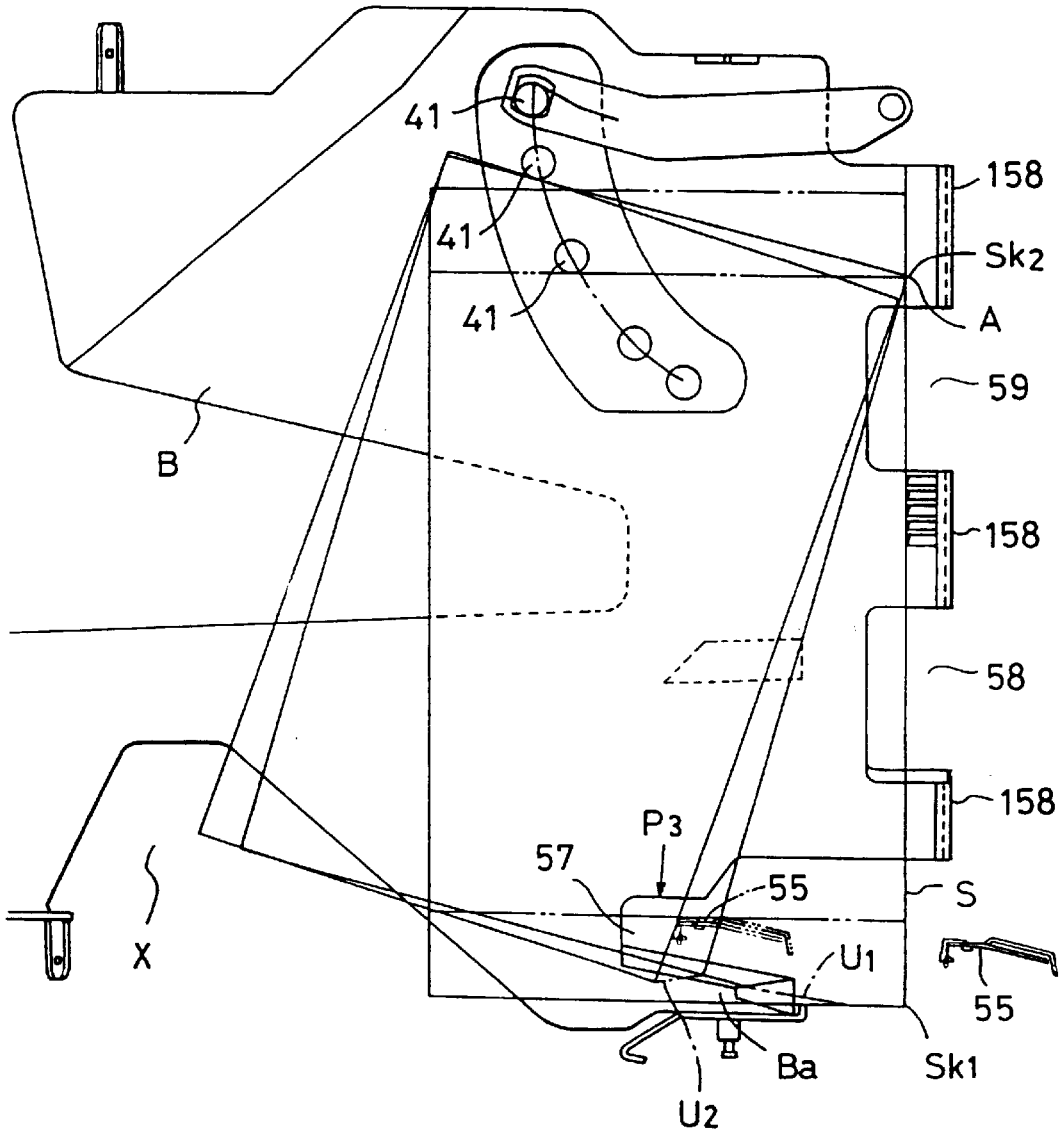
FIG. 57 is a top view showing a state (the locus) of the corner of a sheet when the sheet is pushed upwards.

As shown in FIGS. 56 and 57, the aligning rod 41 pushes inwards the sheet S to the front portion of the apparatus before it moves upward the sheet S. The sheet is pushed inwards to a position (the position out of the cut portion 57 in the bin tray B) to which the sheet is pushed upwards in such a manner that the corner of the sheet is restricted between the bin trays when the sheet is pushed upwards. After the inward pushing operation has been completed, the aligning rod 41 is relieved to a predetermined relief position. The relief position for the aligning rod 41 is determined to a position at which the sheet is pushed upwards in such a manner that the corner SK1 is restricted between the bin trays. Note that the quantity of pushing of the aligning rod 41 and the relief position for the same are determined appropriately to correspond to the size of the sheet intended to be discharged from the space X in the front portion of the apparatus.

Since the aligning rod 41 is moved as described above, the corner SK1 of the sheet S pushed inwards to the front portion of the apparatus is, by the reference guide 55, pushed upwards through a first locus U1, the first support point for rotation of which is position A of the stopper 158 on the bin tray B. Then, it is pushed upwards to the upward movement position P3 through a second locus U2, the second support point for rotation of which the aligning rod 41 relieved to the foregoing position. As a result, as can be understood from the figure, the corner SK1 of the sheet S does not pass through the cut portion 57 in the bin tray B but the same is moved on the surface Ba of the bin for stacking sheets S. Thus, the corner SK1 of the sheet S is pushed upwards while being restricted between the bin trays. As a result, undesirable introduction into the cut portion 57 formed in the bin tray B for moving the reference guide 55 causing bending or breakage of the sheet can be prevented.

Large-size sheets (for example, A4-sheets) among sheets (that can be taken from the front portion) that are pushed upwards by the reference guide 55 are, as shown in FIG. 57, pushed upwards in such a manner that the position A of the inner stopper 158 that comes in contact with the inner corner SK2 of the sheet S is the first support point for the rotation); and the aligning rod 41 moved to the predetermined relief position is the second support point for the rotation so that the corner SK1 of the sheet S is restricted between the bin trays when the sheets S are pushed upwards. Small-size sheets (for example, B5-sheets) are, as shown in FIG. 56, pushed upwards in such a manner that the position A of the central stopper 158 that comes in contact with a portion of the rear end of the sheet serves as a first support point for the rotation and the aligning rod 41 moved to the predetermined relief position serves as a second support point for the rotation. Thus, the sheets are pushed upwards similarly in such a manner that the corner SK1 of the sheet S is restricted between the bin trays. Since the inner corner SK2 of the sheets (regardless of the size) is positioned at the inner cut portion 59 for stapling or above the same when viewed in FIG. 56, the corner SK2 of the sheet is pushed inwards to an inner position i by a distance h (>0) over a line m of the central stopper 158 when the sheets are discharged to the discharge position in the front portion of the apparatus by the aligning rod 41. As a result, even if the aligning rod 41 is relieved to the home position for the following process, undesirable introduction of the corner SK2 of the sheet into the cut portion 59 can be prevented.

Figure 58:
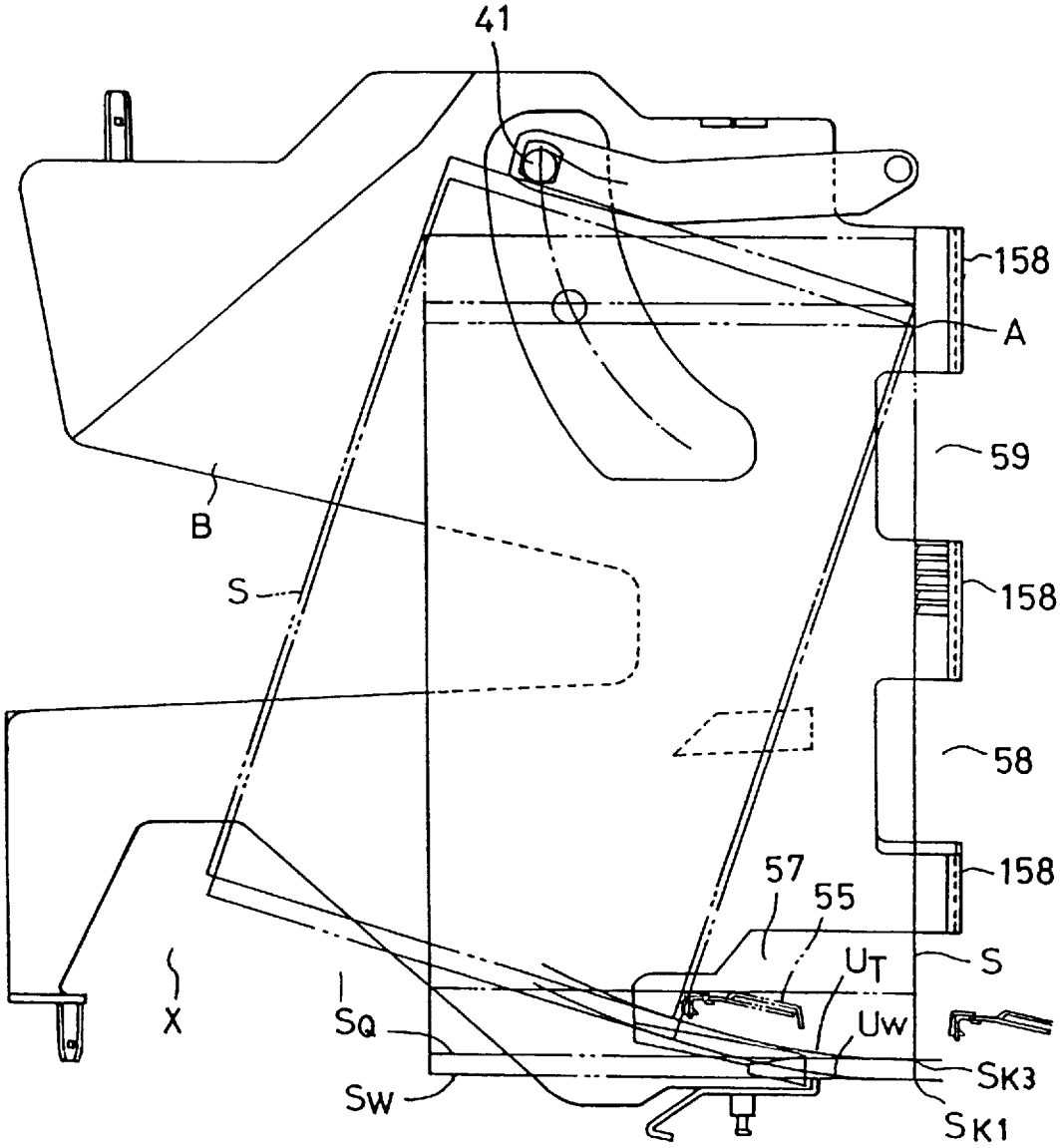
FIG. 58 is a top view showing a state (the locus) of the corner of a sheet when the sheet is pushed upwards.

A method will now be described with reference to FIG. 58 in which the aligning rod 41 is not used as the second support point for the rotation to prevent the introduction of the corner SK1 of the sheet S into the cut portion 57. After the sheets S have been aligned, the reference guide 55 is relieved to inwards push the sheets S by the aligning rod 41. Since the quantity of pushing is small at this time, and the locus UT of the corner SK3 of the sheet S passes through position SQ, that is, the cut portion 57, a similar problem arises.

Accordingly, sufficient inward pushing of the side end of the sheet to position SW will cause the locus UW of the corner SK1 of the sheet S to pass on the stacking surface Ba of the bin tray. Thus, the foregoing problem can be overcome and the sheet bundle can be taken.

(Inhibition Control of the Sheet-bundle Pushing Operation)

As described above, the operation for pushing the sheet bundle is performed after the sorting and sheet aligning operations (the stapling operation if stapling is performed) have been performed. If a sheet bundle having a thick paper cover (a cover mode) is sorted, the cover is initially sorted. If the cover is counted as one bundle when the foregoing operation for pushing the sheet bundle is performed, alignment with the sheet (copied sheet) to be discharged onto the cover cannot be established. If stapling is performed, a defect takes place during the stapling operation.

If the number of sheets of the sheet bundle discharged onto each bin tray exceeds a predetermined number of sheets after the sheets have been aligned and before the operation for pushing the sheet bundle is performed, the load acting on the aligning rod is enlarged excessively when the foregoing pushing operation is performed even if each bin tray has a sufficient stacking capacity. Thus, there arises a risk that the operation for pushing the sheet bundle cannot be performed smoothly and thus malfunction takes place.

Accordingly, the operation of pushing the sheet bundle by the aligning rod 41 to the front portion of the apparatus (the position at which the sheet bundle is taken) is inhibited by a control means (not shown) under a predetermined condition. Specifically when one sheet is sorted (in a cover mode) or sheets larger than a predetermined number are sorted, the foregoing operation for pushing the sheet bundle is inhibited. Then, the control for inhibiting the operation for pushing the sheet bundle in the one-sheet sorting mode and the mode in which sheets larger than a predetermined number are sorted will now be described with reference to flow charts shown in FIGS. 59 and 60.

<One-Sheet-Sorting Mode (Cover Mode)>

Figure 59:
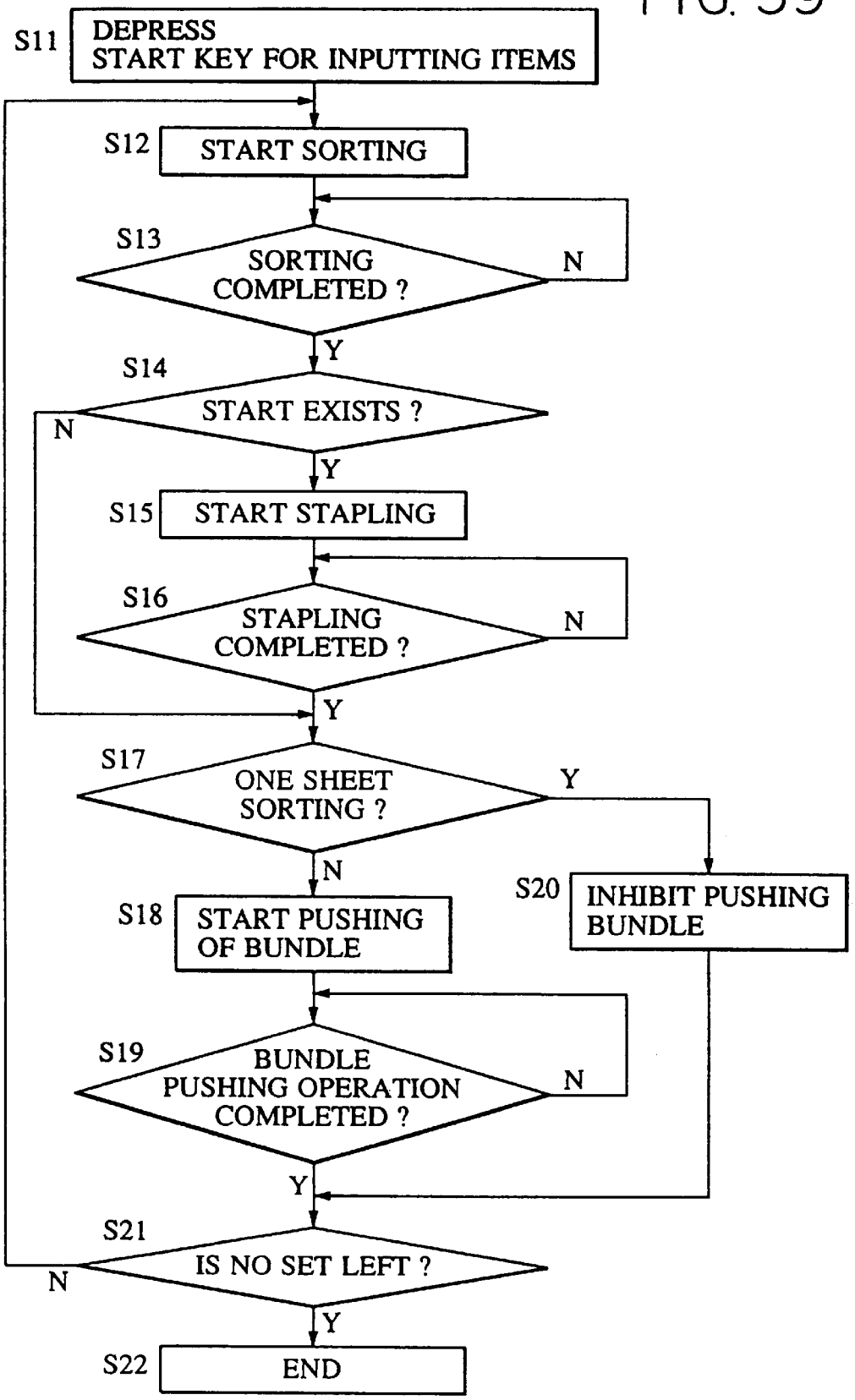
FIG. 59 is a flow chart showing a control operation for inhibiting the pushing of a bundle when one sheet sorting is performed.

As shown in FIG. 59, in step S11 initially the operator sets an original document to the apparatus for automatically feeding the original document shown in FIG. 1, and the operator inputs the number of sheets of the original document, the desired number of copies, and the modes through the operation portion (not shown) of the image processing apparatus, followed by depressing the copy-start key. Note that the number of the sheets of the original document may be caused to be recognized by a control circuit of the body of the image processing apparatus by idly circulating the original document by the apparatus for automatically feeding the original document.

In steps S12 and S13 sheets discharged from the body of the image processing apparatus are sorted. If the number of the set number of bundles is larger than the number of the bin trays, the bundles are initially sorted by the number which is the same as the number of the bin trays. If the number is smaller the number of the bin trays, the bundles are sorted. Whenever the first sheet is sorted on each bin tray, the foregoing alignment of the sheet is performed.

In step S14 whether or the set mode is the staple mode is discriminated. If the stapling mode is set, the operation proceeds to steps S15 and S16 in which the stapling operation, to be described later, is performed. If the mode, in which stapling is not performed, has been set, the operation proceeds to step S17.

In step S17 whether or not one sheet sorting has been performed is discriminated. If the one sheet sorting operation has not been performed, the operation proceeds to steps S18 and S19 in which the reference guide 55 and the aligning rod 41 are operated so that the operation for pushing the sheet bundle is performed. Thus, the sheet bundle is pushed to the front portion of the apparatus at which the sheet bundle is taken. If one-sheet sorting is performed, the foregoing operation for pushing the sheet bundle is inhibited (step S20) and the operation proceeds to step S21. As a result, even if the cover is sorted in the cover mode, the operation for pushing the sheet bundle is not performed. Even if a sheet, on which an image has been copied, is sorted, alignment with the cover can be performed.

In step S21 whether or not a predetermined number of bundles have been sorted is discriminated. If a predetermined number of bundles has been sorted, the operation of the apparatus is completed (step S22). If bundles to be sorted exist, the operation returns to step S12 in which the foregoing operation is repeated until the bundles are sorted.

<Sorting of Sheets Larger than Predetermined Number>

Figure 60:
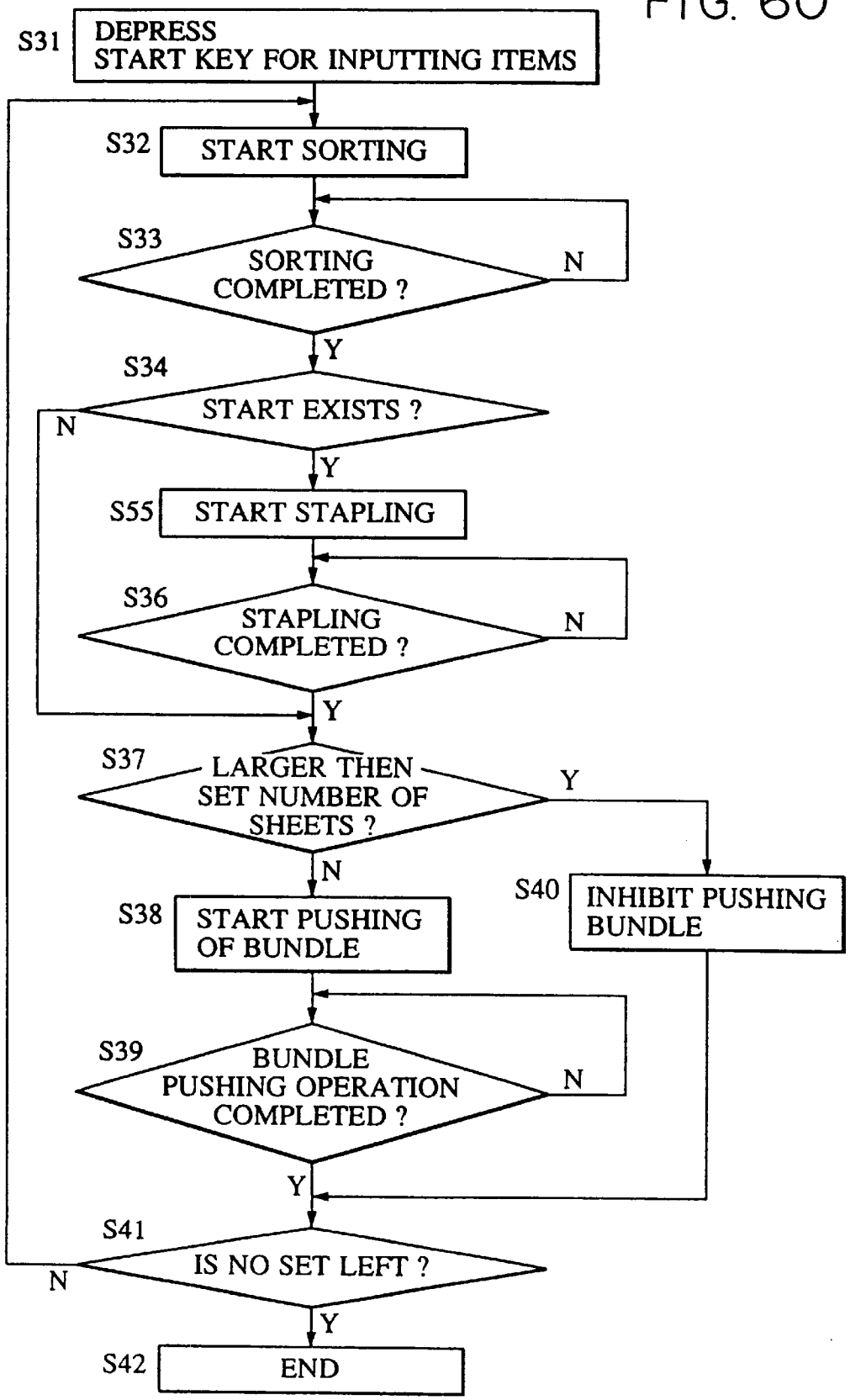
FIG. 60 is a flow chart showing a control operation for inhibiting the operation of pushing the bundle when sheets by a number larger than a predetermined number are sorted.

As shown in FIG. 60, in step S31 initially the operator sets an original document to the apparatus for automatically feeding the original document shown in FIG. 1, and the operator inputs the number of sheets of the original document, the desired number of copies, and the modes through the operation portion (not shown) of the image processing apparatus, followed by depressing the copy-start key. Note that the number of the sheets of the original document may be caused to be recognized by the control circuit of the body of the image processing apparatus by idly circulating the original document by the apparatus for automatically feeding the original document.

In steps S32 and S33 sheets discharged from the body of the image processing apparatus are sorted. If the number of the set number of bundles is larger than the number of the bin trays, the bundles are initially sorted by the number which is the same as the number of the bin trays. If the number is smaller the number of the bin trays, the bundles are sorted. Whenever the first sheet is sorted on each bin tray, the foregoing alignment of the sheet is performed.

In Step S34 whether or the set mode is the staple mode is discriminated. If the stapling mode is set, the operation proceeds to steps S35 and S36 in which the stapling operation, to be described later, is performed. If the mode, in which stapling is not performed, has been set, the operation proceeds to step S37.

In Step S37 whether or not a predetermined number of bundles have been sorted is discriminated (the number of sheets that can be pushed by the aligning rod). If the number of the sheets is smaller than the set number, the operation proceeds to steps S38 and S39 in which the reference guide 55 and the aligning rod 41 are operated so that the operation for pushing the sheet bundle is performed so that the sheet bundle is pushed to the front portion of the apparatus at which the sheet bundle is taken. If the number of the sheets is larger than the set number, the foregoing operation for pushing the sheet bundle is inhibited (step S40), and operation proceeds to step S41. As a result, if the number of the sheets discharged onto each bin tray is larger than a predetermined number, the foregoing operation for pushing the sheet bundle is inhibited even if each bin tray has a stacking capacity. Thus, malfunction can be prevented.

The number of the sheets is the number of sheets instructed from the operation portion (not shown); the number of sheets calculated by multiplying the number of sheets of the original document instructed from the operation portion and the number of copies (the maximum number is the number of the bin trays); or the number (counted number) of sheets detected by a sheet detection sensor provided for the sheet passage. In step S37 whether or not the number of the sheets is larger than a set number is discriminated.

In step S41 whether or not a predetermined number of bundles has been sorted is discriminated. If the predetermined number of bundles has been sorted, the operation of the apparatus is completed (step S42). If bundles to be sorted exist, the operation returns to step S32 in which the foregoing operation is repeated until no residual bundle exists.

Although the foregoing control operation is arranged in such a manner that the operation for pushing the sheet bundle is automatically inhibited under a certain condition, the present invention is not limited to this. For example, another structure may be employed in which an operation portion (not shown) for inputting a signal for inhibiting the operation for pushing the sheet bundle is provided; and a user inputs the signal from the operation portion to inhibit the operation for pushing the sheet bundle. Thus, the user is able to arbitrarily inhibit the operation for pushing the sheet bundle.

<Non-Binding Sorting Mode>

If non-binding sorting is performed except the foregoing operation, there is sometimes a case where binding is desired by an operator after sorting has been completed. If afterwards binding is performed, it can be instructed by a setting means (not shown). If the operation for pushing the sheet bundle is automatically performed after the non-binding sorting operation has been completed in a case where afterward binding is required, there arises a problem in that the operator cannot select binding.

Figure 61:
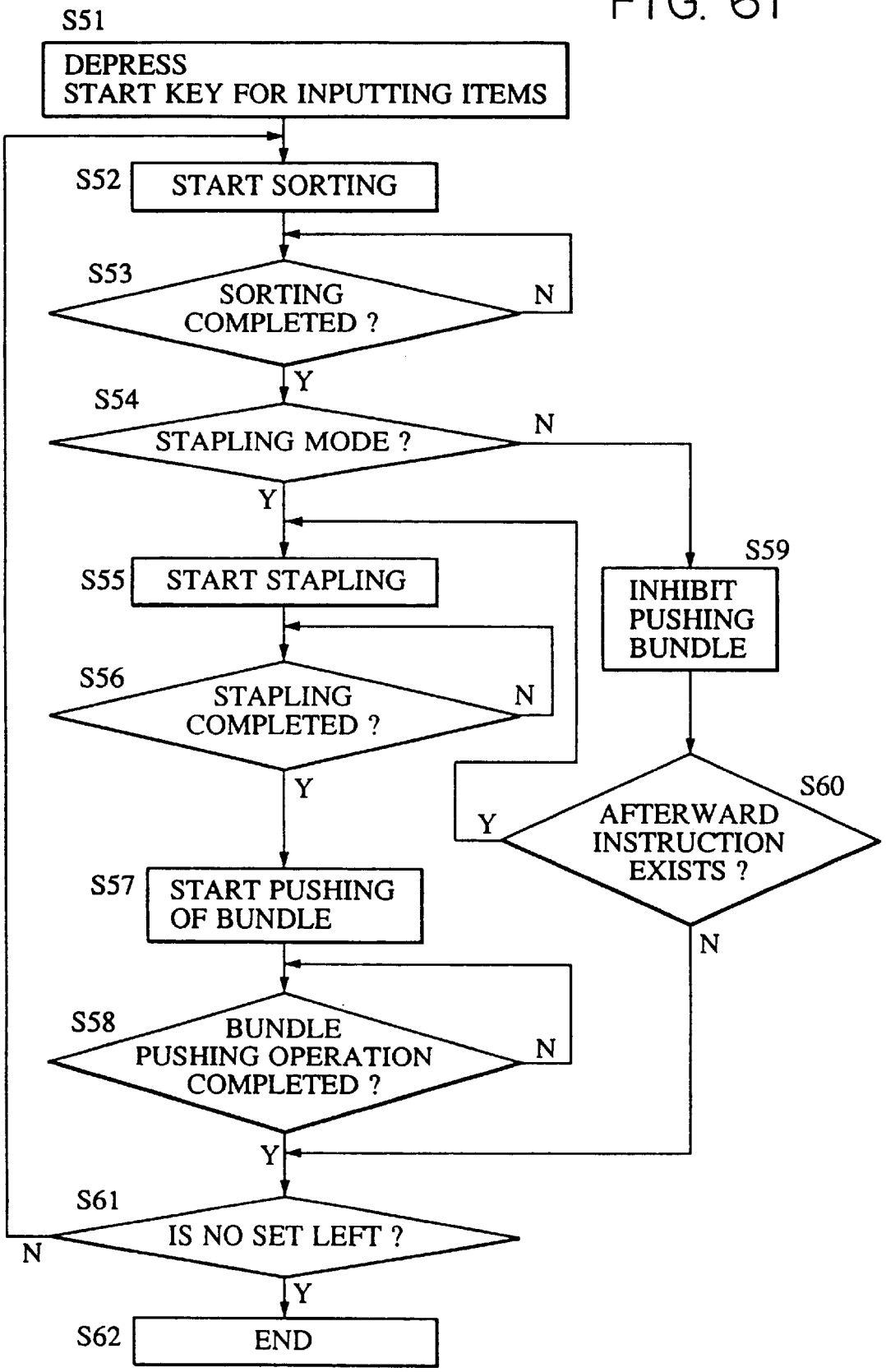
FIG. 61 is a flow chart showing a control operation for inhibiting the operation of pushing the bundle in a nonbinding sorting mode.

Accordingly, it is effective to inhibit operation for pushing the sheet bundle under the foregoing condition. The foregoing case will now be described with reference to a flow chart shown in FIG. 61. As shown in FIG. 61, in step S51 initially the operator sets an original document to the apparatus for automatically feeding the original document shown in FIG. 1, and the operator inputs the number of sheets of the original document, the desired number of copies, and the modes through the operation portion (not shown) of the image processing apparatus, followed by depressing the copy-start key. Note that the number of the sheets of the original document may be caused to be recognized by a control circuit of the body of the image processing apparatus by idly circulating the original document by the apparatus for automatically feeding the original document.

In steps S52 and S53 sheets discharged from the body of the image processing apparatus are sorted. If the number of the set number of bundles is larger than the number of the bin trays, the bundles are initially sorted by the number which is the same as the number of the bin trays. If the number is smaller the number of the bin trays, the bundles are sorted. Whenever the first sheet is sorted on each bin tray, the foregoing alignment of the sheet is performed.

In step S54 whether or the set mode is the staple mode is discriminated. If the stapling mode is set, the operation proceeds to steps S55 and S56 in which the stapling operation, to be described later, is performed. Then, the operation proceeds to steps S57 and S58 in which the reference guide 55 and the aligning rod 41 are operated so that the foregoing operation for pushing the sheet bundle is performed so that the sheet bundle is pushed to the front portion of the apparatus, at which the sheet bundle is taken. If the mode, in which stapling is not performed, has been set, the operation for pushing the sheet bundle is inhibited (step S59) and the operation proceeds to step S60. As a result, the problem can be prevented that takes place in a case where stapling is intended to be performed by the afterward instruction after the non-bound sheet bundle has been sorted.

In step S60 whether or not the afterward instruction of the staple mode has been performed is discriminated. If the afterward instruction has been performed, the operation returns to step S55 in which the foregoing operation is repeated. If the afterward instruction has not been performed, the operation proceeds to step S61.

In step S61, whether or not a predetermined number of sheet bundle has been sorted is discriminated. If the predetermined number of sheet bundle has been completed, the operation of the apparatus is completed (step S62). If bundles to be sorted exist, the operation returns to step S51 in which the foregoing operation is repeated until the bundles are sorted.

<Sorting of Plural Sheets (Front Cover and Rear Cover Mode)>

The foregoing control operation is arranged in such a manner that the operation for pushing the sheet bundle is inhibited when one sheet is sorted. However, in a case where one rear cover is intended to be provided, if the operation for pushing the sheet bundle is performed before the one rear cover is sorted after a plurality of copied sheets have been sorted on the one sorted front cover though the operation for pushing the sheet bundle is inhibited, defective alignment of the sheets and malfunction take place.

Figure 62:
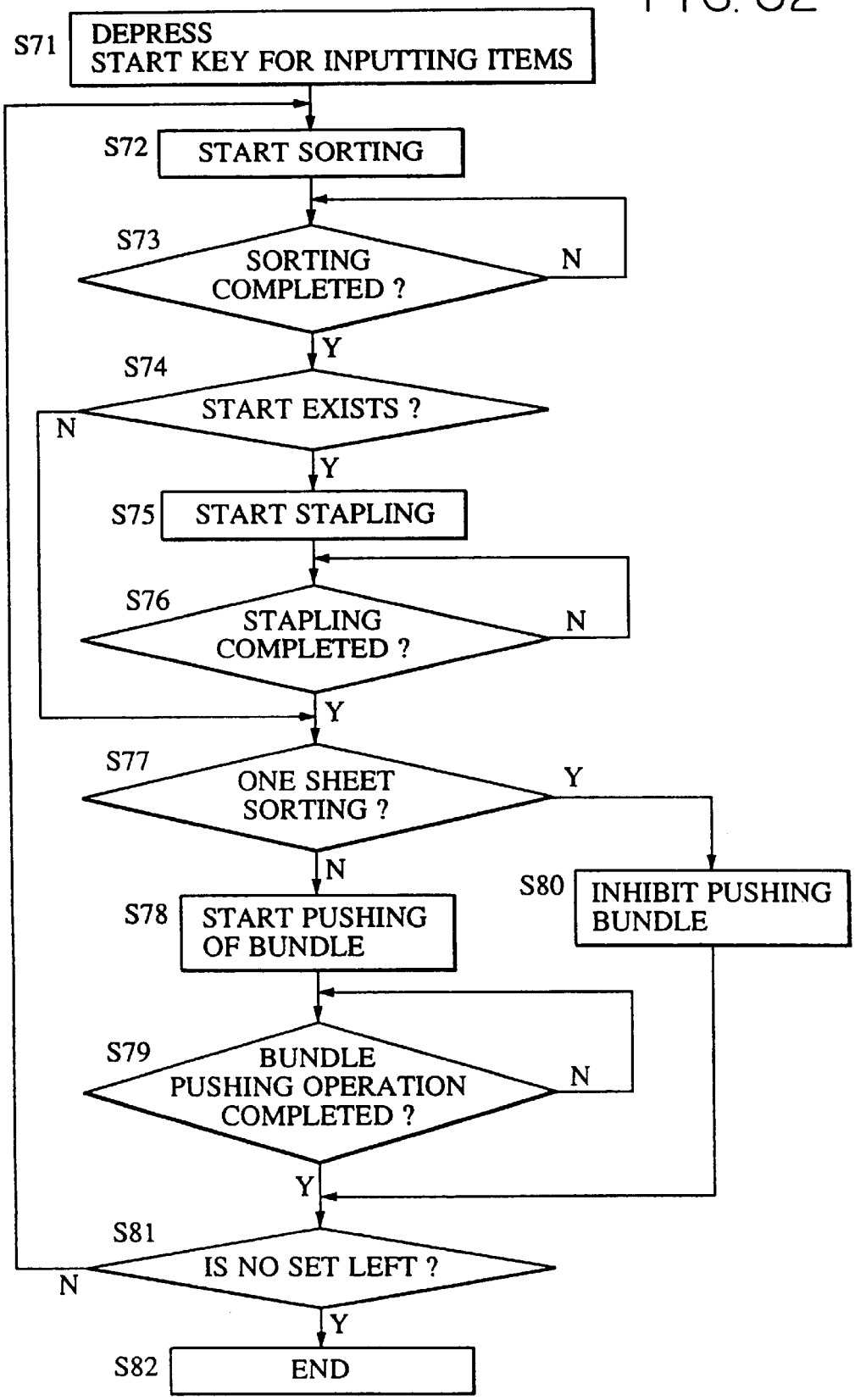
FIG. 62 is a flow chart showing a control operation for inhibiting the operation of pushing the bundle when one sheet is sorted after a plurality of sheets have been sorted.

Accordingly, it is effective to inhibit the operation for pushing the sheet bundle under the foregoing condition. The foregoing operation will now be described with reference to a flow chart shown in FIG. 62. As shown in FIG. 62, in step S71 initially the operator sets an original document to the apparatus for automatically feeding the original document shown in FIG. 1, and the operator inputs the number of sheets of the original document, the desired number of copies, and the modes through the operation portion (not shown) of the image processing apparatus, followed by depressing the copy-start key. Note that the number of the sheets of the original document may be caused to be recognized by the control circuit of the body of the image processing apparatus by idly circulating the original document by the apparatus for automatically feeding the original document.

In steps S72 and S73 sheets discharged from the body of the image processing apparatus are sorted. If the number of the set number of bundles is larger than the number of the bin trays, the bundles are initially sorted by the number which is the same as the number of the bin trays. If the number is smaller the number of the bin trays, the bundles are sorted. Whenever the first sheet is sorted on each bin tray, the foregoing alignment of the sheet is performed.

In step S74 whether or the set mode is the staple mode is discriminated. If the stapling mode is set, the operation proceeds to steps S75 and S76 in which the stapling operation, to be described later, is performed. If the mode, in which stapling is not performed, has been set, the operation proceeds to step S77.

In step S77 whether or not one sheet is sorted on to the sorted sheet bundle (the front cover and rear cover mode) is discriminated. If the one-sheet sorting is not performed, the operation proceeds to steps S78 and S79 in which the reference guide 55 and the aligning rod 41 are operated so that the operation for pushing the sheet bundle is performed. Thus, the sheet bundle is pushed to the front portion of the apparatus, at which the sheet bundle is taken. If the one-sheet sorting is performed, the operation for pushing the sheet bundle is inhibited (step S80) and the operation proceeds to step S81. As a result, even if one front cover is sorted in the front cover and rear cover mode and then a plurality of sheets are sorted, the operation for pushing the sheet bundle is not performed. Therefore, even if the rear cover is sorted after the sorting operation has been performed, alignment with the sheet bundle can be performed.

In step S81 whether or not a predetermined number of bundles has been sorted is discriminated. If the predetermined number of bundles has been sorted, the operation of the apparatus is completed (step S82). If bundles to be sorted exist, the operation returns to step S71 in which the foregoing operation is repeated until no residual bundle exists.

In a case where one sheet is sorted after a plurality of sheets have been sorted and then a plurality of sheets are sorted in order to provide a guard sheet, it is effective to inhibit the operation for pushing the sheet bundle. As a result, the defective alignment of the sheets and malfunction can be prevented which have been experienced with the conventional technique.

<Bin Tray>

<Forming of Bin Tray into Warped Shape>

The rigidity of the bin tray B to be accommodated in the bin unit 17 deteriorates due to the cut portion and the like, and therefore it is deflected due to the weight of the stacked sheets and the like. Thus, there arises a risk that the surface for stacking the sheets cannot be maintained to be horizontal. If the bin is warped downwards, the sheets S discharged through a discharge roller pair 951, as shown in FIG. 12(*d*) in a direction indicated by an arrow 952, are brought into contact with a bin warped downwards (alternate long and one short dash line Bd), thus causing a defect to take place in the discharge operation. Accordingly, some bins have somewhat upward warped portions to prevent the same being warped downwards. However, the bin tray B according to the present invention is intended to prevent its deflection due to the deterioration in the rigidity thereof by compensating the degree of deflection (downward warp) due to the deadweight by previously upwards warping (upward warp) the shape thereof when it is accommodated in the bin unit 17, as shown in FIG. 12(*a*). As a result, when the bin tray B is accommodated in the bin unit 17, the surface for stacking the sheets is made to be horizontal as shown in FIG. 12(*b*). Therefore, an excellent sheet stacking characteristic can be obtained.

(Sharp Form of Stopper)

Figure 41A:
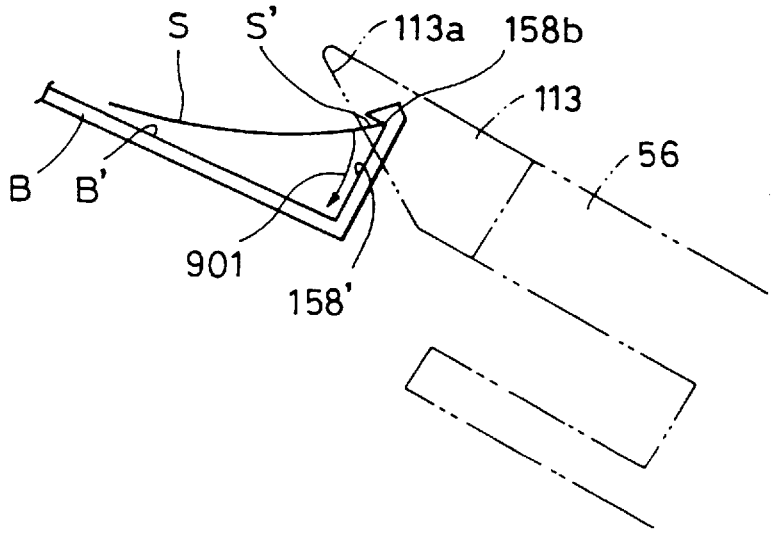
FIGS. 41(*a*), 41(*b*), and 41(*c*) are schematic views showing a portion near the stopper of the bin tray.
Figure 41B:
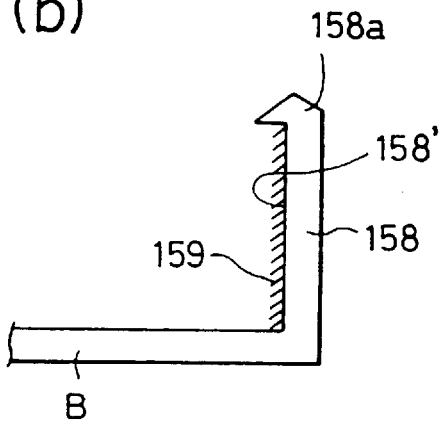
Figure 41C:
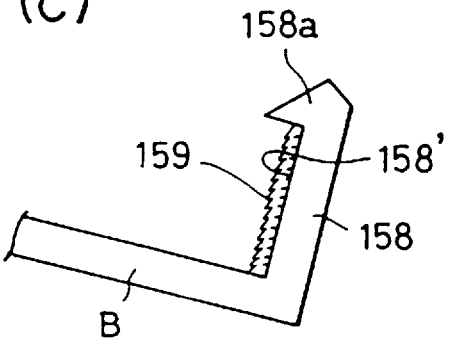

Since the bin tray B is set while being inclined in such a manner that the upstream portion thereof is made lower than the downstream portion thereof in the sheet discharge direction when it is accommodated in the bin unit 17, a stopper 158 is provided in the most upstream position for the purpose of maintaining the end of the sheet. The stopper 158 is formed to have a sharp angle θ that is made from the sheet stacking surface (see FIG. 13). As a result, upward projection of the end of the sheet warped after the discharge can be prevented. In a case where the sheet bundle is stapled by the stapler 56 and as well as a guide surface 113*a* of an upper guide member 113 provided on the upper portion of the stapler 56 is used to downwards push raised point S' at the rear end of the sheet S toward the stacking surface B' of the bin B, the point S' tends to be moved in a direction indicated by an arrow 901. Since the surface 158' of the stopper 158 is formed into a shape that is widened in the downward direction as compared with the right angle stopper, the rear end S' of the raised sheet S can be smoothly pushed upwards and the sheets S can be stapled without disorder of the sheet bundle (see FIGS. 13 and 41(*a*)). It is preferable that the angle θ be 90 degrees or smaller, more preferably about 80 degrees.

(Friction Member Provided for Stopper)

Figure 13:
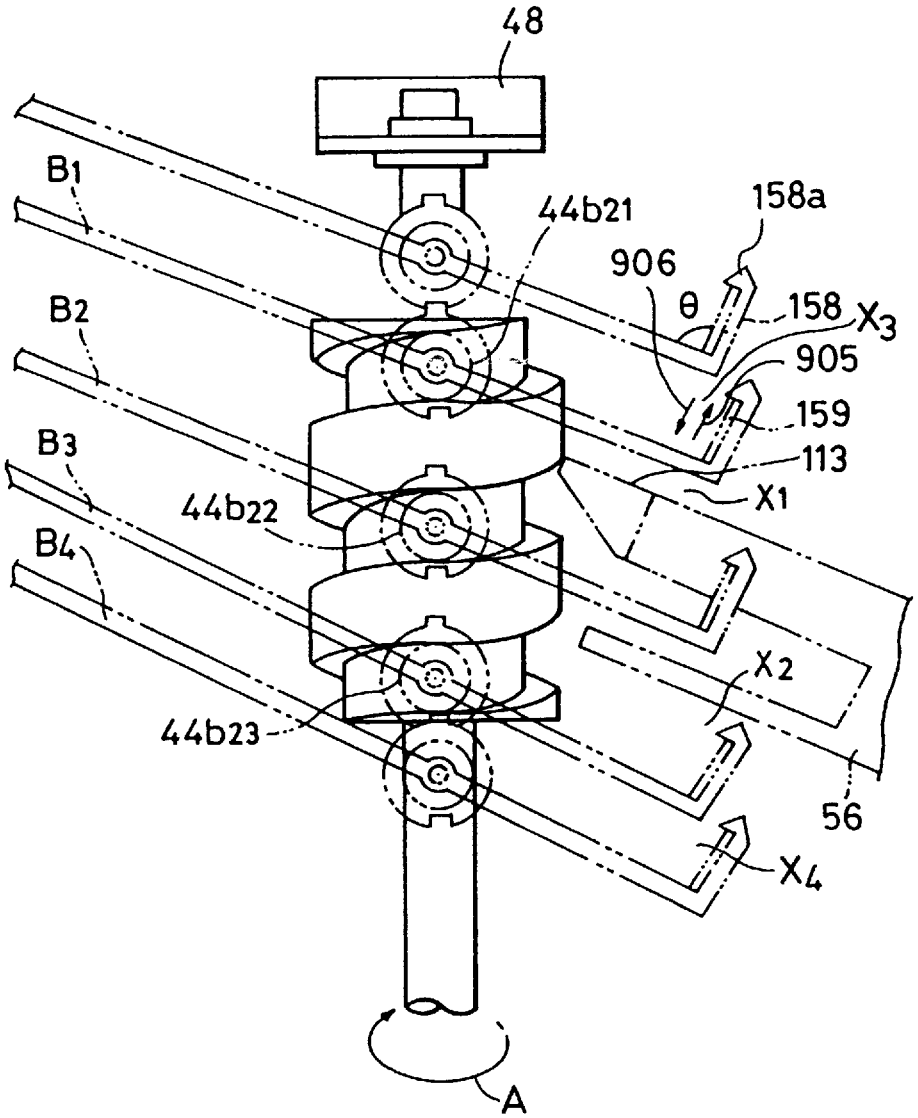
FIG. 13 is a side view showing an operation of opening the bin tray by a lead cam of the sheet processing apparatus.

On the erected surface (the surface that comes in contact with the sheet) of the stopper 158, there is bonded a friction member 159 in order to prevent the end of the sheet being moved upwards. The friction member 159, as shown in FIG. 13, comprises a felt-like member that restricts the movement in the direction indicated by an arrow 905 with respect to the upward movement of the sheet. Specifically, the friction member 159 is made of suede or sponge having a high coefficient of friction. The friction member 159 bonded to the erected surface of the stopper 158 is provided in such a manner that it is continuously attached in the erected surface of the stopper 158 over the widthwise direction of the sheet or it is divided into sections to be bonded. Note that it is preferable that the friction member 159 be a one-way restriction member that can be moved in a direction indicated by an arrow 906 and that cannot be moved in a direction indicated by an arrow 905. For example, it may be a member like a hair-transplant member having downward hairs (see FIG. 41(*b*) or a ratchet-shape member (see FIG. 41(*c*)).

(Hooked Portion of Upper Portion of Stopper)

Figure 40A:
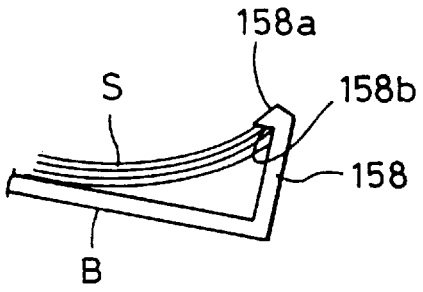
FIGS. 40(*a*) and 40(*b*) are diagrams showing a hooked portion of a stopper of the bin tray.
Figure 40B:
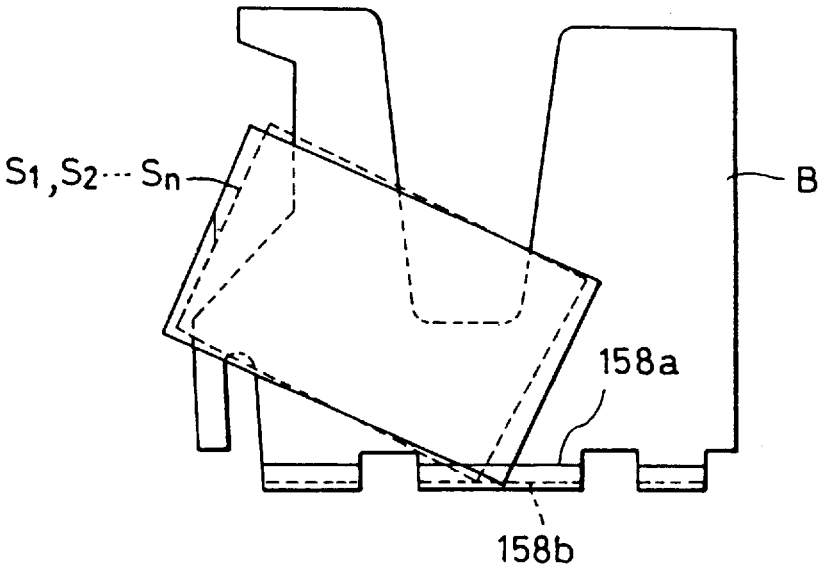

A hooked portion 158*a* for restricting the end of the sheet warped upwards after it has been discharged is formed in the upper portion of the stopper 158. The hooked portion 158*a* according to this embodiment is, as shown in FIG. 6, formed in substantially the central portion of the bin tray B in the direction (a direction perpendicular to the sheet discharge direction) of the width of the sheet or formed continuously to cover the overall surface. As a result, the hooked portion 158*a* is able to correspond to sheets having a variety of sizes. The hooked portion 158*a* prevents a corner 158*b* of the sheet adjacent to the stopper, as shown in FIG. 11(*d*), being placed on the upper surface of the stopper (see FIG. 40(*a*)). Thus, it is effective to stack a plurality of portions S1, S2, . . . , Sn on the bin (See FIG. 40(*b*)).

(Shape of Bin Roller)

Figure 14:
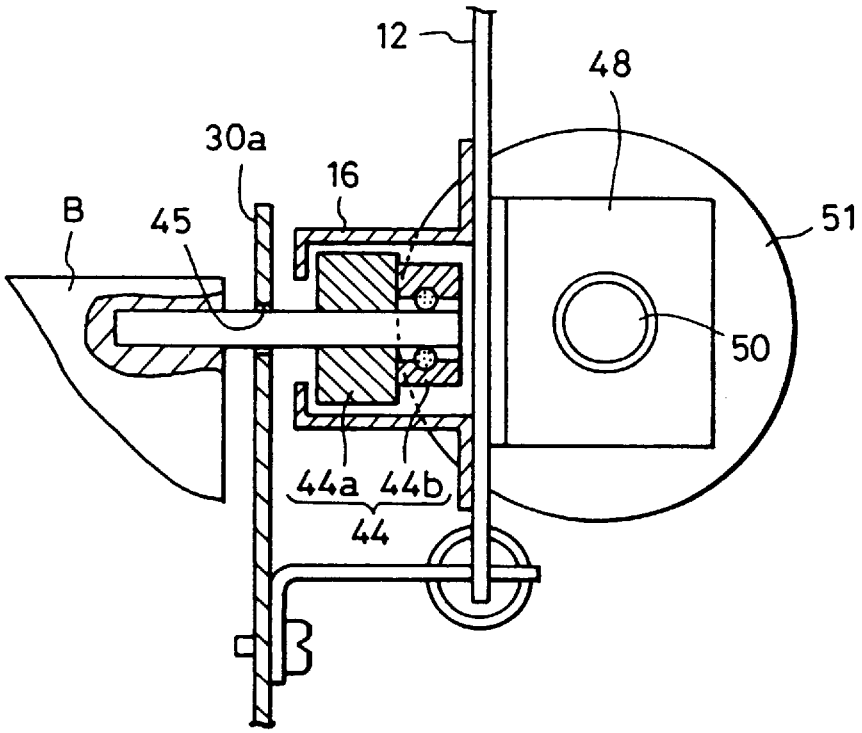
FIG. 14 is a horizontal plan view showing a bin roller attached to the bin tray, a trunnion and lead cam for rotating the bin roller.

Each bin tray B accommodated in the bin unit 17 has, at the two ends of the base portion thereof, bin rollers 44*a*, as shown in FIG. 6. Furthermore, trunnions 44*b* each having a diameter smaller than that of the bin roller 44*a* are rotatively disposed on the outside of the bin rollers 44*a*. The bin rollers 44*a* and the trunnions 44*b* project over a slit 45 formed in an erected portion 30*a* of the bin frame 30, and the bin rollers 44*a* are introduced in such a manner that they are stacked on the guide rail 16 (see FIGS. 13 and 14).

Figure 15A:
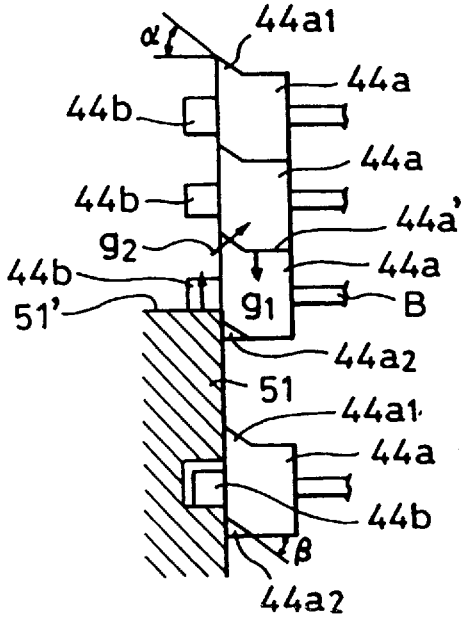
FIGS. 15(*a*), 15(*b*), and 15(*c*) are schematic side views showing the relationship between bin rollers attached to the bin tray.
Figure 15B:
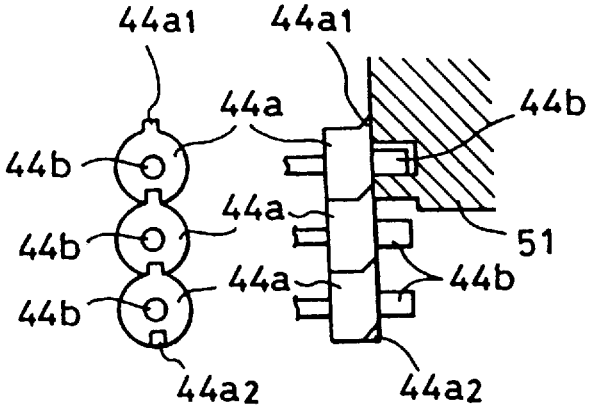
Figure 15C:
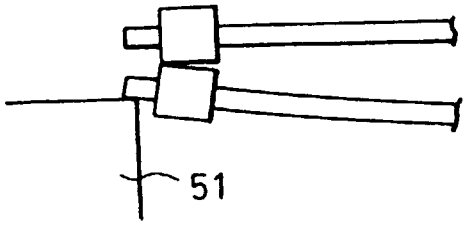

As shown in FIG. 15(*a*), each bin roller 44*a* has, on the outer surface thereof, a projection 44*a*1 in the upper portion; and a recess 44*a*2 formed in the lower portion thereof so that the projection and the recess of the upper and lower bin rollers 44*a* are engaged to each other so as to be secured. The bin roller 44*a* has a member (not shown) for restricting the rotation in the circumferential direction so that the position in the circumferential direction is maintained as illustrated. As a result, the bin roller 44*a* is stacked on the guide rail 16 so that the bin B supported by a lead cam surface 51' of a lead cam 51 receives (arrow g1) the load of all upper bins by an upper surface 44*a*′ of the bin roller, as shown in FIG. 15(*a*). If the projection and recess are not provided, the lowermost bin B is deflected, as shown in FIG. 15(*c*). However, the engaged portion realized by the projection and the recess receives (arrow g2) the force of deflecting as shown in FIG. 15(*a*) so that deflection (downward warp) of the bin tray due to the weight is prevented.

Figure 42A:
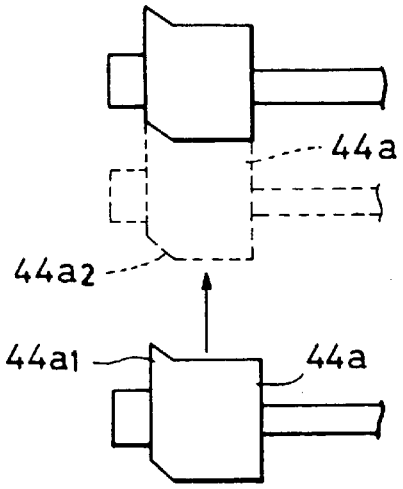
FIGS. 42(*a*) and 42(*b*) are schematic views showing a state where the projections and recesses of the bin rollers approach and move apart from each other.
Figure 42B:
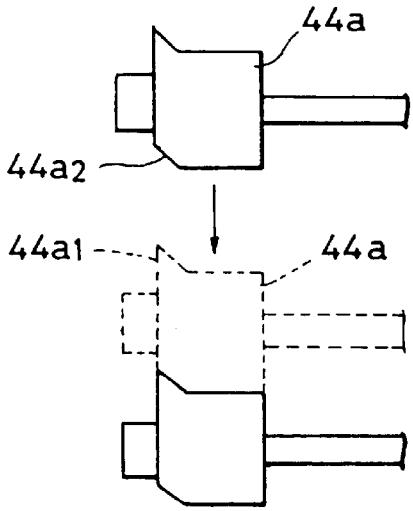

Angles α and β made between the projection 44*a*1 and the recess 44*a*2 are determined to be substantially 45 degrees to easily introduce the projection 44*a*1 and the recess 44*a*2 when the separated bin roller 44*a* is brought to the contact state (see FIGS. 42(*a*) and (*b*)). It is preferable that the angles be 45 deg.±30 deg.

Figure 43A:
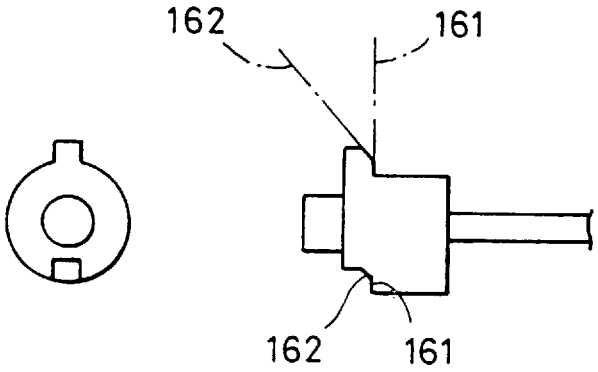
FIGS. 43(*a*) and 43(*b*) are diagrams showing the other shapes of the projections and recesses of the bin rollers.
Figure 43B:
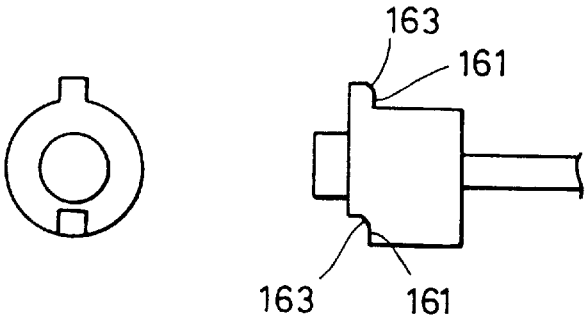

Although the foregoing embodiment according to the present invention has the structure such that the substantially −45 degrees projections and recesses on the outer surface of the bin roller 44*a*, the projection and the recess may be formed to comprise a substantially right-angle portion 161 and an inclined portion 162, as shown in FIGS. 43(*a*). As a matter of course, a projection and a recess having the substantially right-angle portion 161 and an rounded portion 163 may be employed to obtain a similar effect.

The lowermost bin roller 441 is brought into contact with the lower guide roller 46*a* supported by the erected portion 30*a* of the bin frame 30, while the uppermost bin roller 44*a* is brought into contact with the upper guide roller 47*a* supported by the erected portion 30*a* of the bin frame 30. Thus, each bin tray B is supported by the bin unit 17 in such a manner that the bin intervals are the same as the diameter of the bin roller 44*a*.

Thus, the upper guide roller 47*a* and the lower guide roller 46*a* are introduced into the guide rail 16 so that the bin unit 17 is able to move vertically along the guide rail 16. Furthermore, trunnions 46*b* and 47*b* each having a diameter smaller than that of each guide rollers 46*a* and 47*a* are rotatively disposed on the outsides of the guide rollers 46*a* and 47*a*. The trunnions 46*b* and 47*b* are guided by a lead cam 51 to enable the bin unit 17 to be moved vertically.

By making the diameter of the trunnion 44*b* (and trunnions 46*b* and 47*b*) to be smaller than the diameter of the bin roller 44*a* (and guide rollers 46*a* and 47*a*), when the lead cam 51 is used to vertically move each bin tray B maintained at predetermined intervals, that are the same as the diameter of the bin roller 44*a*, the operation of scooping the trunnion 44*b* by a spiral cam surface of the lead cam 51 can be performed smoothly (or easily introduced). That is, the vertical movement of the bin tray B by the lead cam can be performed smoothly.

At positions of the front and rear side plates 12 that faces the lower discharge roller pair 22, there are disposed cam shaft holders 48 (see FIG. 2), as shown in FIGS. 2 and 3. Between the cam shaft holder 48 and the base 13, there is rotatively disposed each lead cam shaft 50 through a bearing 49 that bears the thrust lead. Above the lead cam shafts 50, there are disposed lead cams 51 each having a spiral cam surface, while a sprocket 52 is secured below the same.

Between the sprocket 52 and a shift motor 53, a chain 54 is arranged so that the lead cam 51 is rotated forwards or rearwards by the shift motor 53 that is selectively rotated forwards or rearwards.

The lead cam 51 is so disposed as to face the lower discharge roller pair 22 disposed in the substantially central portion of the sorter body 15. The lead cam 51 places, on the spiral cam surface thereof, the trunnion 44*b* of each bin tray B, that is moved to a position to oppose the lower discharge roller pair 22, to guide the trunnion 44*b*. Thus, the bin roller 44*a* disposed coaxial with the trunnion 44*b* is moved vertically along the guide rail 16 (see FIGS. 13 and 14). For example as shown in FIG. 13, on rotation of the lead cam 51 in a direction indicated by an arrow A moves the trunnion 44*b*23 to an intermediate position of the lead cam 51 (the position 44*b*22). A further rotation moves the same to a position (position 44*b*21) that passes the lead cam 51. Between the bin tray B2, that has received the sheet from the lower discharge roller pair 22 at a position that faces the lower discharge roller pair 22 and the bin trays B1 and B3 disposed above and below the bin tray B2, opening portions X1 and X2, each of which is wider than the interval of the other bin trays B, are formed.

(Paper Retaining Means)

After the sheet has been discharged onto the bin tray B2 that has the opening X1 the bin try is usually moved upwards or downwards. In a case where the bin tray is moved upwards, the bin tray B2 is moved upwards to the position of the bin tray B1 shown in FIG. 13 so that a narrow opening X3 is formed. In a case where the bin tray is moved downwards, the bin tray B2 is moved downwards to the positions B3 and B4. When the bin tray has been moved downwards to the position B4, the bin tray forms a narrow opening X4. If a sheet is discharged in such a manner that the end is projected upwards, this sheet interrupts the discharge of the next sheet. Therefore, sheets cannot accurately be discharged and stacked. If the in tray once forms the narrow opening X3 and X4, the projecting end of the sheet is pressed. Thus, the sheet does not interrupt the sheet to be discharged next. The bin trays B1, B2, . . . , Bn when the bin trays whose moving direction is switched, that is, when the bin trays B1, B2, B3, . . . , Bn are used, temporarily form wide opening portions. Thus, the sheet S is undesirably discharged before a narrow opening is formed after the sheet has been discharged.

Accordingly, the present invention comprises a paper retaining means 160 for pressing the sheet on the bin tray in the opening X1 and X2. Thus, even if the direction, in which the bin tray is moved, is changed, the end of the sheet can be held.

In a so-called group mode, in which a plurality of sheets are continuously discharged on to one bin tray, the opening in the bin tray is not narrowed and therefore the next sheet can be discharged. Therefore, the paper retaining means 160 is operated whether the sheet is discharged so as to hold the end of the sheet.

In a case where a sorter is connected to an image processing apparatus in which is sheet is curled considerably, if the end of the sheet is temporarily held by the narrow opening, the end of the sheet is sometimes moved upwards due to vibrations occurring when the bin tray is moved. Accordingly, the present invention has a structure such that, if a sheet, that is curled considerably, is used, the bin tray is moved to operate the paper retaining means 160 before the next sheet is discharged so as to hold the end of the sheet.

As for the sheet in the opening X1 (between the bin trays B1 and B2) of the bin tray B2 and the sheet in the opening X2 (between the bin trays B2 and B3) of the bin tray B3, if the end of the sheet is warped and moved upwards after the sheet has been discharged, the upper and lower jaws of the stapler 56, that is introduced into the openings X1 and X2, undesirably outwards pushes the sheets on the bin trays B2 and B3. In this embodiment, the paper retaining means 160 holds the end of the sheet between the stapler 56 is introduced into the openings X1 and X2.

Figure 16:
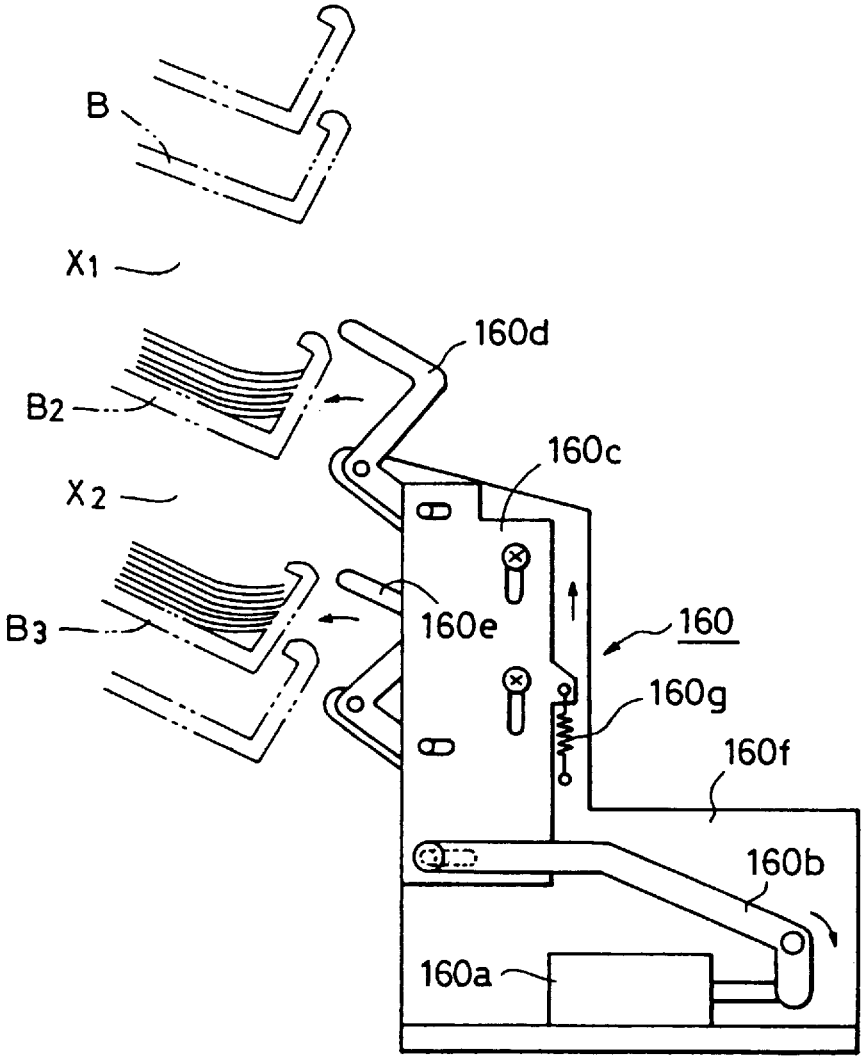
FIG. 16 is a diagram showing the structure of a sheet retaining mechanism.

The paper retaining means 160, as shown in FIG. 16, comprises a solenoid 160*a*, an arm 160*b* that is rotated when the solenoid 160*a* is turned on/off, a sliding member 160*c* that is moved vertically when the arm 160*b* is rotated, an upper retaining member 160*d* and a lower retaining member 160*e* that are rotated when the sliding member 160*c* is moved vertically.

Referring to FIG. 16, reference numeral 160*f* represents a support frame that has a bottom to which the solenoid 160*a* is secured and which rotatively supports the arm 160*b*. Furthermore, the support frame 160*f* has, in the side portion thereof, the retaining members 160*d* and 160*e* that are rotatively supported; and the sliding member 160*c* that is slidably supported by a screw. A portion of the support frame 160*f* and a portion of the sliding member 160*c* are connected to each other by a spring 160*g* so that the sliding member 160*c* is pulled downwards.

Figure 17:
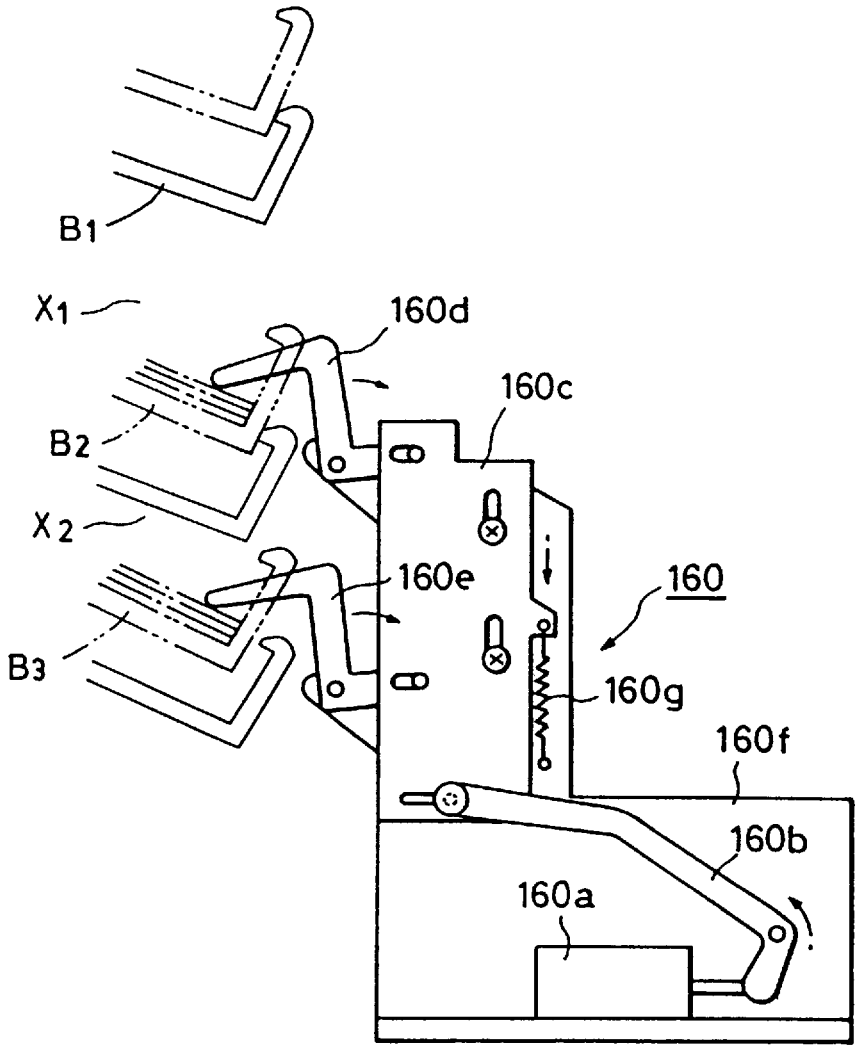
FIG. 17 is a diagram showing the structure of the sheet retaining mechanism.

In the paper retaining means 160, when the solenoid 160*a* is turned on, the sliding member 160*c* in the state shown by bin trays depicted with the dashed and dotted lines in FIG. 17 is moved upwards against the force of the spring 160*g* optical system that the retaining members 160*d* and 160*e* are rotated to the retaining positions. Thus, as shown in FIG. 16, the ends of the sheet bundles on the bin trays B2 and B3 are held. If the solenoid 160*a* is turned off, the state shown in FIG. 16 is brought to a state in which the restoring force of the spring 160*g* downwards moves the sliding member 160*c* so that the retaining members 160*d* and 160*e* are rotated to the relief positions. Thus, as shown by the bin trays depicted with solid lines in FIG. 17, holding of the end of the sheet bundles on the bin trays B2 and B3 is suspended.

Since the paper retaining means 160 holds the sheets in the openings X1 and X2 on the bin trays B2 and B3, sheet jamming occurring due to the end of the sheet mode upwards on the bin tray, and undesirable outward pushing of the sheets on the bin trays B2 and B3 by the upper and lower jaws of the stapler 56, that is introduced into the openings X1 and X2, can be prevented so that the sheet discharge conveyance operation and the stapling operation are performed smoothly.

Figure 20:
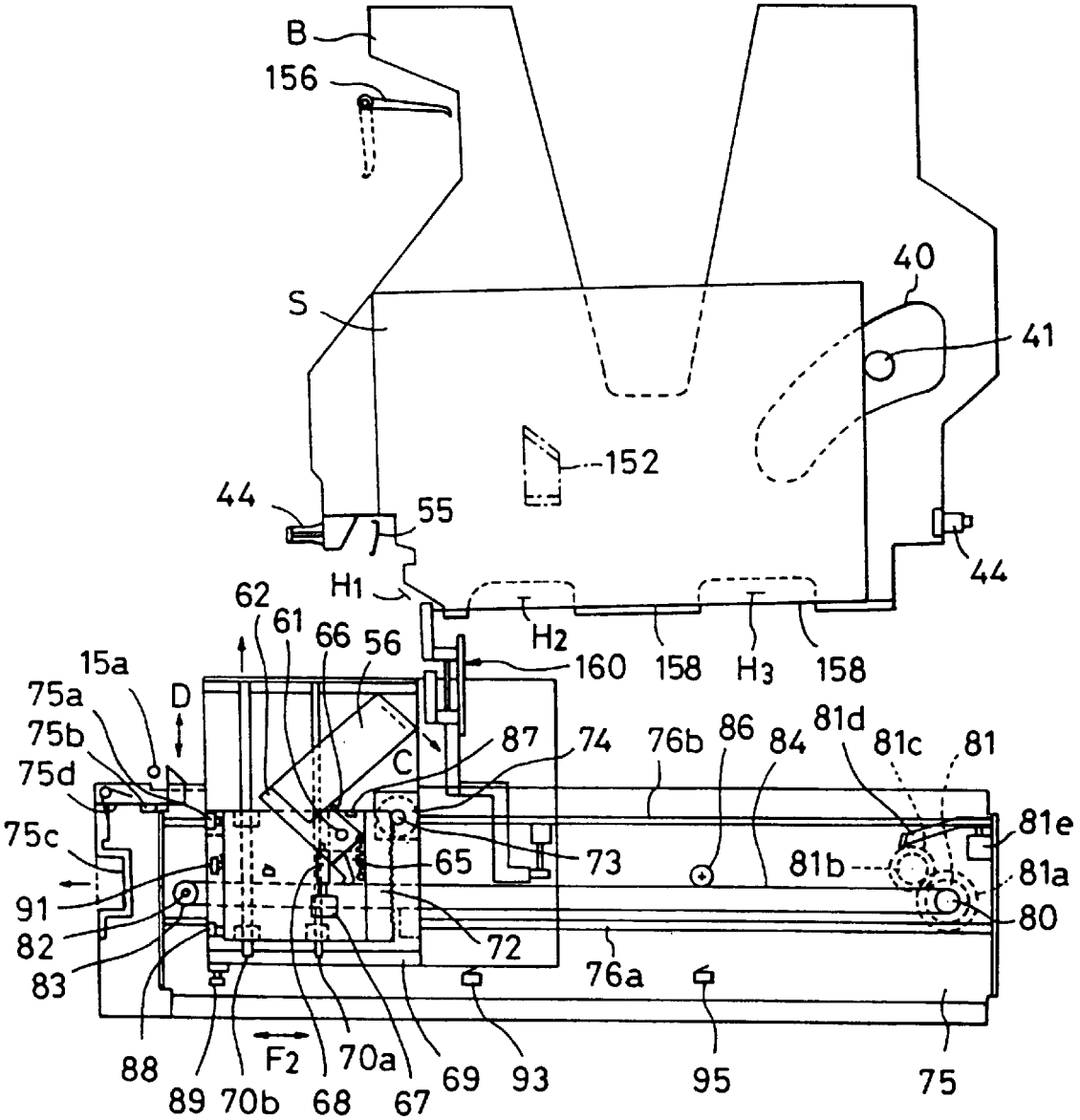
FIG. 20 is a plan view showing the stapler portion and the bin tray portion.

The paper retaining means 160 having the foregoing structure is disposed adjacent to the stapler 56 so as to be moved in the direction of the width of the sheet (in a direction perpendicular to the sheet discharge direction) together with the stapler 56 (see FIG. 20). As a result, the end of the sheet is always held at a position near the stabling position. Therefore, the effect of outwards pushing the sheet by the stapler 56 can be further improved.

In this embodiment, the paper retaining means is used to improve the conveying and stacking characteristics and to prevent outward pushing by the stapler 56. Individual paper retaining means may be provided for the respectively purposes.

(Stapler)

The sorter body 15 has an electric stapler 56 disposed to face the bin B that opposes the lower discharge roller pair 22 so as to bind the sheets accommodated in the bin B2. A stapler moving mechanism, to be described later, performs one-front-portion binding (binding position: H1) of sheets S1 and S2 discharged onto the bins, two-portion binding of sheet S1 (binding positions: H2 and H3) and one-inner-portion binding of sheet S2 (binding position: H3).

At the positions in each bin tray B at which stapling is performed, cut portions 57, 58 and 59 to prevent interference with the stapler 56 are formed.

Figure 18:
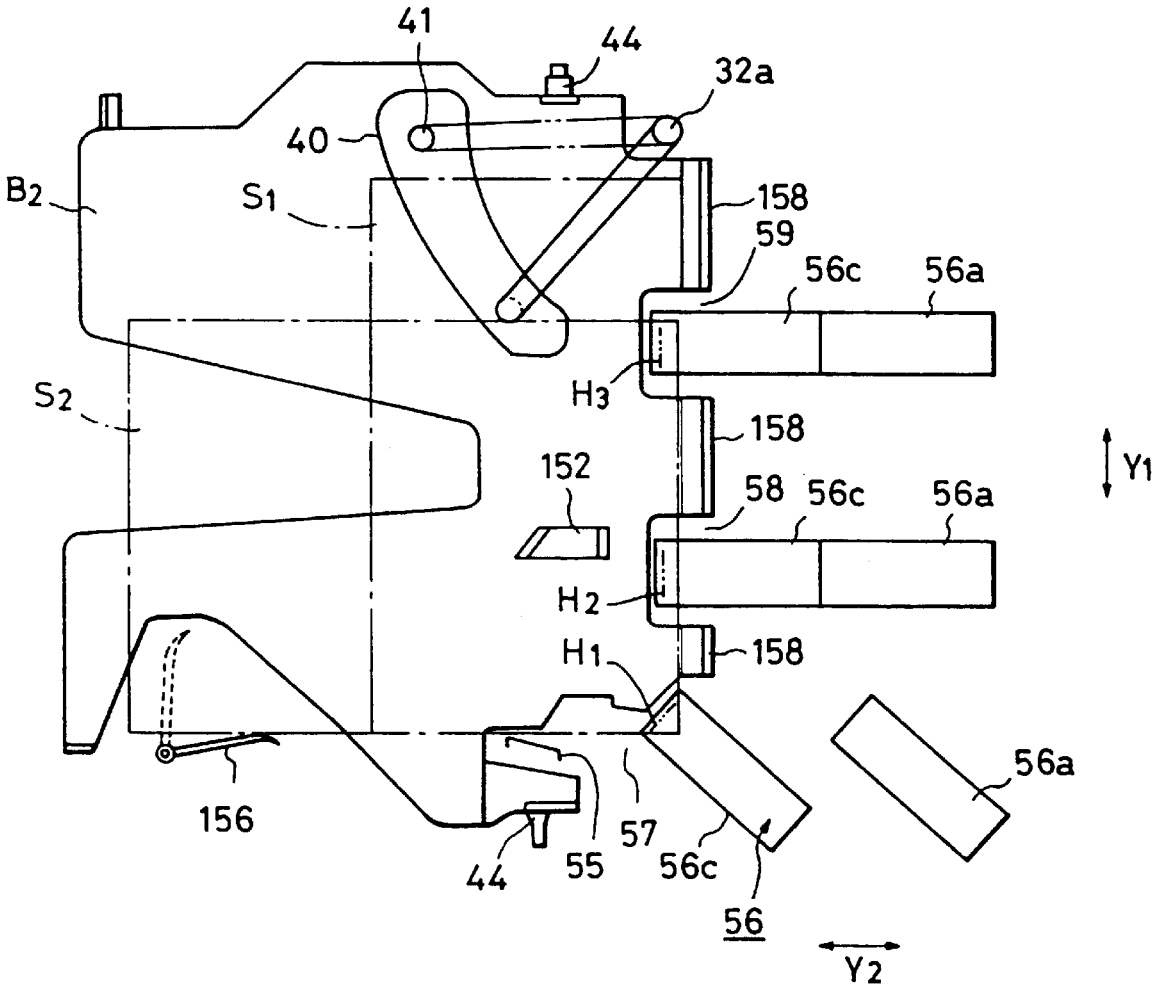
FIG. 18 is a plan view showing a bin tray portion of the sheet processing apparatus.

The stapler 56 is also to move in directions indicated by arrows Y1 and Y2 shown in FIG. 18 and slides at the respective positions (56*a*/56*c*) to perform stapling.

(Stapler Apparatus)

Figure 19:
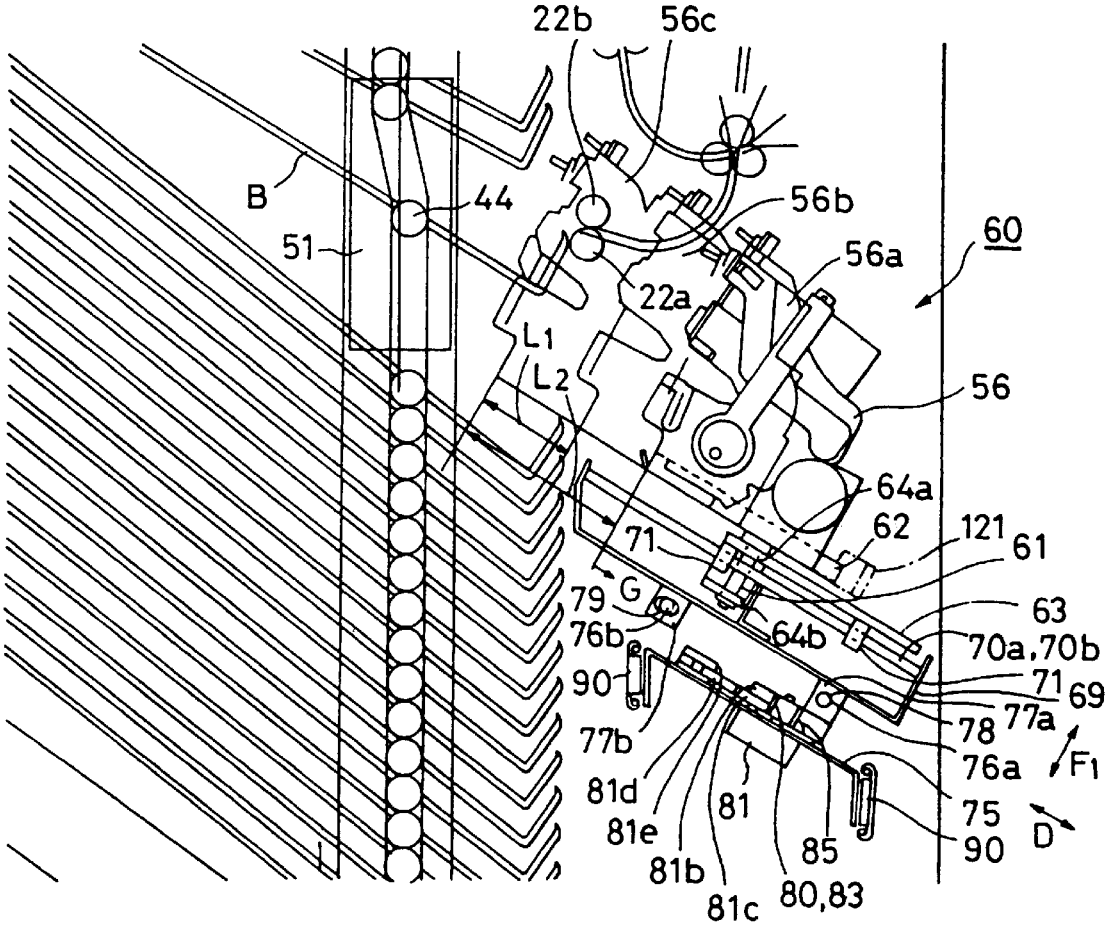
FIG. 19 is a vertical side view of a stapler portion of the sheet processing apparatus.

A stapler apparatus 60 will now be described with reference to FIGS. 19 and 20. The direction of the stapler 56 shown in FIG. 19 shows a state where the binding positions H2 and H3 shown in FIG. 18 are stapled.

The stapler 56 is secured to a first support member 62 having a support shaft 62 secured thereto. A second support member 63 rotatively supports the support shaft 61 of the first support member 62 by holes in the two support portions 64*a* and 64*b*.

A spring member 65 is disposed at an end of the first support member 62, while another end of the same is secured to the second support member 63. Thus, the first support member 62 is urged on the second support member 63 around the support shaft 61 in a direction indicated by an arrow C and it is located by a stopper 66.

On a portion opposing the spring member 65 and the support shaft 61, a link 68 connected to a solenoid 67 secured to the second support member 63 is connected.

In a lower portion of the second support member 63, a guide member 71, that is engaged in a swinging manner to two rails 70*a* and 70*b* and that movably supports the second support member 63 in the direction indicated by an arrow D.

The support holes in the guide member 71 are formed such that the hole to be engaged to either rail (70*a* or 70*b*) is formed into a circular hole and the hole to be engaged to the other rail is formed into an elongated round hole so that shakiness of the second support member 63 including the stapler 56 in directions indicated by arrows F1 and F2 is prevented.

The second support member 63 has a rack gear 72, while the third support member 69 has a motor 74 secured to thereto, the motor 74 having a pinion gear 73 to be engaged to the rack gear 72.

When the motor is rotated, the second support member 63 is moved in a direction indicated by an arrow D while being guided by the rails 70*a* and 70*b*.

Guide members 77*a* and 77*b* that are engaged to two rails 76*a* and 76*b* provided for a fourth support member 75 and that movably supports the third support member 69 in a direction indicated by an arrow F2 are disposed below the third support member 69. Hole to be engaged to the rails 76*a* and 76*b* of the guide members 77*a* and 77*b* are formed such that either hole is formed into a circular hole 78 and the other hole is formed into an elongated round hole 79 so as to prevent shakiness of the third support member 69 in directions indicated by arrows F1 and D.

A motor 81 for rotating a belt pulley 80 and an idler pulley that rotates around a shaft 82 are secured to the fourth support member 75. A belt 84 is arranged between the two pulleys 80 and 83, a portion of the belt 84 being secured to a secured portion 85 that is a potion of the third support member 69. Reference numeral 86 represents a bent tensioner. When the motor 81 is rotated, the belt is rotated so that the third support member 69 is moved in a direction indicated by an arrow F2 while being guided by the rails 76*a* and 76*b*.

To detect waiting positions for the first, second, and the third support members 62, 63 and 69, detection means 87, 88 and 89 each comprising a microswitch are provided (see FIG. 20).

The fourth support member 75 is supported by an acculied rail 90 and the like so as to be made detachable with respect to the body of the apparatus when maintenance is performed, the fourth support member 75 being usually located and mounted by a locking mechanism, to be described later, in the sorter body 15.

(Locking Mechanism for Stapler)

The fourth support member 75 is drawn toward (to the left portion of FIG. 20) the operator by the operator when stable cartridge to be mounted on the electric stapler 56 or when jamming of a staple is overcome. If the fourth support member 75 can be drawn in a state where the electric stapler 56 is located at an arbitrary position, the electric stapler 56 and the stopper 158 of the bin interfere with each other and are damaged. Accordingly, a front locking mechanism is provided to prevent drawing of the fourth support member 75 only in a case where the third support member 69 having the stapler 56 mounted thereon is located at the home position.

Figure 44A:
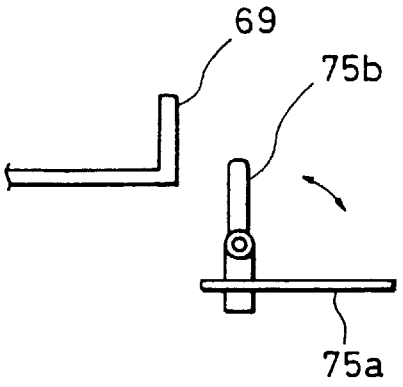
FIGS. 44(*a*) and 44(*b*) are schematic views showing a front locking mechanism.
Figure 44B:
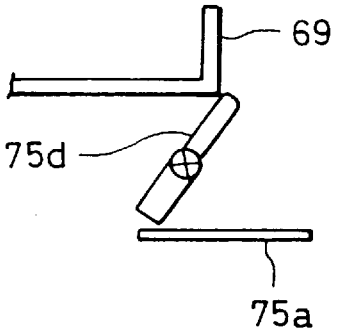

The front locking mechanism will now be described. Referring to FIG. 20, a lock pin 15*a* projects over the sorter body 15. A locking member 75*a* that can be engaged to the locking pin 15*a* is rotatively attached to the fourth support member 75. The locking member 75*a* is, by a stopper 75*b*, usually secured to a position, to which it is engaged to the locking pin 15*a*. The stopper 75*b* is structured such that the engagement is suspended when the third support member 69 is moved to the home position. Referring to FIGS. 44(*a*) and (*b*) that are views when viewed in a direction indicated by an arrow G shown in FIG. 19, the stopper 75*b* is secured to the fourth support member 75 in such a manner that the stopper 75*b* can be swung in the direction indicated by the arrow. If the third support member 69 is not in contact, the stopper 75*b* is located to engage the locking member 75*a* as shown in FIG. 44(*a*). If the third support member 69 has been moved to the home position and brought into contact with the stopper 75*b*, the engagement of the locking member 75*a* is suspended. A handle 75*c* is coaxially provided with the rotational center of the locking member 75*a*. A twisted coil spring 75*d* is secured to the handle 75*c* and the stopper 75*b*. Therefore, when the handle 75*c* is pulled in the direction indicated by the dashed-line arrow, the engagement between the stopper 75*b* and the locking pin 15*a* as, through the twisted coil spring 75*d*, suspended.

Therefore, if the third support member 69 is not located at the home position, pulling of the handle 75*c* cannot rotate the locking member 75*a* because of the stopper 75*b*. If the handle 75*c* is pulled to suspend the engagement of the stopper 75*b* when the third support member 69 has been moved to the home position, the locking member 75*a* is rotated to suspend the engagement with the locking pin 15*a*. Thus, the fourth support member 75 can be drawn to a position in front of the sorter body 15. When the fourth support member 75 is mounted on the sorter body 15, the handle 75*c* is mounted while being gripped and then the handle 75*c* is released, the elastic force of the twisted coil spring 75*d* causes the locking member 75*a* to be engaged to the locking pin 15*a*. When the fourth support member 75 is moved, the stopper 75*b* engages and locks the locking member 75*a*. Therefore, undesirable drawing of the fourth support member 75 by an operator regardless of the position of the stapler 56. Therefore, the safety and the reliability can be improved.

When the fourth support member 75 is mounted on the sorter body 15, the weights of the electric stapler 56 mounted on the fourth support member 75, the first, second and the third support members 62, 63 and 69 for supporting the electric stapler 56 cause the fourth support member 75 to be brought into contact with the inner end of the sorter body 15, thus causing the foregoing elements to be moved toward inside of the apparatus due to inertia. Therefore, there arise a risk that the electric stapler 56, the leading end passage 26 and the stopper 158 interfere with each other and they are broken. Accordingly, an inner locking mechanism for locking the moving mechanism of the third support member 69 is provided.

The inner locking mechanism will now be described. Referring to FIG. 20, a small-diameter gear 81*b* of a two-speed gear is engaged to a motor gear 81*a* attached to the motor 81. A ratchet 81*d* is attached to a large-diameter gear 81*c* in such a manner that the ratchet 81*d* is capable of engaging to the same. The ratchet 81*d* has a structure that it can be engaged to and separated from the large-diameter gear 81*c* by a solenoid 81*e*. The solenoid 81*e* is usually turned off, and the ratchet 81*d* and the large-diameter gear 81*c* are, in the foregoing state, engaged to each other. Only when the motor 81 is turned on, the solenoid 81*e* is turned on so that the engagement is suspended.

As a result, the belt pulley 80 is not rotated. Therefore, even if the fourth support member 75 is drawn from the sorter body 15 or it is mounted on the sorter body 15, the third support member 69 is not moved. In particular, undesirable inward movement of the third support member 69 having the electric stapler 56 mounted due to inertia when the fourth support member 75 is mounted can be prevented, the undesirable inward movement taking place due to inertia. Therefore, the safety and reliability can be improved.

Figure 21:
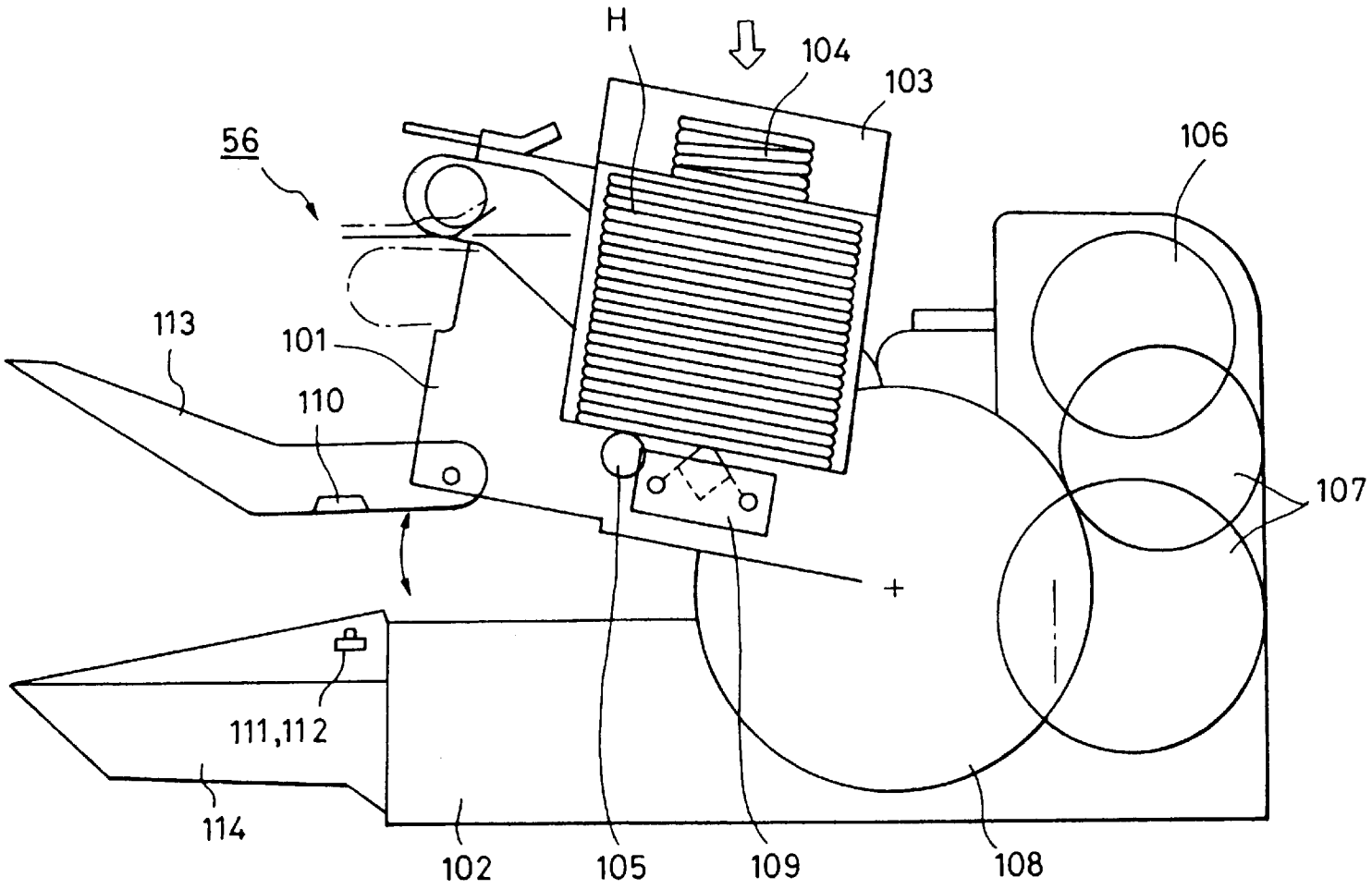
FIG. 21 is a side view showing the structure of the stapler portion.

The specific structure and basic operation of the stapler 56 will now be described. Referring to FIG. 21, the stapler 56 is formed into an alligator-shape and comprises a forming portion 101 in the upper portion thereof; and a staple table 102 in the lower portion thereof. A staple cartridge 103 is detachably mounted in the stapler 56, the staple cartridge 103 including about 5,000 staples H connected in the form of a plate. The plate-like staples H loaded into the staple cartridge 103 are downwards urged by a spring 104 disposed to the uppermost portion of the staple cartridge 103 so that a feeding roller 105 disposed in the lowermost portion is given conveyance force. Each of the staples H fed by the feeding roller 105 is formed into a U-shape facing side when the forming portion 101 is swung.

When a staple motor 106 is rotated, the forming portion 101 causes an eccentric cam gear 107 to be rotated. Thus, an eccentric cam 108 integrally formed with the eccentric cam gear 105 swings the forming portion 101 toward the staple table 102 as indicated by an arrow so that the forming portion 101 performs a clinching operation (a stapling operation).

A state where the staple cartridge 103 has no staple H can be detected by a reflection-type sensor 109 disposed in the lower portion of the staple cartridge 103. The timing, at which the final staple H is detected, is arranged in such a manner that a state where the number of the staples is as expressed by: number (n) of the bin trays B×the number (2) of portions to be stapled, that is, a state where 2n staples exist, can be detected. As a result, if the staple is wanted during the stapling operation, the subject job can be completed.

Figure 22:
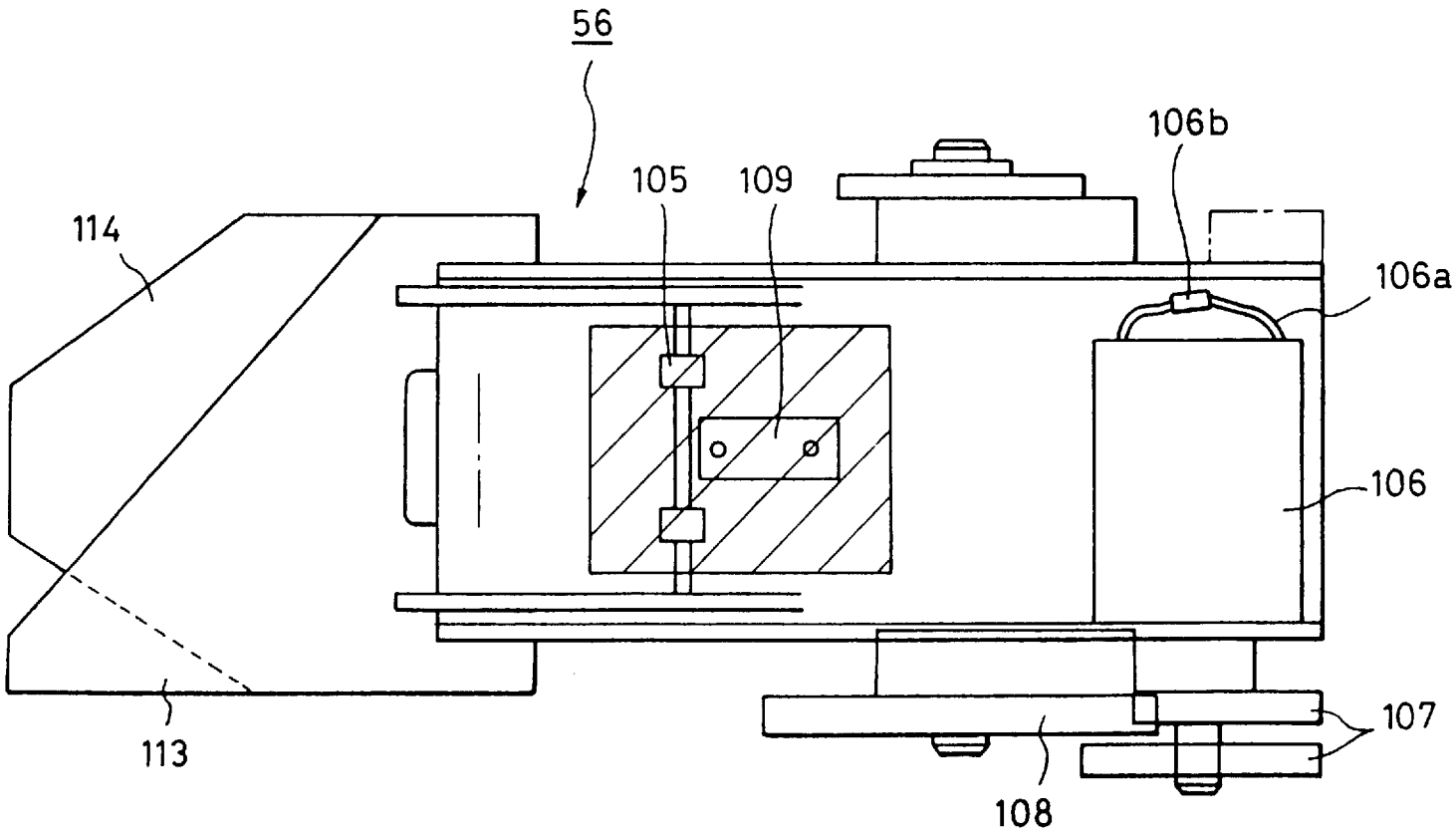
FIG. 22 is a plan view showing the structure of the stapler portion.

Detection of jamming of staples H (clogging of a staple) to be fed by the staple cartridge 103 will now be described with reference to FIGS. 22 and 23. Referring to FIG. 22, a cord 106*a* for supplying an operation electric current is connected to the staple motor 106, the cord 106*a* having an electric-current sensor (an abnormality detection means) 106*b* serving as a load detection means for detecting the flowing electric current.

Figure 23:
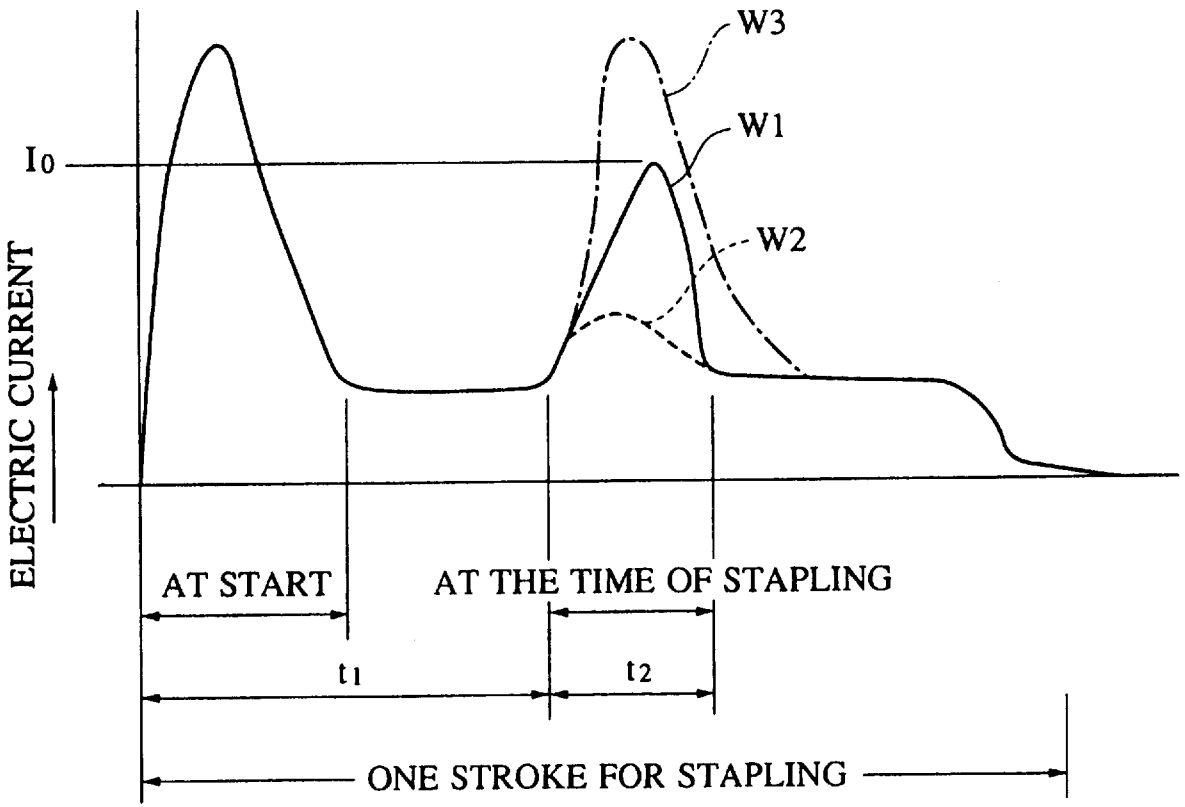
FIG. 23 is a graph of waveform showing electric current that flows in a staple motor during one stapling process of the stapler.
Figure 24:
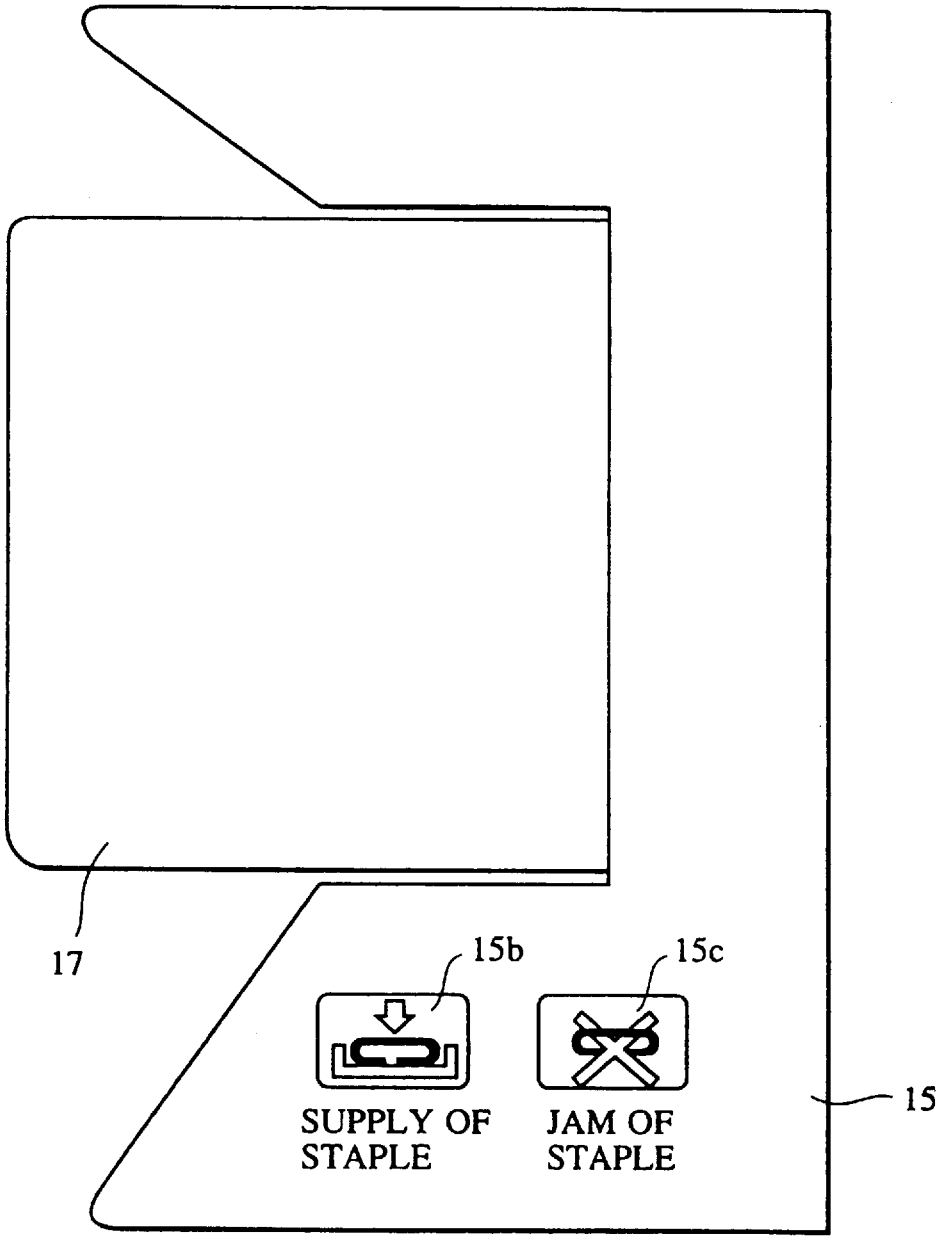
FIG. 24 is a plan view showing a staple-less display portion showing a staple-less state and a staple-jam display portion showing a staple-jam state of the stapler.

FIG. 23 shows the waveform of an electric current that flows in the staple motor 106 during one stapling process detected by the electric current sensor 106*b*.

Referring to FIG. 23, W1 indicates the waveform realized when the staple H has been usually ejected to pass through the sheet bundle S and the staple has been bent and the sheet bundle S has been fixed; and W2 indicates the waveform realized when idle stapling (although the stapler 56 has been operated, no staple H has been ejected) has been performed. Since no load acts when the staple H penetrates the sheet bundle S and when the staple H is bent, the level of the electric current is lowered. W3 indicates the waveform when a defective stapling has been performed or a staple jamming has taken place. In the foregoing case, an excess load is usually generated and the level of the electric current is raised extremely.

Therefore, when the level of the electric current is near I0 (the initial value), a discrimination can be made that the stapling operation is being performed normally. If I>I0+C (C represents scattering), a discrimination can be performed that jamming of a staple, defective stapling, or a mechanical problem of the stapler 56 has occurred. If I<I0−C, a discrimination can be made that idle stapling has been performed.

The staple-less state or the staple-jam state of the stapler 56 are respectively displayed on a staple-less display portion (abnormal display means) 15*b* and a staple-jam display portion (abnormal display means) 15*c* formed in the portion of the sorter body 15 adjacent to an operator. If the stapler 56 has encountered the staple-less state, the staple-less display portion 15*b* is flickered. If the stapler 56 has encountered the staple-jam, the staple-jam display portion 15*c* flickers. Thus, the foregoing problems are notified to the operator.

(Paper Detection Means Provided for Stapler)

Figure 25:
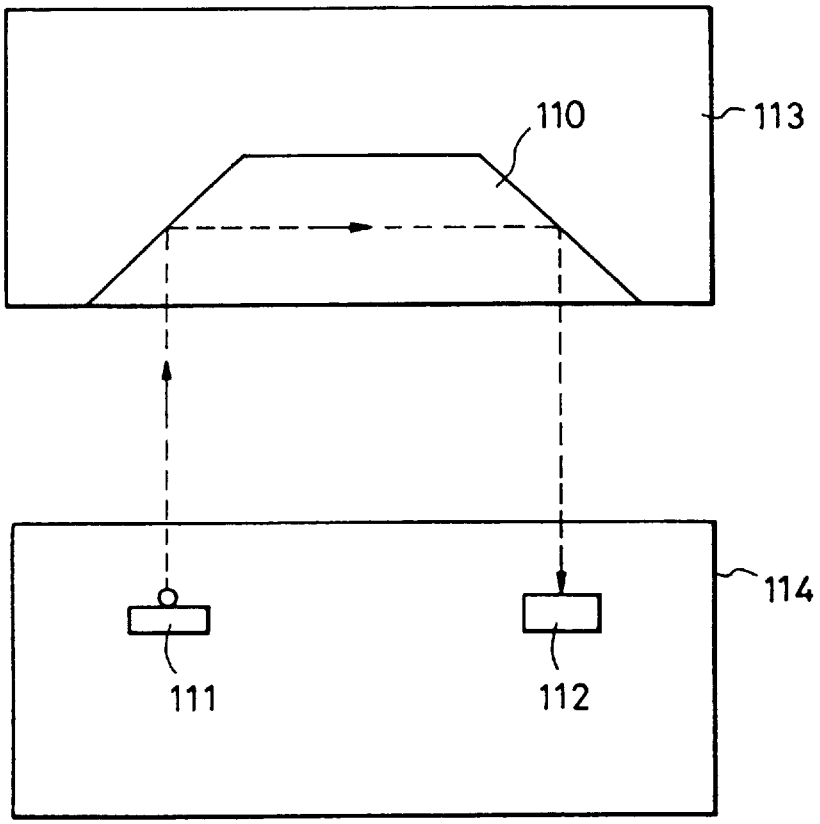
FIG. 25 is a vertical cross sectional view showing a guide member of the stapler.

As shown in FIGS. 21 and 25, the forming portion 101 and the staple table 102 respectively comprise an upper guide member 113 and a lower guide member 114. The upper guide member 113 is provided with a prism 110, while the lower guide member 114 is provided with a light emitting device 111 comprising an LED or the like; and a light receiving device 112 comprising a phototransistor or the like. The light emitting device 111 and the light receiving device 112 detect whether or not a sheet S exists between the forming portion 101 of the stapler 56 and the staple table 102 so as to prevent idle stapling that is performed by the stapler 56. If the stapler 56 performs the idle stapling operation, the staple H is used wastefully and the idly ejected staple H is dispersed in the apparatus. Thus, the foregoing problems can be prevented.

As shown in FIG. 25, the detection by means of the sheet detection sensor is performed in such a manner that light emitted by the light emitting device 111 is reflected by the prime 110 so as to be detected by the light receiving device 112. Thus, light emitted by the light emitting device 111 is shielded by the sheet S so that whether or not a sheet S exists is detected. If the sheet S has been detected by the sheet detection sensor provided for the upper and lower guide members 113 and 114, the sheet S can reliably by stapled due to the movement of the stapler 56. Thus, idle stapling can be prevented.

As a result of the foregoing structure, a sheet S is detected when the stapling operation is performed within the width of the stapler 56. Thus, a space required to provide a detection means for detecting sheet S individually from the stapler 56 can be eliminated. The width of a cut portion required to be formed in the bin tray B can be minimized so that deterioration in the alignment characteristic of the sheet S and the strength of the bin tray B are prevented. Even if the reverse side (facing the light emitting device and the light receiving device) is black, the existence of the sheet can reliably be detected.

Referring to FIG. 21, the upper guide member 113 and the lower guide member 114 are respectively attached to the forming portion 101 and the staple table 102. The upper guide member 113 and the lower guide member 114 act in such a manner that a tapered surface 114*a* of the lower guide member 114 is introduced to a portion below the bin tray B when the stapler 56 is moved to a stapling position 56*c* to staple the sheets S so as to move the staple 56 on to the staple table 102. As a result, the position of stapling the sheet S is determined. The upper guide member 113 guides the stapler 56 into the stapling position 56*c* between the forming portion 101 and the staple table 102 in such a manner that the end of the contact of sheets stacked on the bin tray B with the guide surface 113*a,* which causes the stacking characteristic and the aligning characteristic to deteriorate, is prevented.

Figure 26:
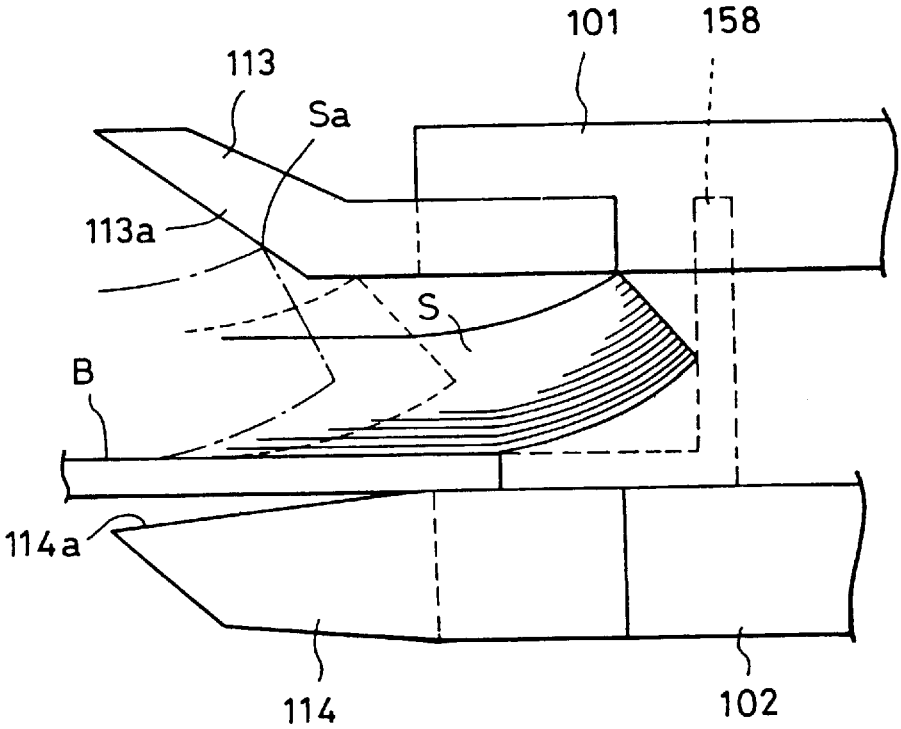
FIG. 26 is an explanatory view showing an operation of the stapler to introduce into the bin tray.

The guiding operation to be performed by the upper and lower guide members 113 and 114 will now be described. Referring to FIG. 26, when the stapler 56 is moved so the stapling position 56*c,* the upper paper end Sa of the sheet bundle S indicated by an alternate long and one short dash line is downwards restricted along the tapered surface (the guide surface) 113*a* of the upper guide member 113 so as to be guided between the upper guide member 113 and the bin tray B as indicated by a dashed line. Then, the bin tray B is gradually moved upwards by the lower guide member 114, and the stapler 56 is further moved so that the bin tray B is supported by the staple table 102. As a result, the stapling position is determined and the stapling operation by the forming portion 101 is performed.

As a result of the foregoing structure, the stapling operation is performed in such a manner that the sheet bundle S is initially introduced between the stapler 56 and the bin tray B by the tapered surface 113*a* of the upper guide member 113 and the stapling operation can be performed smoothly without deterioration in the sheet stacking characteristic and the aligning characteristic while preventing dislocation of the stapling position. Since the upper guide member 113 holds the end of the sheet and guides the introduction, the stapler 56 can be moved to the stapling position 56*c* in such a manner that the contact to the end of the sheet that causes the stacking characteristic to deteriorate can be prevented. Thus, the end of the sheet can smoothly be introduced.

Figure 27B:
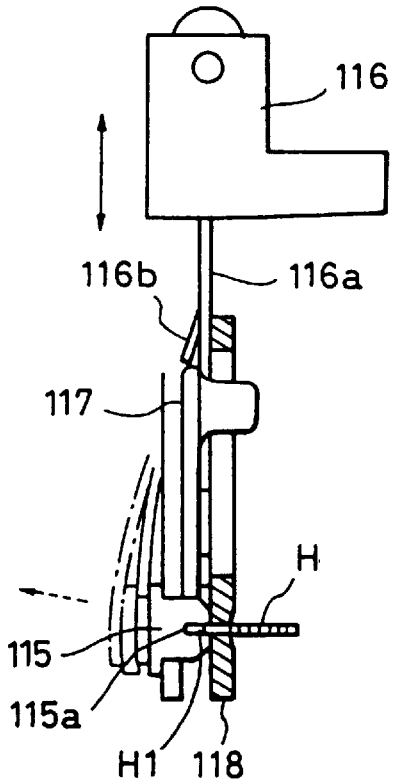
FIGS. 27(*a*) and 27(*b*) are diagrams showing the structure for the stapling operation performed by the forming portion of the stapler.
Figure 27A:
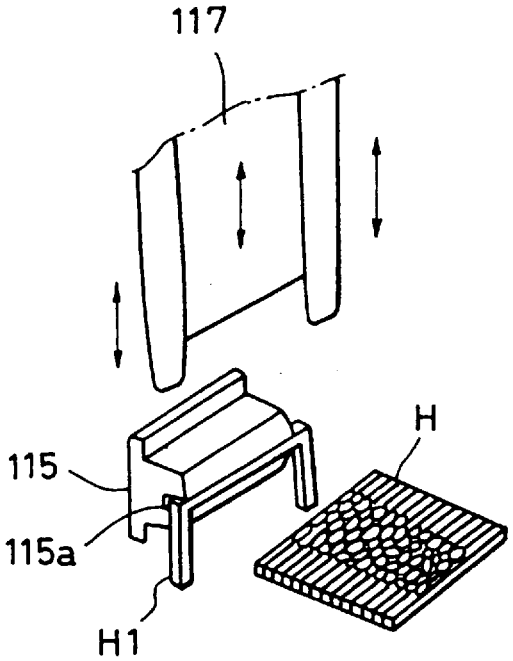

The stapling operation of the stapler 56 will now be described specifically. Referring to FIG. 27, the plate-like staples H accommodated in the staple cartridge 103 are, one by one, fed by the feeding roller 105 to a staple bending block 115. Thus, the leading staple H is held in a holding groove 115*a* of the staple bending block 115. The eccentric cam gear 108 is rotated so that the forming portion 101 is moved downwards to the operation position. As a result, as shown in FIG. 27(*b*), a drive mechanism (not shown) downwards move a driver 116 so that the plunger 116*a* is moved downwards. At this time, a pushing claw 116*b* formed in a portion of the plunger 116*a* pushes the bending block 117 formed into a U-shape acing side to press the upper surface of the staple bending block 115. The staple H held in the holding groove 15*a* of the staple bending block 115 is bent into a U-shape facing side, as shown in FIG. 27(*a*).

The plunger 116*a* is further moved downwards so that the pushing claw 116*b* is separated from the bending block 117 formed into a U-shape facing side. Thus, only the plunger 116*a* is pushed downwards to reach the tapered portion of the staple bending block 115. While pushing aside the staple bending block 115 to a position (in a direction indicated by a dashed-line arrow) indicated by an alternate long and a short dash line, only the leading staple H formed into the U-shape facing side is sheared by a staple shearing member 118 to inject the staple H into the sheet S. Then, the staple H is pushed against the staple table 102 so that the sheet S is stapled. When the further rotation of the eccentric cam gear 108 moves the forming portion 101 to the upper waiting position, the driver 116 is pulled upwards to that the plunger 116*a* is moved upwards to be restored to the waiting position. Thus, one process of the stapling operation is completed.

(Stable Cartridge)

Figure 28:
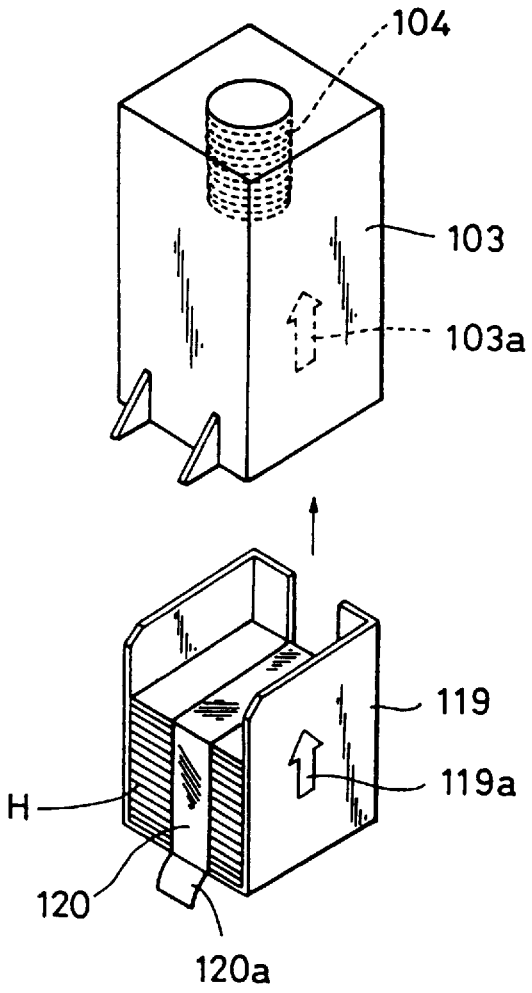
FIG. 28 is a diagram showing a staple cartridge and staples.

The structure of the staple cartridge 103 and a method of loading the staple H to be accommodated in the stable cartridge 103 will now be described. The staple cartridge 103, as shown in FIG. 28, comprises an integrally-formed box-like transparent case having an opened bottom and made of plastic or resin. A spring 104 is attached to the upper surface of the staple cartridge 103 to downwards urge the staple H loaded in the staple cartridge 103. The staple H loaded in the staple cartridge 103 is fastened by a fastening means, such as a clicking member, so that the staple H is not dropped through the opening.

A plurality of the staples H are connected to be formed into a plate-like shape, and a plurality of the plate-like structures are stacked before they are loaded into the staple cartridge 103. Before the staples H are loaded, a plurality of the plate-like structures are stacked and held by a wrapping paper 119 in such a manner that the two sides ends are held in the form of a U-shape facing side, and a tape 120 is wound around the plate-like structures. A handle 120*a* is projected over the tape 120 so that separation is easily performed by pulling the handle 120*a*.

An arrow 103*a* indicating the loading direction for the staple H is formed on one side surface of the staple cartridge 103. The arrow 103*a* can be formed by printing or embossing the case. Also the side surface of the wrapping paper 119 for wrapping the staples H has an arrow 109*a* that indicates the loading direction for the staples H. The reason for this is that, if the staples H are loaded into the staple cartridge 103 inversely in longitudinal direction or the sides, the stapling operation cannot be performed effectively. Thus, the foregoing problems can be prevented.

When a state where no staple H is in the staple cartridge 103 is detected by the reflection-type sensor 109 disposed in the lower portion of the staple cartridge 103, the operator draws the fourth support member 75 from the sorter body 15 as shown in FIG. 20, and upwards removes the staple cartridge 103 mounted on the stapler 56, as shown in FIG. 21. As shown in FIG. 28, the staples H wrapped by the wrapping paper 119 are loaded into the staple cartridge 103 against the force of the spring 104 in such a manner that the arrows 119*a* and 103*a* are made coincide with each other. Then, the handle 120*a* is pulled to peel off the tape 120 that bundles the staples H. Thus, the loading operation is completed. Then, the staple cartridge 103 accommodating the staples H is again mounted on the stapler 56, and the fourth support member 75 is mounted on the sorter body 15. Thus, the operation is completed.

As a result of the foregoing structure, loading is performed such that the arrow 103*a* formed on the side surface of the stable cartridge 103 and the arrow 109*a* formed on the wrapping paper 119 that is warping the staples H are made coincide with each other. Thus, the operator is able to prevent erroneous loading of the staples H inversely in the longitudinal direction or the sides. Thus, sheets S can effectively be stapled.

Figure 29:
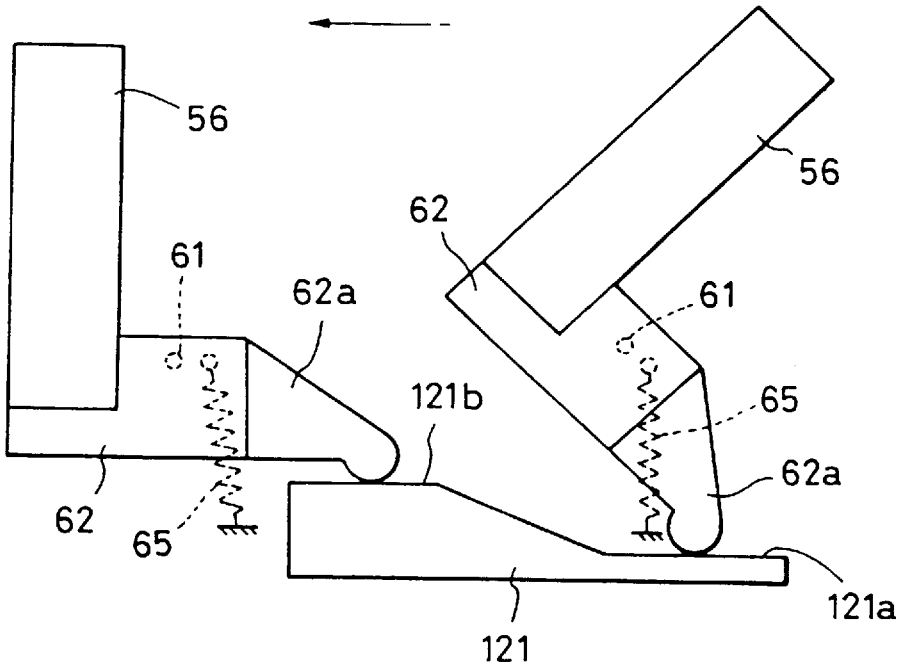
FIG. 29 is a diagram showing a mechanism for rotating a support member having the stapler mounted thereon.

As shown in FIG. 29, the first support member 62 for supporting the stapler 56 has the cam 62*a* formed integrally. The plate cam 121 is secured to the frame (not shown) of the sorter body 15. The stapler 56 is set to a position, at which the first support member 62 is pulled by the spring member 65 to correspond to the one-front-portion binding position, that is, to a position (the home position) at which the leading portion diagonally faces the inner portion of the apparatus.

If the stapler 56 encounters jam of a staple, the handle 75*c* is gripped to draw the fourth support member 75 toward the front portion of the apparatus (the left portion of FIG. 20). Thus, the cam 62*a* is initially brought into contact with a tin portion 121*a* of the plate cam 121. As the stapler 56 moves in a direction indicated by the arrow, the cam 62*a* is brought into a thick portion 121*b* through the inclined cam surface. The first support member 62 is rotated counterclockwise around the support shaft 61 against the elastic force of the spring member 65 so that the clinching portion of the stapler 56 is rotated in a direction toward the front portion. When the fourth support member 75 has been accommodated in an inner portion (in the first portion of FIG. 20), the cam 62*a* is initially in contact with the thick portion 121*b* of the plate cam 121. As the stapler 56 is moved, the first support member 62 is rotated clockwise around the support shaft 61 due to the elastic force of the spring member 65. After the accommodating operation has been completed, it is brought into contact with the thin portion 121*a* and the stapler 56 is returned to the home position.

As a result of the foregoing structure, since the clinching portion of the stapler 56 is located in a position adjacent to the operator when the fourth support member 75 has been drawn, the operator is able to excellently recognize the staple jam state and therefore the operator is able to easily jam overcoming operation. By using the support shaft 61 of the first support member 62 for use in the stapling operation, such as the one-front-portion binding and two-portion binding operations as the rotational shaft for the staple jam overcoming operation, the necessity of providing a rotational shaft or the like for the stapler 56 can be eliminated. Therefore, the jam overcoming operation can be simplified. Since the stapler 56 can be rotated in synchronization with the drawing and accommodating operations of the stapler unit, excellent operationality can be realized, and the staple jam overcoming operation can be completed quickly.

Although this embodiment has the structure such that the first support member 62 is rotated in synchronization with the drawing and accommodating operations of the fourth support member 75, the first support member 62 is not required to be moved in synchronization with the operation of the fourth support member 75. For example, another structure may be employed in which the first support member 62 is eccentrically supported around the support shaft 61; when the stapler 56 is at the home position, the first support member 62 is secured by a securing member, such as a claw, and the foregoing securing state is suspended by a button or the like after the fourth support member 75 has been removed from the body of the apparatus so that the first support member 62 is rotated around the support shaft 61 due to the dead weight to cause the clinching portion of the stapler 56 to face the front portion of the apparatus. A structure may be employed in which the cam formed on the first support member 62 is brought into contact with the frame of the sorter body in the accommodation state so that the first support member 62 is rotated in the reverse direction, and securing to the securing member is again realized at the position at which the stapler 56 is returned to the home position.

The stapler apparatus 60 has the foregoing structure. The image processing apparatus 1 and the sorter 11 respectively provided with control apparatuses (a CPU) 1A and (a CPU) 11A to control the operations and passing (see FIG. 1).

Since this embodiment has the foregoing structure, the sheet S discharged from the image processing apparatus, such as a copying machine, is, through an introduction port 18, guided by the deflector 24 that is displaced to correspond to the non-sort mode (a mode in which sheets are not classified) and the sort mode (a mode in which sheets are classified) so as to be introduced into the first sheet conveyance passage 19 or the second sheet conveyance passage 20.

(Binding Operation)

The binding operations in a plurality of bins B will now be described with reference to flow charts shown in FIGS. 34 to 38.

<One-Front-Portion Binding>

The binding operation in a plurality of bins B is performed such that the binding operation is performed in the bin B to which the sheets have been finally discharged and accommodated (S113) to obtain the most significant effect.

Figure 30:
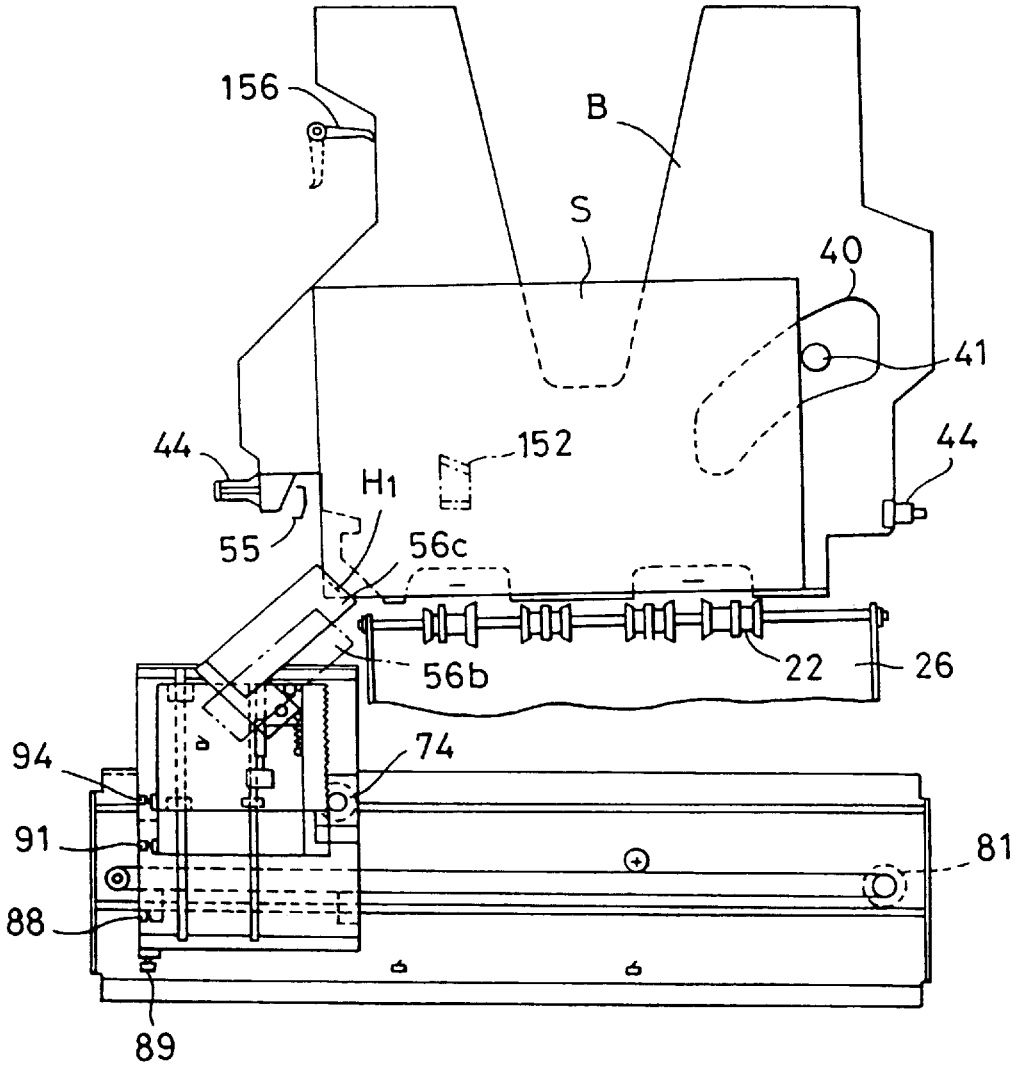
FIG. 30 is a plan view showing the stapler portion and the bin tray portion in a state when the stapling operation is performed in the sheet processing apparatus.
Figures 34, 34A:
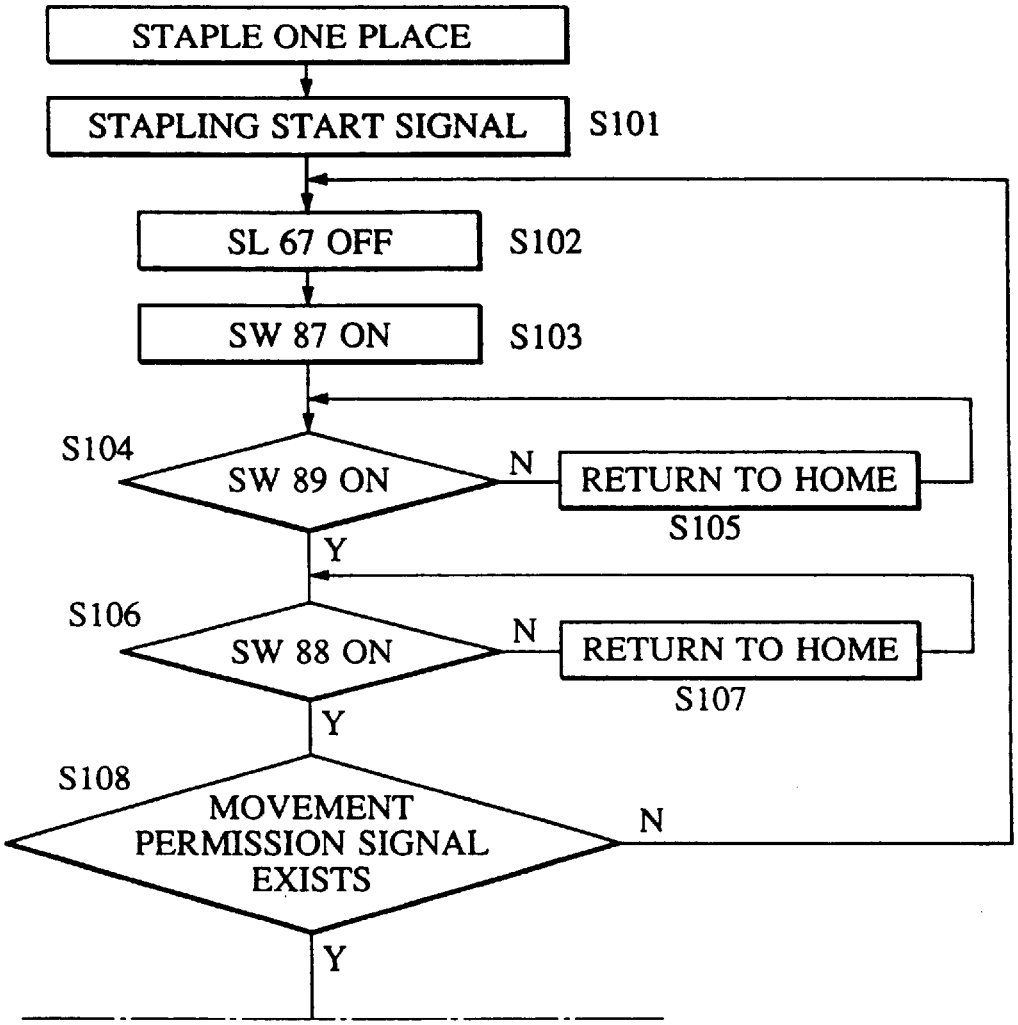
FIG. 34, including
FIGS. 34A and 34B, is a flow chart showing the stapling operation in the sheet processing apparatus.
Figure 34B:
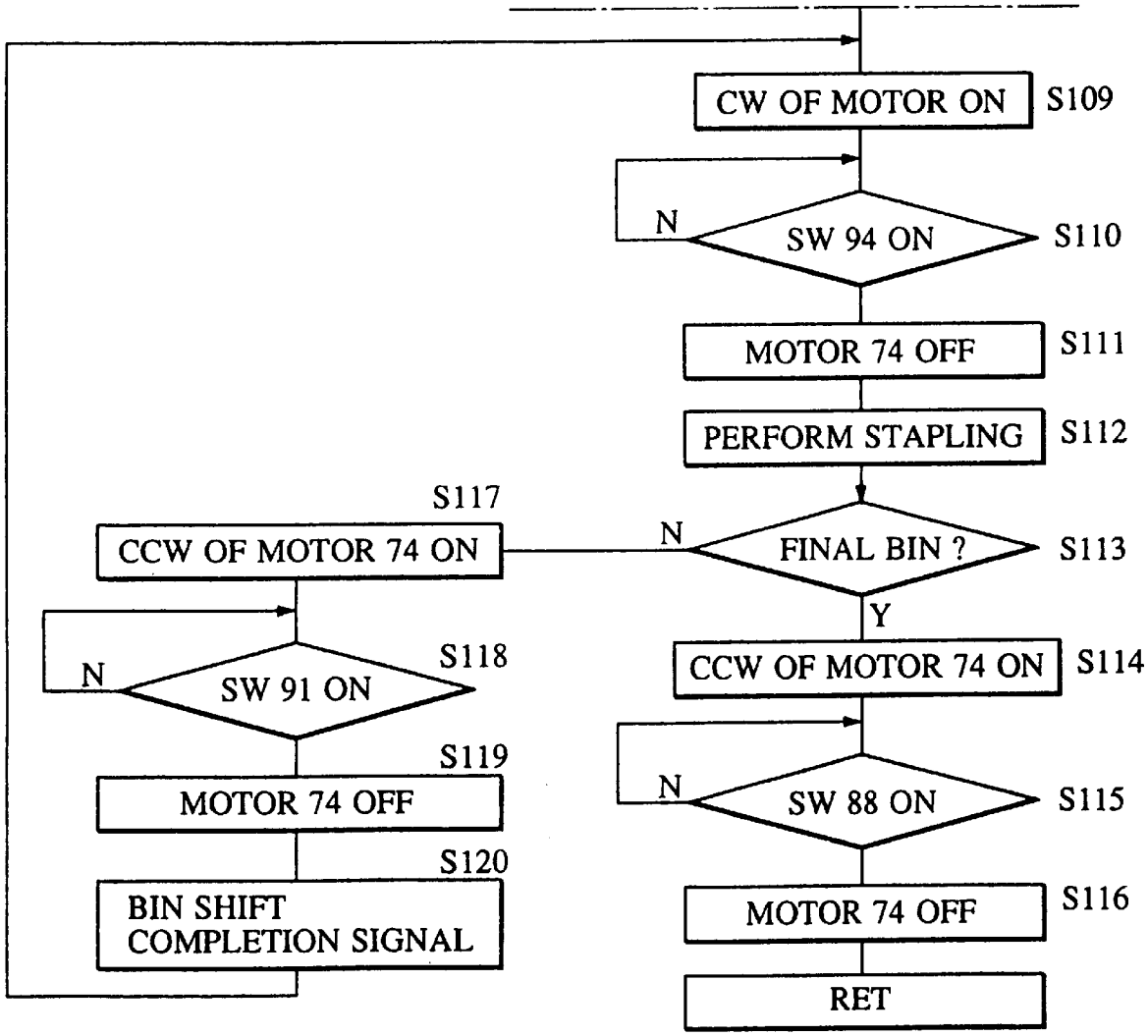

Initially, the operation to be performed in the case where the one-front-portion binding (binding position: H1) operation is performed will now be described. Referring to FIG. 34, the second support member 63 is, as described above, moved together with the stapler 56 on the first support member 62 so that the stapler 56 is moved from the waiting position 56*a* to the stapling position 56*c*. When the operation of stapling the first bin has been completed, the motor 74 is rotated counterclockwise (S117). Then, the stapler 56 is not returned to the position 56*a*, but it is moved to the intermediate waiting position 56*b*, and the rotation of the motor 74 is stopped (S119). The foregoing intermediate waiting position 56*b* is detected by the detection means 91 (S118) (see FIGS. 3 and 30).

In response to a bin-shifting completion signal (S120), sheets in the second bin are subjected to a process such that the stapler 56 is, by the foregoing drive means, moved from the intermediate waiting position 56*b* to the stapling position 56*c*. After the stapling operation has been completed, the stapler 56 is returned to the intermediate waiting position 56*b*. In response to a signal representing the completion of the sequential operations of the stapler 56, a next bin shifting operation is performed, and the operation is repeated. Thus, the stapling operation is automatically completed. After the stapling operation in the final bin has been completed, the second support member 63, first support member 62 and the stapler 56 are returned so that the stapler 56 is returned from the stapling position 56*c* to the waiting position 56*a*.

As a matter of course, the required member of shifting of the bins at the time of performing the automatic stapling operation is repeated by the number of bin shifting times at the time of performing the sorting operation.

The distance L1 of movement of the stapler 56 from the stapling position 56*c* to the intermediate waiting position 56*b* is shorter than distance L2 of movement from the stapling position 56*c* to the waiting position 56*a* (see FIG. 19). The reason for this is that the distance (L1), for which the stapler 56 is relieved when the stapling operation is continuously performed, is minimized so far as the interference with the bin is prevented at the time of shifting the bin.

Therefore, the time required to perform the reciprocating operation can be shortened and thus the time taken to complete the stapling operation can be shortened.

<Two-Portion Binding>

Figure 31:
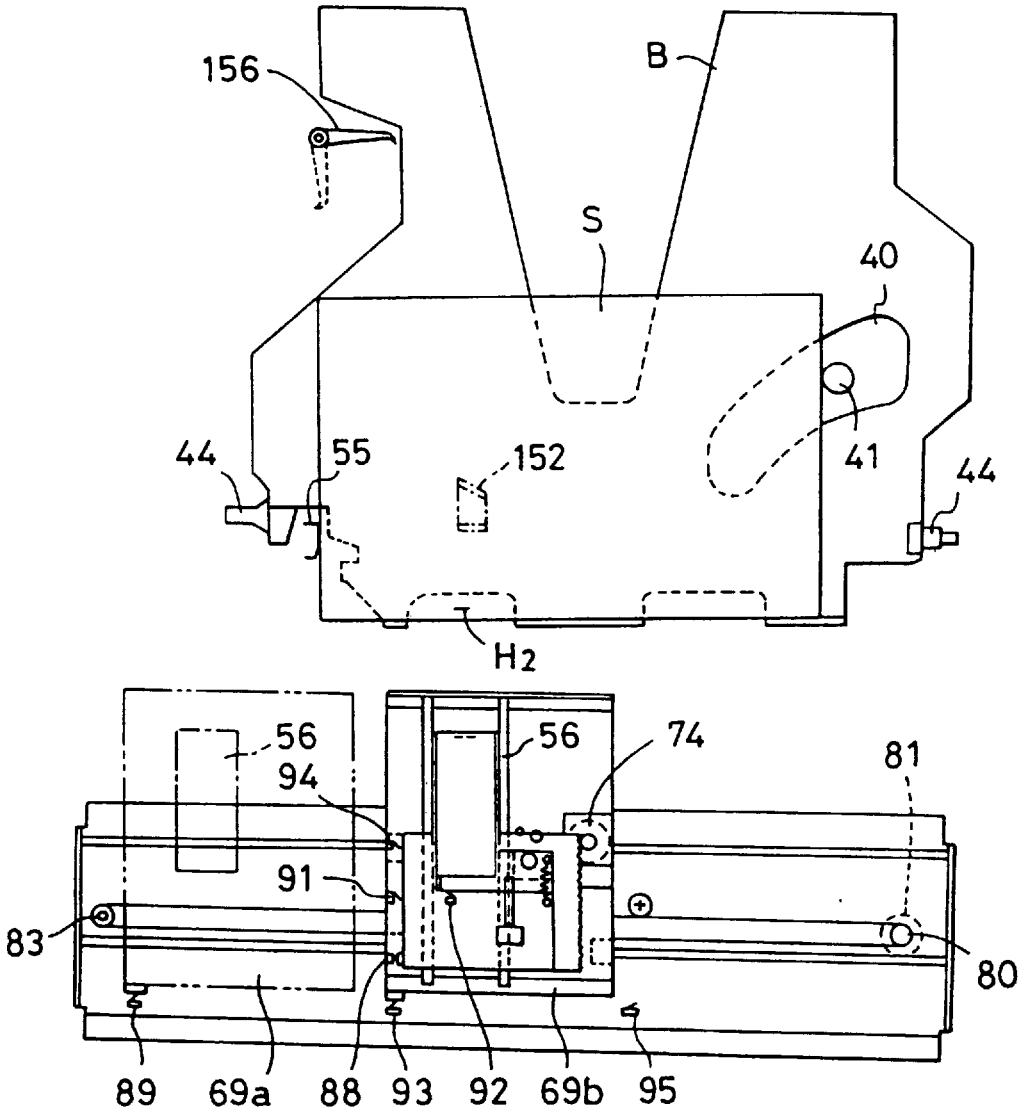
FIG. 31 is a plan view showing the stapler portion and the bin tray portion in a state when the stapling operation is performed in the sheet processing apparatus.
Figures 35, 35B:
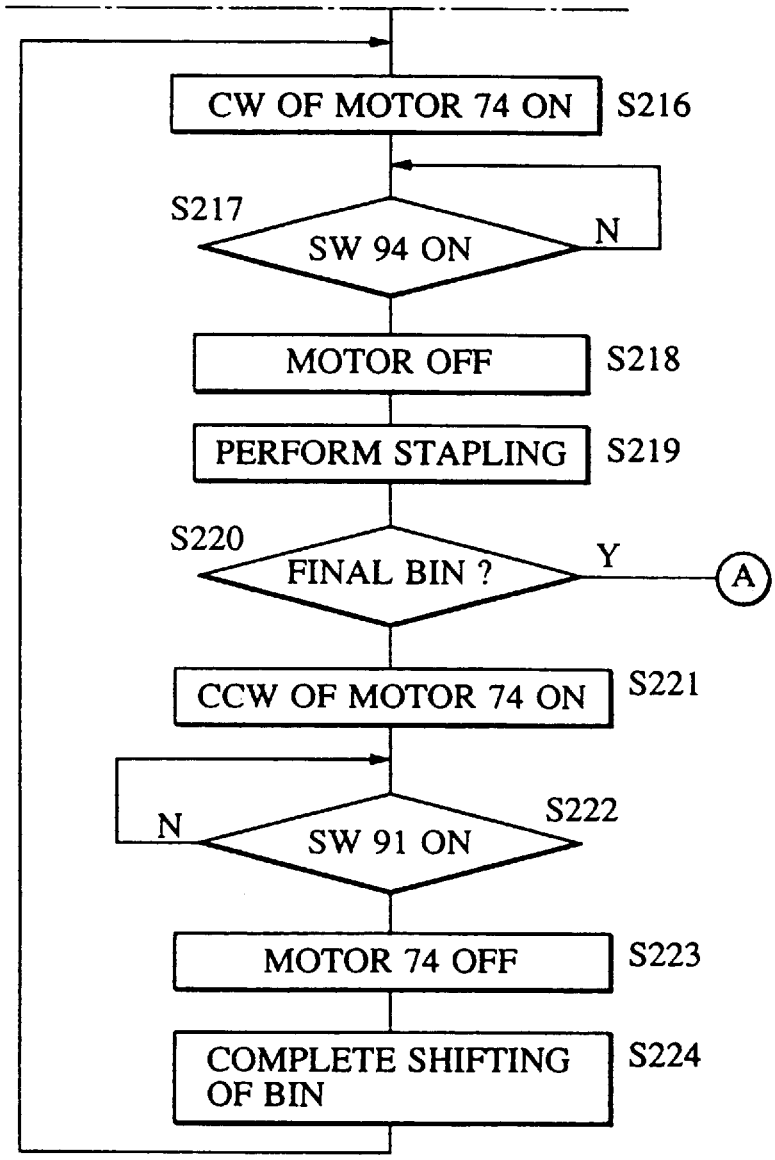
FIG. 35, including
FIGS. 35A and 35B is a flow chart showing the stapling operation to be performed in the sheet processing apparatus.
Figure 35A:
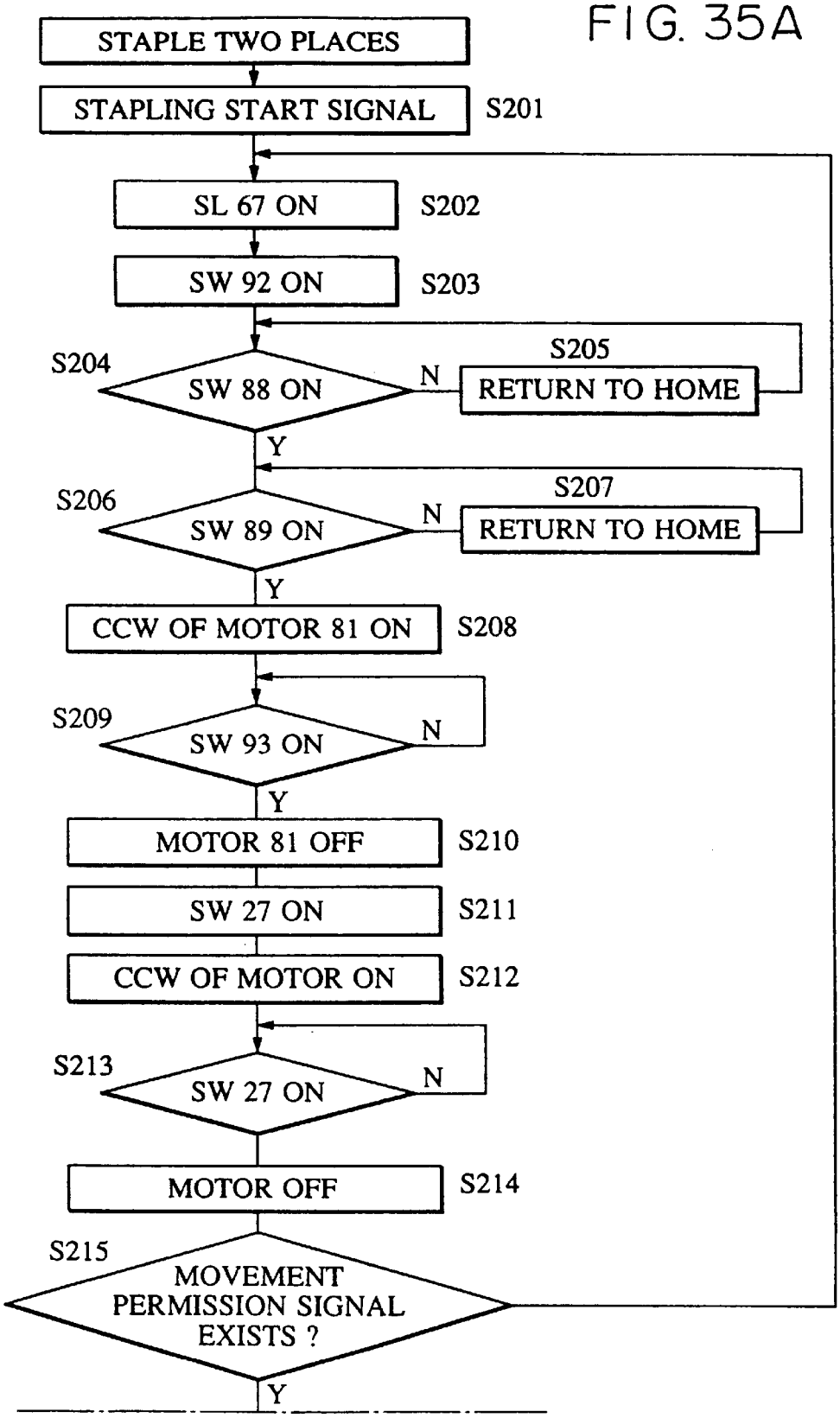
Figure 36:
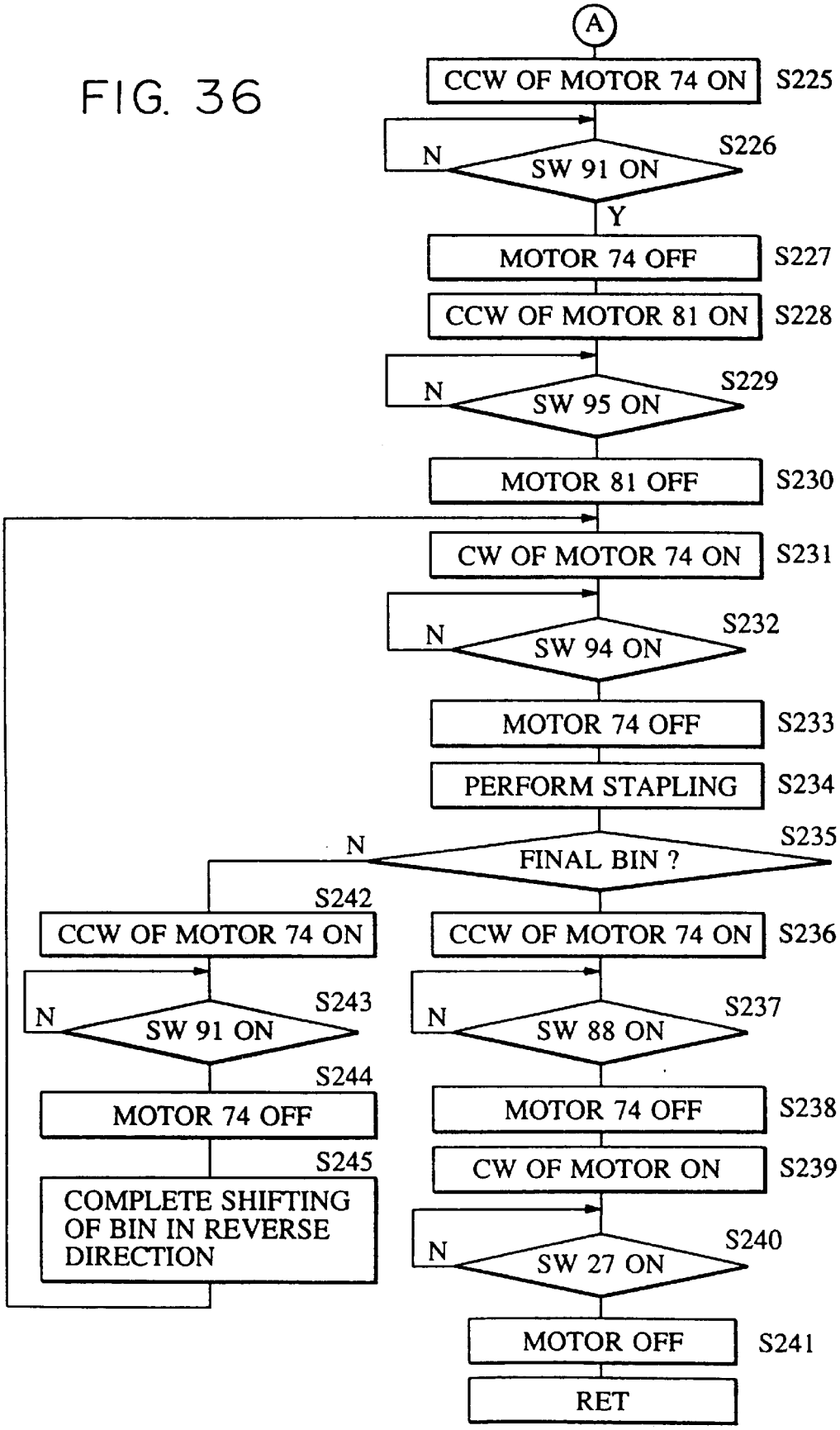
FIG. 36 is a flow chart showing the stapling operation to be performed in the sheet processing apparatus following the operation shown in FIG. 34.
Figure 37:
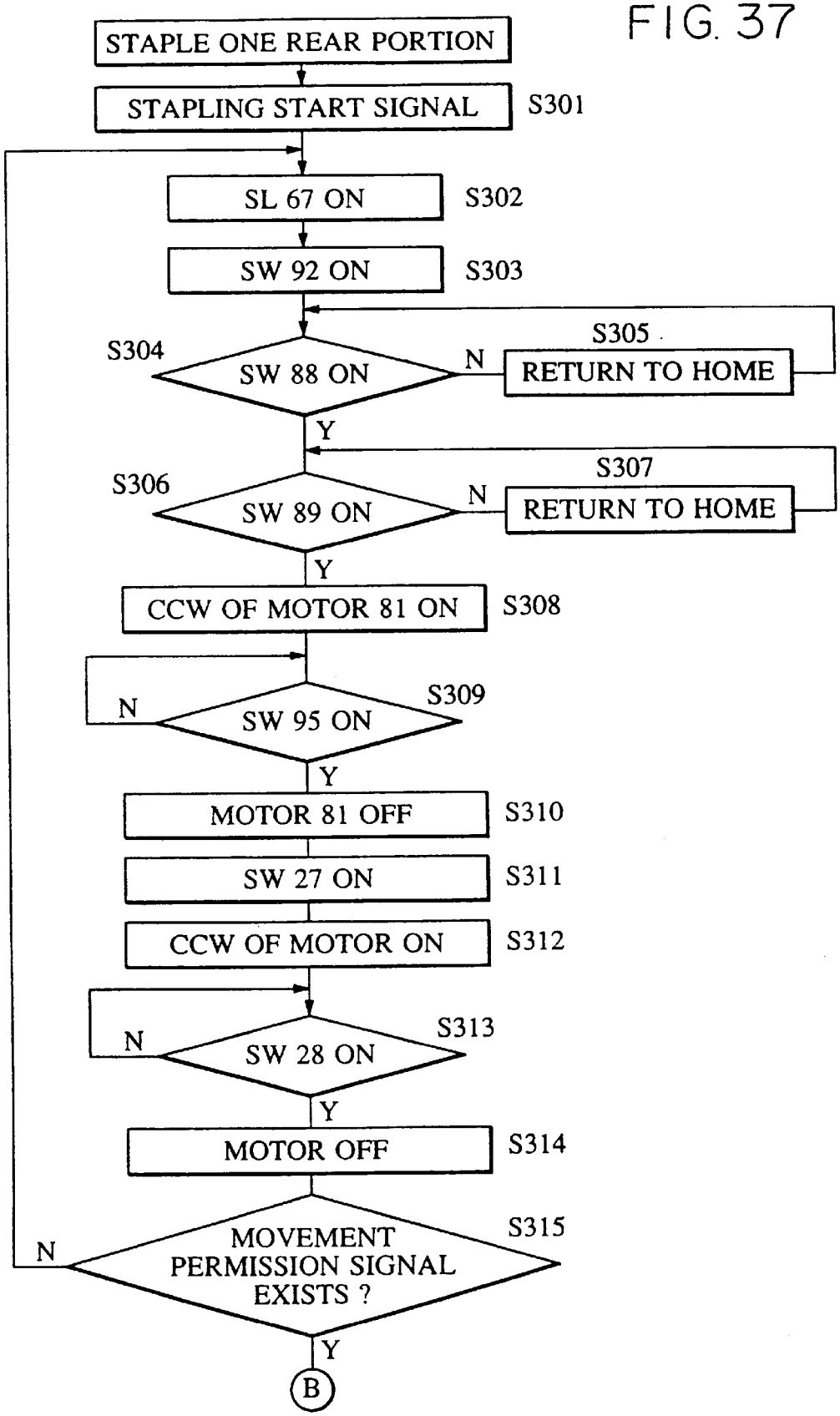
FIG. 37 is a flow chart showing the stapling operation to be performed in the sheet processing apparatus.
Figure 38:
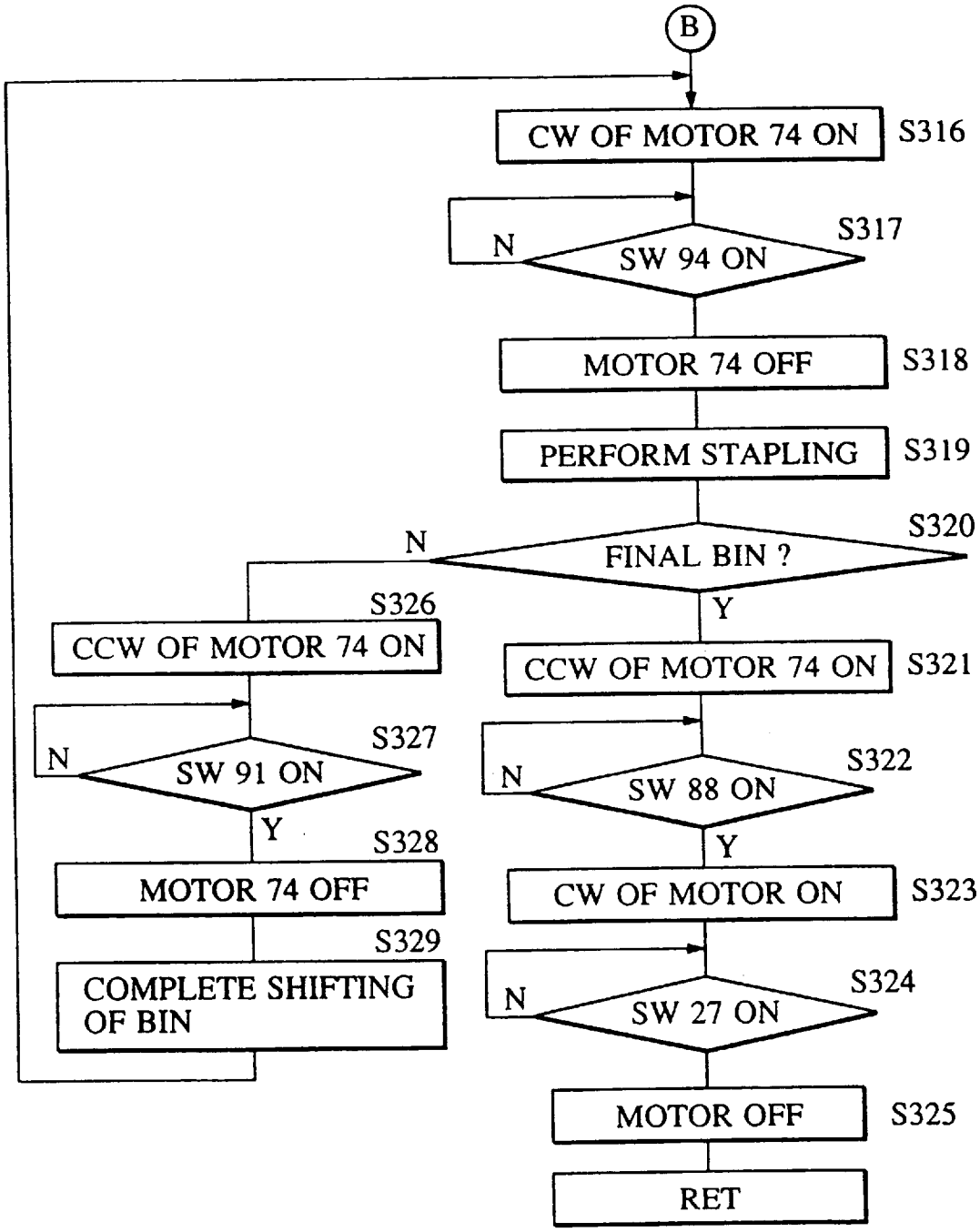
FIG. 38 is a flow chart showing the stapling operation to be performed in the sheet processing apparatus following the operation shown in FIG. 36.

Referring to FIGS. 35 and 36, when a signal indicating the two-portion binding operation has been supplied from the control means (S201), the solenoid 67 is turned on (S202) so that the first support member 62 is, together with the stapler 56, rotated counterclockwise around the support shaft 61 so as to be located (at the position indicated by the alternate long and two short dashes line shown in FIG. 31). The completion of the rotation is detected by the detection member 92 (S203). Whether or not the second support member 63 and the third support member 69 are at the waiting positions is detected by the detection means 88 and 89 (S204 and S206). If they are not at their waiting positions, they are returned to the waiting positions (home positions) (S205 and S207).

At the substantially the same time as the foregoing operation, the motor 81 is rotated counterclockwise (S208) so that the third support member 69 is moved from the position 69*a* to the position 69*b,* and the motor 81 is stopped (S210).

The position 69*b* of the third support member 69 is detected by the detection means 92 (S209).

The motor 81 may comprise, for example, a DC motor, and its rotation may be detected by the detection means 93. A stepping motor or the like may be employed so as to be stopped after the movement by a predetermined distance from the detection means 89 that detects the waiting position of the third support member 69. In the foregoing case, the detection means 93 also serves as a means for detecting the stop position.

At the substantially the same time as the foregoing operation, the leading passage 26 in the state detected by the detection means 27 (S211) moved from the usable position 26*a* (the position indicated by a continuous line shown in FIG. 3) to the relief position 26*b* (alternate long and two short dashes line shown in FIG. 3) when the drive motor (not shown) of the sheet conveyance system is rotated to rotate the eccentric cam 29*a* of the foregoing pushing mechanism.

If reaching of the leading passage 26 to the relief position 26*b* has been detected by the detection means 28 (S213), the drive motor (not shown) is stopped (S214), and the leading passage 26 is maintained at the stopped position.

Figure 32:
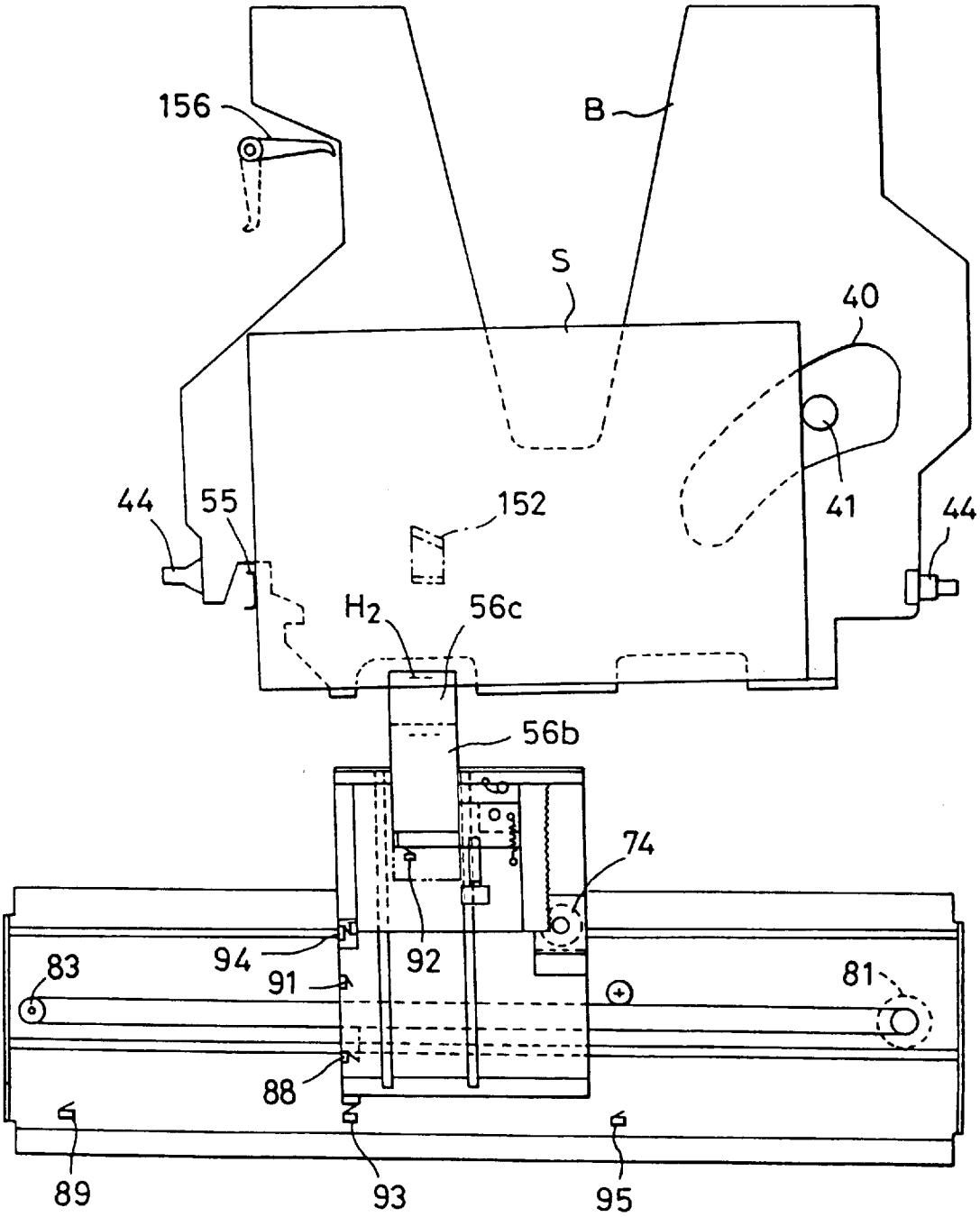
FIG. 32 is a plan view showing the stapler portion and the bin tray portion in a state when the stapling operation is performed in the sheet processing apparatus.

When the detection means 93, 92, 28 and 88 have supplied signals representing that all elements have been moved to predetermined positions to the control means, the control means, similarly to the one-front-portion binding operation, transmits a signal that permits the movement to the stapling position of the second support member 63 (S215) so that the motor 74 is rotated clockwise (S216). Thus, the stapler 56 is moved from the intermediate waiting position 56 to the stapling position 56*c*. The detection means 94 performs the detection operation (S217), and then the motor 74 is stopped (S218). Then, staple H is injected at the stapling position H2 for the sheet S (S219) (see FIGS. 31 and 32).

If the detection means 28 does not detect the leading passage 26, that is, if the leading passage 26 has not been moved to the relief position (alternate long and one dashed line shown in FIG. 3), the movement of the second support member 63 is inhibited.

In the foregoing operation, the relief position 26*b* for the leading passage 26 is determined to a position at which interference can be prevented when the stapler 56 is moved to the stapling position 56*c*. Since the stapler 56 is operated in such a manner that its respective positions are confirmed by the detection means 28, 93, 92 and 88 (in particular, by the detection means 28), the interference between the stapler 56 and the bin B and the leading passage 26 can be prevented. The movement of the leading passage 26 and the movements of the first support member 62 and the third support member 69 are performed during a period in which the first support member 62 is detected by the detection means 88. Therefore, if the stapler 56 is at the waiting position waiting position 56*a,* any process may be performed previously or the processes may be performed simultaneously.

Thus, the stapling operation by the stapler 56 is completed.

In a case where one bin is processed (S220), the stapler 56 is moved to the intermediate waiting position 56*b* because of the same reason as that for the foregoing process, the motor 74 is rotated counterclockwise (S225). After the detection means 91 has detected the stapler 56, the motor 74 is stopped (S227), followed by restoring the stapler 56.

Then, the motor 81 is rotated counterclockwise (S228), and the third support member 69 is moved to the position 69*c*. The position 69*c* of the third support member 69 is detected by the detection means 95 (S230) (see FIG. 33).

At the foregoing position, the second support member 63 is moved, and the motor 74 is rotated clockwise (S231) so that the stapler 56 is moved from the intermediate waiting position 56*b* to the stapling position 56*c*. After the detection means 94 has performed the detection (S232), the motor 74 is stopped (S233). The staple H is injected to the binding position H3 which is one of the two-portion binding positions (S234). Since binding in one bin is performed (S234), the motor 74 is rotated counterclockwise (S226) to move the staple 56 from the stapling position 56*c* to the waiting position 56*a*. After the detection means 88 has performed the detection (S337), the motor 74 is stopped (S338). Thus, binding in one bin is completed.

When the detection means 88 has detected that the second support member 63 is at the waiting position, the drive motor (not shown) of the sheet conveyance system is rotated reversely (S239) so that the leading passage 26 is returned to the usable position 26*a* (the position indicated by the continuous line shown in FIG. 3). The returned leading passage 26 is detected by the detection means 27 (S240). Thus, the drive motor is stopped (S241).

The operation of binding to be performed in a plurality of bins B will now be described.

Initially, the third support member 69 is moved to the position 69*b,* and stapling of the stapling position H2 in the final bin is performed (the stapler 56 is moved from the waiting position 56*a* to stapling position 56*c*).

In steps S201 to S220, the stapler 56 is moved from the stapling position 56*c* to the intermediate waiting position 56*b* by counterclockwise rotating the motor 74 (S221). After the detection means 91 has performed the detection (S222), the motor 74 is stopped (S223).

When shifting of the bins has been completed similarly to the foregoing process (S224), the foregoing operation (intermediate waiting position 56*b*—stapling position 56*c*—intermediate waiting position 56*b*) is repeated so that stapling is performed. Thus, stapling at position H2 of the sheets in the bins, the number of which is the desired number of copies, is completed.

At the position of the in at which stapling at the stapling position H2 is performed, the third support member 69 is moved to the position 69*c* (S220 to S230) similarly to the foregoing process.

At the foregoing position, the stapler 56 is moved from the intermediate waiting position 56*b* to the stapling position 56*c* so that stapling is performed (S231 to S232). Then, the motor 74 is rotated counterclockwise (S242) to move the stapler 56 to the intermediate waiting position 56*b*. After the detection means 91 has performed the detection (S243), the motor 74 is stopped (S244) to return the stapler 56.

Then, the bin is shifted in a direction opposing the direction, in which the bin has been shifted (S245), and a similar operation (intermediate waiting position 56*b*—stapling position 56*c*—intermediate waiting position 56*b*) is repeated with shifting the bin so that stapling is performed (S231 to S234).

After stapling at the position H3 has been completed in the final bin (the bin in which the stapling at position H2 has been first performed), the stapler 56 is returned to the waiting position 56*a* so that two places stapling in all bins is completed (S226, S237 and S238).

The third support member 69 is moved from the position 69*c* to the position 69*a* at a predetermined timing. If the fact that the stapler 56 is at the waiting position 56*a,* that is, the fact that the second support member 63 is at the waiting position has been detected by the detection means 88, the leading passage 26 is returned to the usable position 26*a* (the position indicated by the continuous line shown in FIG. 30). The position 26*a* is detected by the detection means 27 (S239 to S241).

If the detection means 88 has not detected the second support member 63, movement of the leading passage 26 to the usable position 26*a* is inhibited.

Referring to FIG. 3, as a matter of course, the detection means 27 and the stapler 56 are disposed not to interfere with each other in the thrusting direction (a front portion of FIG. 3).

<One-Inner-Portion Binding>

Figure 33:
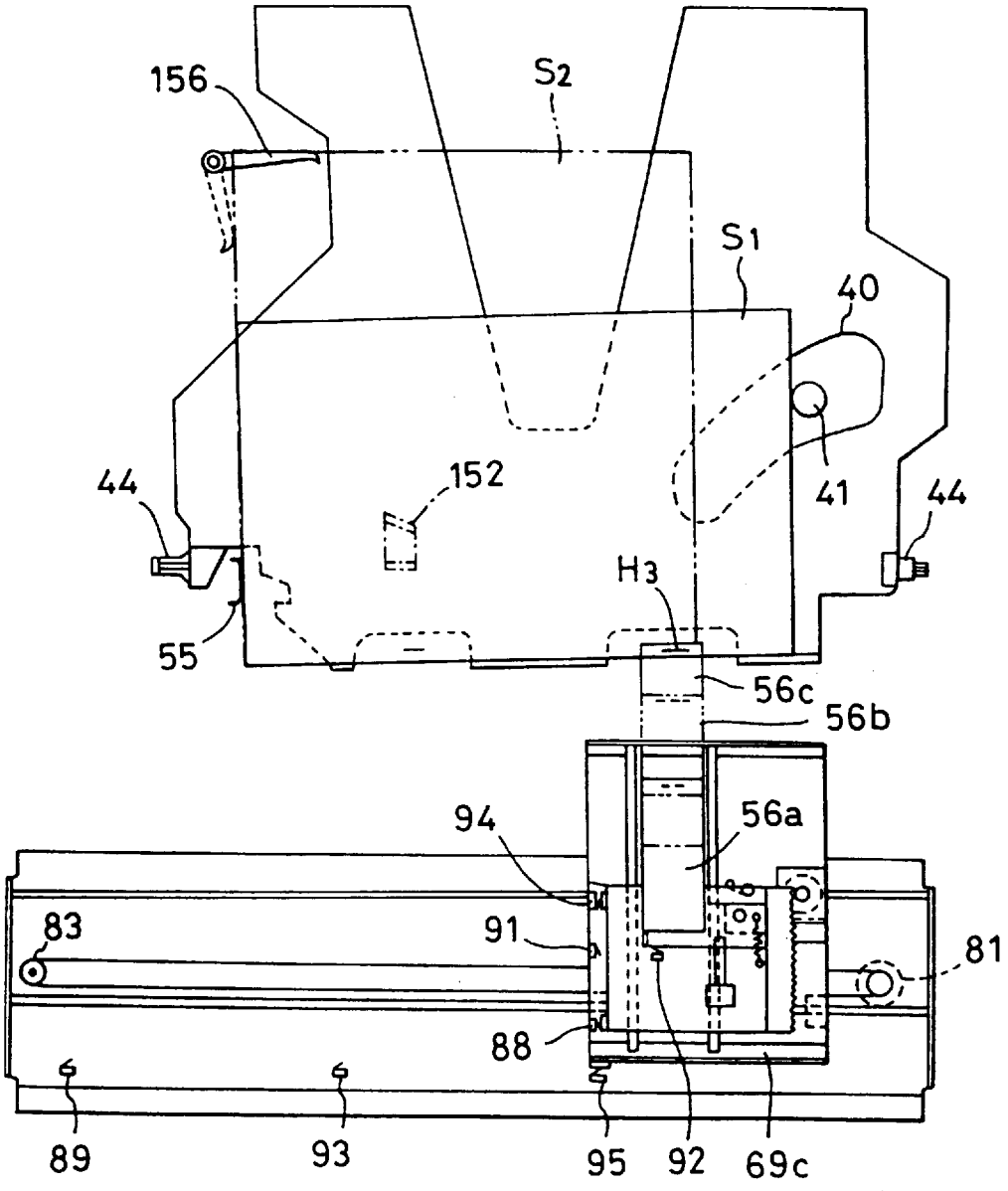
FIG. 33 is a plan view showing the stapler portion and the bin tray portion in a state when the stapling operation is performed in the sheet processing apparatus.

If a signal representing the one-inner-portion binding operation (binding position H3) at which sheet S2 is stapled as shown in FIG. 33) has been supplied from the control means (S301), the solenoid 67 is turned on similarly to the foregoing two-portion binding operation (S302). The stapler 56 is brought to a state shown in FIG. 33 (the foregoing position is detected by the detection means 92 (S303)).

Similarly, the initial position for each process is detected by the detection means 89 and 88 (S304 and S306). If the positions have not been detected, the stapler 56 is returned to the waiting position (S305 and S307), and the third support member 69 is moved to the position 69*c* by counterclockwise rotating the motor 81 (S308). The foregoing position is detected by the detection means 95 so that the motor 81 is stopped (S310).

Also the leading passage 26 is moved to the relief position 26*b* by rotating the drive motor (not shown) of the sheet conveyance system in a state where the detection means 27 has detected the same (S311) similarly to the two-portion binding operation. The detection means 28 detects it (S313), and the drive motor is stopped (S314).

The operation order of the leading passage 26 and the operations of the first, second and the third support members 62, 63 and 69 may be determined arbitrarily.

Similarly to the foregoing operation, when the detection means 95, 92, 88 and 94 have confirmed all operation positions, a signal permitting the movement is transmitted (S315), and the second support member 63 is moved to the stapling position by rotating the motor 74 clockwise (S316). The stapler 56 is moved from the waiting position 56*a* to the stapling position 56*c*. When the detection means 94 has performed the detection (S317), the motor 74 is stopped (S318), stapling at the stapling position H3 is performed (S319). In a case of a one-bin process (S320), the motor 74 is rotated counterclockwise (S321) to move it to the waiting position 56*a*. After the detection means 88 has performed the detection (S322), the motor 74 is stopped (S323), and thus the stapling operation is completed. If the detection means 28 has not detected it, that is, if the leading passage 26 has not been moved to the relief position 26*b,* movement of the second support member 63 to the sheet stapling position is inhibited.

If the detection means 88 has detected that the second support member 63 is at the waiting position, the drive motor (not shown) of the sheet conveyance system is rotated reversely (S323) so that the leading passage 26 is returned to the usable position 26*a* (the position indicated by the continuous line shown in FIG. 3). After the detection means 27 has performed the detection (S324), the drive motor is stopped (S325).

If the detection means 88 has not detected the second support member 63, the movement of the leading passage 26 to the usable position 26*a* is inhibited.

The stapling operations in a plurality of bins B will now be described.

Similarly to the foregoing process, the third support member 69 is moved to the position 69*c,* and the leading passage 26 is moved to the relief position 26*b*. Then, similarly to the one-front-portion binding operation, the stapler 56 is moved from the waiting position 56*a* to the stapling position 56*c* so that stapling at the stapling position H3 is performed (S301 to S320). Then, the motor 74 is rotated counterclockwise (S326), followed by returning the stapler 56 to the intermediate waiting position 56*b* at which it can be detected by the detection means 91 (S327). Then, the motor 74 is stopped (S328).

After sheets in the first bin have been stapled at the position H3, simultaneously with the completion of shifting of the bin (S329), the movement of the stapler 56 (intermediate waiting position 56*b*—stapling position 56*c*) and the stapling operation are repeated. After stapling of a predetermined number of bundles has been completed (S316 to S320 and S326 to S329), the stapler 56 is returned to the waiting position 56*a* (S321 to S323).

Similarly to the foregoing process, when the detection means 88 has detected the stapler 56 at the waiting position 56*a,* the leading passage 26 is returned to the usable position 26*a* (the position indicated by the continuous line shown in FIG. 3) (if the detection means 88 has not detected it, the movement of the leading passage 26 is inhibited). Also the third support member 69 is returned to the position 69*a* (S324 and S325).

Thus, the stapling operation is performed in the case of the one-front-portion binding operation, the two-portion binding operation, and the one-inner-portion binding operation to staple on and a plurality of sheet bundles.

The stapling mode may be an afterward stapling operation in which a stapling start button (not shown) is used after sheets have been distributed and stacked on the bins due to the sorting operation; or a stapling operation in which stapling is automatically started after sorting has been completed.

The foregoing operation may, of course, be performed in a group mode (a mode in which the copies of the same original document are classified and stacked on one bin).

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. A sheet post processing apparatus, comprising:

at least one sheet receiving tray for accommodating sheets;

sheet discharging means for discharging sheets to said sheet receiving tray;

sheet processing means for processing, at a plurality of positions at a predetermined interval, sheets accommodated on said sheet receiving tray adjacent first edges of the sheets;

a reference member for guiding second edges of the sheets, the second edges extending in a direction crossing with an extending direction of the first edges, on said sheet receiving tray and for functioning as a reference for alignment of the sheets to a reference position;

an aligning member movable to urge the sheets on said receiving tray to said reference member; and means for changing, before said aligning member urges the sheet, the reference position of said reference member in accordance with a size of the sheets, to make a distance from the second edges of the sheets to one of the plurality of positions where the sheets are processed by said sheet processing means which is closer to the second edges, substantially equal to a distance from third edges of the sheets, the third edges being opposite form the second edges, to another of the plurality of positions where the sheets are processed by said sheet processing means which is closer to the third edges.

2. An apparatus according to claim 1, wherein said sheet processing means carries out its operation selectively for a corner adjacent the reference position or adjacent the alignment position.

3. An apparatus according to claim 1 or 2, wherein said sheet processing means includes one sheet process which is movable along the first edges of the sheets.

4. An apparatus according to claim 1, wherein said changing means changes, in accordance with a size of the sheets, the reference position so that a distance between the processing position adjacent the third edges and the third edges is substantially constant.

5. A sheet post processing apparatus, comprising:

at least one sheet receiving tray for accommodating sheets;

sheet discharging means for discharging sheets to said sheet receiving tray;

sheet processing means for processing sheets accommodated on said sheet receiving tray, adjacent first edges;

a reference member for guiding second edges of the sheets, the second edges extending in a direction crossing with an extending direction of the first edges, on said sheet receiving tray and for functioning as a reference for alignment of the sheets to a reference position;

an aligning member movable to act on third edges of the sheets, the third edges being opposite from the second edge, to urge the sheets on said receiving tray to said reference member; and means for changing, before said aligning member urges the sheet, the reference position of said reference member in accordance with a size of the sheets to make substantially constant a distance from the third edges of the sheets to a position where the sheets are processed by said sheet processing means adjacent the third edges.

6. An apparatus according to claim 1 or 5, wherein said reference member is provided with a swingable member for changing the reference position.

7. A sheet post processing apparatus, comprising:

at least one sheet receiving tray for accommodating sheets;

sheet discharging means for discharging the sheets to said sheet receiving tray;

binding means for binding sheets accommodated on said sheet receiving tray adjacent first edges of the sheets;

a reference member for guiding second edges of the sheets, the second edges extending in a direction crossing with an extending direction of the first edges, on said sheet receiving tray and for functioning as a reference for alignment of the sheets to a reference position;

an aligning member movable to act on third edges to urge the sheets on said receiving tray to said reference member, the third edges being opposite from the second edges of the sheets, wherein said apparatus is operable in a first single binding mode in which the sheets are bound adjacent the second edges, a second single binding mode in which the sheets are bound adjacent the third edges, and a double binding mode in which the sheets are bound adjacent the second edges and the third edges at two positions which are spaced with a predetermined distance; and means for changing, before said aligning member urges the sheet, the reference position of said reference member to provide substantially symmetrical binding positions in the double binding mode and to provide a substantially constant binding position in the second single binding mode, in accordance with a size of the sheets to be bound.

8. An apparatus according to claim 7, wherein said binding means is swingable to provide inclined stapling in a corner binding mode.

9. An apparatus according to claim 7, wherein said apparatus is operable in a sorting mode, and when said apparatus is operated in the sorting mode, said double binding mode is selected.

10. An apparatus according to claim 9, further comprising operation setting means for inputting signals for selectively binding the sheets after sorting of the sheets, wherein the reference position is moved from the reference position for the double binding mode to the reference position for the first single binding mode, when the first single binding mode is selected in said operation setting means after the sorting operation in the sorting mode, and wherein the binding operation is effected after said aligning member moves the set of sheets to the position for the first single binding mode.

11. An apparatus according to claim 7, wherein said reference member has a swingable member, driving means for swinging the swingable member and control means, wherein the reference position changes by swinging motion of said swingable member.

12. An image forming apparatus, comprising:

image forming means for forming images on sheets;

at least one sheet receiving tray for accommodating the sheets having images formed by said image forming means;

sheet discharging means for discharging sheets to said sheet receiving tray;

sheet processing means for processing, at a plurality of positions at a predetermined interval, sheets accommodated on said sheet receiving tray adjacent first edges of the sheets;

a reference member for guiding second edges of the sheets, the second edges extending in a direction crossing with an extending direction of the first edges, on said sheet receiving tray and for functioning as a reference for alignment of the sheets to a reference position;

an aligning member movable to urge the sheets on said receiving tray to said reference member; and means for changing, before said aligning member urges the sheet, the reference position of said reference member in accordance with a size of the sheets, to make a distance from the second edges of the sheets to one of the plurality of positions where the sheets are processed by said sheet processing means which is closer to the second edges, substantially equal to a distance from third edges of the sheets, the third edges being opposite from the second edges, to another of the plurality of positions where the sheets are processed by said sheet processing means which is closer to the third edges.

13. An apparatus according to claim 12, wherein said sheet processing means carries out its operation selectively for a corner adjacent said reference position or adjacent said alignment position.

14. An apparatus according to claim 12 or 13, wherein said sheet processing means includes one sheet processor which is movable along the first edges of the sheets.

15. An apparatus according to claim 12, wherein said changing means changes, in accordance with a size of the sheets, the reference position so that a distance between the processing position adjacent the third edges and the third edges is substantially constant.

16. An image forming apparatus, comprising:

image forming means for forming images on sheets;

at least one sheet receiving tray for accommodating the sheets having images formed by said image forming means;

sheet discharging means for discharging sheets to said sheet receiving tray;

sheet processing means for processing sheets accommodated on said sheet receiving tray, adjacent first edges;

a reference member for guiding second edges of the sheets, the second edges extending in a direction crossing with an extending direction of the first edges, on said sheet receiving tray and for functioning as a reference for alignment of the sheets to a reference position;

an aligning member movable to act on third edges of the sheets, the third edges being opposite from the second edges to urge the sheets on said receiving tray to said reference member; and means for changing, before said aligning member urges the sheet, the reference position of said reference member, in accordance with a size of the sheets, to make substantially constant a distance from the third edges of the sheets to a position where the sheets are processed by said sheet processing means adjacent the third edges.

17. An apparatus according to claim 12 or 16, wherein said reference member is provided with a swingable member for changing the reference position.

18. An image forming apparatus, comprising:

image forming means for forming images on sheets;

at least one sheet receiving tray for accommodating the sheets having images formed by said image forming means;

sheet discharging means for discharging the sheets to said sheet receiving tray;

binding means for binding sheets accommodated on said sheet receiving tray adjacent first edges of the sheets;

a reference member for guiding second edges of the sheets, the second edges extending in a direction crossing with an extending direction of the first edges, on said sheet receiving tray and for functioning as a reference for alignment of the sheets to a reference position;

an aligning member movable to act on third edges to urge the sheets on said receiving tray to said reference member, the third edges being opposite from the second edges of the sheets, wherein said apparatus is operable in a first single binding mode in which the sheets are bound adjacent the second edges, a second single binding mode in which the sheets are bound adjacent the third edges, and a double binding mode in which the sheets are bound adjacent the second edges and the third edges at two positions which are spaced with a predetermined distance; and means for changing, before said aligning member urges the sheet, the reference position of said reference member to provide substantially symmetrical binding positions in the double binding mode and to provide a substantially constant binding position in the second single binding mode, in accordance with a size of the sheets to be bound.

19. An apparatus according to claim 18, wherein said binding means is swingable to provide inclined stapling in a corner binding mode.

20. An apparatus according to claim 18, wherein said apparatus is operable in a sorting mode, and when said apparatus is operated in the sorting mode, said double binding mode is selected.

21. An apparatus according to claim 20, further comprising an operation setting means for inputting signals for selectively binding the sheets after sorting of the sheets, the reference position being moved from the reference position for the double binding mode to the reference position for the first single binding mode, when the first single binding mode is selected in said operation setting means after the sorting operation in the sorting mode, wherein the binding operation is effected after the aligning member moves the set of sheets to the position for the first single binding mode.

22. An apparatus according to claim 18, wherein said reference member has a swingable member, driving means for swinging the swingable member and control means, wherein the reference position changes by swinging motion of said swingable member.

* * * * *

UNITED STATES PATENT AND TRADEMARK OFFICE

CERTIFICATE OF CORRECTION

PATENT NO. : 5,839,048
DATED : November 17, 1998
INVENTOR(S) : Katsuhito Kato

It is certified that error appears in the above-identified patent and that said Letters Patent is hereby corrected as shown below:

Column 2,
Line 10, "operatively" should read --operativity--;
Line 14, "cross sectional" should read --cross-sectional--.

Column 3,
Line 7, "cross sectional" should read --cross-sectional--;
Line 35, "35B" should read --35B,--.

Column 4,
Line 65, "a" should read --n--.

Column 5,
Line 40, "form" should read --from--;
Line 67, rub" should read --rib--.

Column 6,
Line 41, "place" should read --place,--;
Line 49, "passage)" should read --passage")--.

Column 8,
Line 5, "upper most" should read --uppermost--.

Column 9,
Line 14, "cross sectional" should read --cross-sectional--.

Column 11,
Line 13, "be" should be deleted;
Line 14, "is" should reat --to be--'
Line 67, "surface." should read --surface Q.--

Column 12,
Line 42, "(as)," should read --(3),--.

Column 13,
Line 7, "(as))" should read --(3))--;
Line 22, "coincide" should read --to coincide--.

UNITED STATES PATENT AND TRADEMARK OFFICE

CERTIFICATE OF CORRECTION

PATENT NO. : 5,839,048
DATED : November 17, 1998
INVENTOR(S) : Katsuhito Kato

It is certified that error appears in the above-identified patent and that said Letters Patent is hereby corrected as shown below:

Column 14,
Line 10, "on to" should read --onto--.

Column 15,
Line 12, "between" should read --because--;
Line 34, "although the" should read --The--;
Line 60, "that;" should read --that:--.

Column 16,
Line 31, "(S4)." should read --S4).--;
Line 35, "discharge" should read --discharged--;
Line 51, "on to" should read --onto--.

Column 19,
Line 15 and Line 62 "or" should read --or not--;

Column 21,
Line 31 and Line 32 "bundle" should read --bundles--.

Column 22,
Line 2, "smaller" should read --smaller than--.

Column 24,
Line 32, "an" should read --a--.

Column 26,
Line 7, "between" should read --before--;
Line 54, "stabling" should read --stapling--;
Line 60, "respectively" should read --respective--.

Column 27,
Line 39, "to" should be deleted.

Column 28,
Line 1, "acculide" should read --ACCURIDE® (available from Nihon Accuride Kabushi Kaisha, Japan)--;
Line 10, "cartridge" should read --cartridge is--;
Line 43, "as," should read --is,--.

UNITED STATES PATENT AND TRADEMARK OFFICE

CERTIFICATE OF CORRECTION

PATENT NO. : 5,839,048
DATED : November 17, 1998
INVENTOR(S) : Katsuhito Kato

It is certified that error appears in the above-identified patent and that said Letters Patent is hereby corrected as shown below:

Column 29,
Line 4, "arise" should read --arises--;
Line 39, "downwards" should read --downwardly--.

Column 31,
Line 63, "acing" should read --facing--.

Column 32,
Line 59, "coincide" should read --to coincide--.

Column 33,
Line 2, "warping" should read --wrapping--.

Column 35,
Line 19 and 34 "the" (1st occurrence) should be deleted;

Column 39,
Line 5 and 47 "post processing" should read --post-processing--;
Line 31, "form" should read --from--;
Line 40, "process" should read --processor--;
Line 63, "edge" should read --edges--.

Column 40,
Line 8, "post processing" should read --post-processing--.

Signed and Sealed this

Twenty first Day of August, 2001

Nicholas P. Godici

*Attest:*

*Attesting Officer*

NICHOLAS P. GODICI
*Acting Director of the United States Patent and Trademark Office*